US011547924B2

(12) United States Patent
Labonte et al.

(10) Patent No.: US 11,547,924 B2
(45) Date of Patent: Jan. 10, 2023

(54) ICE SKATE

(71) Applicant: BAUER HOCKEY LLC, Exeter, NH (US)

(72) Inventors: Ivan Labonte, Montreal (CA); Jean-Francois Corbeil, Prevost (CA)

(73) Assignee: Bauer Hockey, LLC, Exeter, NH (US)

( * ) Notice: Subject to any disclaimer, the term of this patent is extended or adjusted under 35 U.S.C. 154(b) by 0 days.

(21) Appl. No.: 15/919,117

(22) Filed: Mar. 12, 2018

(65) Prior Publication Data

US 2018/0361224 A1 Dec. 20, 2018

Related U.S. Application Data

(63) Continuation of application No. 14/212,468, filed on Mar. 14, 2014, now abandoned.

(60) Provisional application No. 61/783,590, filed on Mar. 14, 2013.

(51) Int. Cl.

| | |
|---|---|
| ***A63C 1/30*** | (2006.01) |
| ***A63C 1/42*** | (2006.01) |
| ***A63C 1/32*** | (2006.01) |

(52) U.S. Cl.

CPC ..... *A63C 1/30* (2013.01); *A63C 1/303* (2013.01); *A63C 1/32* (2013.01); *A63C 1/42* (2013.01); *A63C 2203/42* (2013.01)

(58) Field of Classification Search

CPC .. A63C 1/02; A63C 1/303; A63C 1/32; A63C 1/30; A63C 1/22; A63C 1/34; A63C 1/42

See application file for complete search history.

(56) References Cited

U.S. PATENT DOCUMENTS

| | | | |
|---|---|---|---|
| 37,934 | A | 3/1863 | Yates |
| 1,371,609 | A | 3/1921 | Drevitson |
| 1,666,690 | A | 4/1928 | Drevitson |
| 1,773,017 | A | 8/1930 | Thompson |
| 4,008,901 | A | 2/1977 | Conn |
| 4,053,168 | A | 10/1977 | Goverde |
| 4,218,069 | A | 8/1980 | Baikie |

(Continued)

FOREIGN PATENT DOCUMENTS

| | | |
|---|---|---|
| CA | 2638352 | 2/2009 |
| CA | 2916673 | 7/2016 |

(Continued)

OTHER PUBLICATIONS

Non-final Office Action dated May 17, 2017 in connection with U.S. Appl. No. 14/988,191, 25 pages.

(Continued)

*Primary Examiner* — Emma K Frick

(57) ABSTRACT

An ice skate comprising a blade holder having U-shaped inner and outer members that are spaced apart to define a hollow space therebetween. The U-shaped outer member has an elongated blade-supporting base and front and rear pillars that are spaced apart in a longitudinal direction of the blade holder. At least part of the elongated blade-supporting base, front pillar and rear pillar is made of a composite material such as a fiber-matrix composite material. The ice skate also has a blade comprising a runner and a body made of composite material with a matrix and a plurality of fibers embedded in the matrix.

44 Claims, 43 Drawing Sheets

(56) References Cited

U.S. PATENT DOCUMENTS

| | | | | |
|---|---|---|---|---|
| 4,453,727 | A | 6/1984 | Bourque | |
| 4,509,276 | A | 4/1985 | Bourque | |
| 4,549,742 | A | 10/1985 | Husak | |
| 5,248,156 | A | 9/1993 | Cann | |
| 5,326,115 | A | 5/1994 | Seltzer | |
| 5,332,242 | A | 7/1994 | Cann | |
| 5,484,148 | A | 1/1996 | Olivieri | |
| 5,505,467 | A | 4/1996 | Hill | |
| 5,641,169 | A | 6/1997 | Bekessy | |
| 5,769,434 | A | 6/1998 | Wurthner | |
| 5,839,734 | A | 11/1998 | Steinhauser | |
| 5,988,683 | A | 11/1999 | Venier | |
| 6,105,975 | A | 8/2000 | Shum | |
| 6,109,622 | A | 8/2000 | Reynolds | |
| 6,164,667 | A | 12/2000 | Olivieri | |
| 6,416,064 | B1 | 7/2002 | Evans | |
| 6,467,778 | B1 | 10/2002 | Goldsmith et al. | |
| 6,485,033 | B2 | 11/2002 | Nicoletti | |
| 6,761,363 | B2 | 7/2004 | Fask | |
| 7,380,801 | B2 | 6/2008 | Rudolph | |
| 7,392,991 | B2 * | 7/2008 | Labonte | A63C 1/02 280/11.12 |
| 7,628,405 | B2 | 12/2009 | Smith | |
| 7,673,884 | B2 | 3/2010 | Wurthner | |
| 7,758,053 | B2 | 7/2010 | Wylie | |
| 7,793,947 | B2 | 9/2010 | Labonte | |
| 7,806,418 | B2 | 10/2010 | Labonte | |
| 7,866,675 | B2 | 1/2011 | Hauser | |
| 7,896,363 | B2 | 3/2011 | Lovejoy | |
| 7,950,676 | B2 | 5/2011 | Goldsmith | |
| 8,109,536 | B2 | 2/2012 | Labonté | |
| D659,216 | S | 5/2012 | Wuerthner | |
| 8,277,284 | B2 | 10/2012 | Wilson | |
| 8,329,083 | B2 | 11/2012 | Jou | |
| 8,353,535 | B2 | 1/2013 | Salmon | |
| 8,387,286 | B2 | 3/2013 | Koyess et al. | |
| 8,505,217 | B2 | 8/2013 | Stewart | |
| 8,684,368 | B2 | 4/2014 | Van Horne et al. | |
| 8,770,595 | B2 | 7/2014 | Cruikshank | |
| 8,857,823 | B2 | 10/2014 | Mars | |
| 8,876,124 | B2 | 11/2014 | Pokupec | |
| 9,004,502 | B2 | 4/2015 | Van Horne et al. | |
| 9,084,927 | B2 | 7/2015 | Lewis | |
| 9,186,569 | B2 | 11/2015 | Wuerthner | |
| 9,295,901 | B2 | 3/2016 | Cruikshank | |
| D762,275 | S | 7/2016 | Labonte | |
| 9,510,639 | B2 | 12/2016 | Cruikshank et al. | |
| D784,471 | S | 4/2017 | Labonte | |
| 9,693,600 | B1 | 7/2017 | Van Horne | |
| 9,936,762 | B2 | 4/2018 | Koyess et al. | |
| D837,318 | S | 1/2019 | Rouzier | |
| 10,195,514 | B2 | 2/2019 | Davis | |
| D844,726 | S | 4/2019 | Rouzier | |
| D845,410 | S | 4/2019 | Rouzier | |
| D845,416 | S | 4/2019 | Rouzier | |
| 10,376,771 | B2 | 8/2019 | Rouzier et al. | |
| 10,406,424 | B2 | 9/2019 | Gans et al. | |
| D868,915 | S | 12/2019 | Faucher et al. | |
| 10,532,269 | B2 | 1/2020 | Davis et al. | |
| D875,196 | S | 2/2020 | Evon | |
| D888,176 | S | 6/2020 | Evon | |
| 11,130,044 | B2 | 9/2021 | Davis et al. | |
| 2002/0175481 | A1 | 11/2002 | Steinhauser | |
| 2003/0011150 | A1 | 1/2003 | Goldsmith | |
| 2004/0140631 | A1 | 7/2004 | Goldsmith | |
| 2004/0168357 | A1 | 9/2004 | Meibock | |
| 2005/0134010 | A1 | 6/2005 | Blankenburg | |
| 2006/0082081 | A1 | 4/2006 | Loveridge | |
| 2006/0108751 | A1 | 5/2006 | Labonté | |
| 2007/0037637 | A1 * | 2/2007 | Jennings | A63B 21/0004 473/423 |
| 2008/0001369 | A1 | 1/2008 | Wylie et al. | |
| 2008/0100008 | A1 | 5/2008 | Wan | |
| 2008/0252061 | A1 | 10/2008 | Demmers et al. | |
| 2009/0045616 | A1 | 2/2009 | Eldridge | |
| 2009/0224494 | A1 | 9/2009 | Wan | |
| 2009/0289427 | A1 | 11/2009 | Lovejoy | |
| 2010/0139126 | A1 | 6/2010 | Koyess | |
| 2010/0156058 | A1 | 6/2010 | Koyess et al. | |
| 2010/0176564 | A1 | 7/2010 | Koyess | |
| 2010/0192412 | A1 | 8/2010 | Stewart | |
| 2010/0194062 | A1 | 8/2010 | Hauser | |
| 2010/0314844 | A1 | 12/2010 | Spah | |
| 2011/0001297 | A1 | 1/2011 | Labonté | |
| 2011/0101665 | A1 | 5/2011 | Van Horne et al. | |
| 2011/0148054 | A1 | 6/2011 | Davis et al. | |
| 2011/0198834 | A1 | 8/2011 | Olivieri | |
| 2012/0187642 | A1 | 7/2012 | Corbeil | |
| 2012/0317842 | A1 | 12/2012 | McClelland | |
| 2013/0038031 | A1 | 2/2013 | Cruikshank | |
| 2013/0285338 | A1 | 10/2013 | Bois | |
| 2014/0250733 | A1 | 9/2014 | Cruikshank | |
| 2014/0252736 | A1 | 9/2014 | Lefebvre | |
| 2014/0265175 | A1 | 9/2014 | Labonté | |
| 2016/0001162 | A1 | 1/2016 | Azzolin | |
| 2016/0193523 | A1 | 1/2016 | Gans et al. | |
| 2016/0114239 | A1 | 4/2016 | Davis et al. | |
| 2016/0236065 | A1 | 8/2016 | Cruikshank | |
| 2017/0361200 | A1 | 12/2017 | Chartrand et al. | |
| 2018/0117448 | A1 | 5/2018 | Rouzier et al. | |
| 2019/0045879 | A1 | 2/2019 | Labonte et al. | |
| 2019/0160355 | A1 | 5/2019 | Rouzier | |
| 2019/0160363 | A1 | 5/2019 | Davis et al. | |
| 2019/0184250 | A1 | 6/2019 | Rouzier | |
| 2019/0255405 | A1 | 8/2019 | Rouzier | |
| 2019/0269997 | A1 | 9/2019 | Labonte et al. | |
| 2019/0351313 | A1 | 11/2019 | Gans et al. | |
| 2020/0222785 | A1 | 7/2020 | Davis | |
| 2021/0394038 | A1 | 12/2021 | Davis et al. | |

FOREIGN PATENT DOCUMENTS

| | | |
|---|---|---|
| CA | 2935348 | 12/2017 |
| CA | 171235 | 6/2019 |
| CA | 3027838 | 6/2019 |
| CA | 2909496 | 7/2020 |
| DE | 545394 | 3/1932 |
| EP | 1 013 314 | 6/2000 |
| EP | 2478937 | 7/2012 |
| EP | 3415205 | 12/2018 |
| WO | WO 2013/022787 | 2/2013 |

OTHER PUBLICATIONS

Final Office Action dated Dec. 21, 2017 in connection with U.S. Appl. No. 14/488,191, 11 pages.

Advisory Action dated Mar. 22, 2018 in connection with U.S. Appl. No. 14/488,191, 3 pages.

Non-Final Office Action issued by the USPTO dated Jun. 20, 2018 in connection with U.S. Appl. No. 14/988,191—10 pages.

Final Office Action issued by the USPTO dated Jan. 22, 2019 in connection with U.S. Appl. No. 14/988,191—8 pages.

Restriction Requirement dated May 15, 2015 for U.S. Appl. No. 14/212,468, 8 pages.

Non-final Office Action dated Sep. 10, 2015 in connection with U.S. Appl. No. 14/212,468, 15 pages.

Final Office Action dated Mar. 1, 2016 in connection with U.S. Appl. No. 14/212,468, 20 pages.

Non-Final Office Action dated Mar. 20, 2017 in connection with U.S. Appl. No. 14/212,468, 20 pages.

Final Office Action dated Oct. 12, 2017 in connection with U.S. Appl. No. 14/212,468, 18 pages.

Non-Final Office Action dated Feb. 6, 2017 in connection with U.S. Appl. No. 15/199,179, 8 pages.

Non-final Office Action dated Jan. 25, 2018 in connection with U.S. Appl. No. 15/670,500, 6 pages.

Non-final Office Action dated May 29, 2018 in connection with U.S. Appl. No. 15/670,500, 9 pages.

Final Office Action issued by the USPTO dated Dec. 26, 2018 in connection with U.S. Appl. No. 15/670,500—9 pages.

(56) References Cited

OTHER PUBLICATIONS

Restriction Requirement dated Mar. 14, 2016 for U.S. Appl. No. 14/920,664, 8 pages.
Non-final Office Action dated Sep. 14, 2016 in connection with U.S. Appl. No. 14/920,664, 7 pages.
Final Action dated Mar. 22, 2017 in connection with U.S. Appl. No. 14/920,664, 8 pages.
Non-Final Office Action dated Sep. 26, 2017 in connection with U.S. Appl. No. 14/920,664, 8 pages.
Examiner's Reporting dated Jan. 11, 2019 in connection with CA patent application No. 2,847,139—4 pages.
Extended Search Report dated Jul. 25, 2014 in connection with European Patent Application No. 14160032.0, 5 pages.
Office Action dated May 8, 2015 in connection with European Patent Application No. 14160032.0, 3 pages.
Examiner's report dated Feb. 22, 2019 in connection with CA design application No. 171,235, 1 page.
European Search report dated Nov. 21, 2018, in connection with European Patent Publication No. 3415205.
Examiner's Report dated Feb. 22, 2019 in connection with CA design application No. 184,225—1 page.
Examiner's Report dated Feb. 22, 2019 in connection with CA design application No. 184,226—1 page.
Examiner's Report dated Feb. 22, 2019 in connection with CA design application No. 175,917—2 pages.
Easton, Hockey Catalog 2000, Extracts of pp. 5, 6 and 7.
Mission holder called the driveshaft with a carbon insert—print out of web page from hockey world website—Jul. 13, 2015, 2 pages.
Mission Hockey catalog 1998 showing the driveshaft with carbon insert and the skate with the driveshaft, 3 pages.
Easton catalog 1999—composite blade holder, 5 pages.
Easton catalog 1998—composite blade holder, 7 pages.
Examiner's Report dated Apr. 17, 2017 in connection with CA design application No. 171,235—6 pages.
Examiner's Report dated Jan. 17, 2018 in connection with CA design application No. 171,235—3 page.
Examiner's Report dated May 21, 2019 in connection with CA patent application No. 2,847,139.
Non-Final Office Action dated Mar. 7, 2018, in connection with U.S. Appl. No. 14/920,664, 7 pages.
Non-Final Office Action dated May 22, 2019 in connection with U.S. Appl. No. 16/225,095, 20 pages.
Notice of Allowance dated Apr. 3, 2019 in connection with U.S. Appl. No. 15/670,500.
Notice of Allowance dated Apr. 30, 2019 in connection with U.S. Appl. No. 14/988,191.
Notice of Allowance dated Sep. 19, 2018 in connection with U.S. Appl. No. 14/920,664, 7 pages.
Notice of Allowance dated Sep. 9, 2019 in connection with U.S. Appl. No. 16/225,095, 7 pages.
Restriction Requirement dated Oct. 3, 2019 in connection with Design U.S. Appl. No. 29/582,205—7 pages.
Office Action dated Apr. 16, 2020 in connection with Design U.S. Appl. No. 29/582,205—7 pages.
Examiner's Report dated Aug. 25, 2020 in connection with Canadian Patent Application No. 2,847,139, 4 pages.
Examiner's Report dated Mar. 24, 2021 in connection with Canadian patent application No. 2847139, 4 pages.
Examiner's Report dated May 4, 2021 in connection with Canadian Patent Application No. 3,053,924, 4 pages.
Examiner's Report dated Nov. 24, 2021 in connection with Canadian Patent Application No. 3,053,924, 3 pages.
Non-Final Office Action dated Feb. 3, 2022 in connection with U.S. Appl. No. 16/528,867, 10 pages.
Non-Final Office Action dated Jan. 28, 2021 in connection with U.S. Appl. No. 16/712,094, 8 pages.
Non-Final Office Action dated Jul. 23, 2021 in connection with U.S. Appl. No. 16/295,497, 6 pages.
Non-Final Office Action dated Jun. 11, 2021 in connection with Design U.S. Appl. No. 29/582,205, 6 pages.
Non-Final Office Action dated Oct. 20, 2020 in connection with Design U.S. Appl. No. 29/582,205, 14 pages.
Notice of Allowance dated May 26, 2021 in connection with U.S. Appl. No. 16/712,094, 25 pages.
Restriction requirement dated Feb. 26, 2021 in connection with U.S. Appl. No. 16/295,497, 8 pages.
Examiner's Report dated Feb. 23, 2022 in connection with Canadian Patent Application No. 2916673, 15 pages.
Non-Final Office Action dated Feb. 3, 2022 by the USPTO in connection with U.S. Appl. No. 16/528,867, 10 pages.
Non-Final Office Action dated Mar. 4, 2022 in connection with U.S. Appl. No. 16/295,497, 21 pages.
Final Office Action dated May 23, 2022 by the USPTO in connection with U.S. Appl. No. 16/528,867, 8 pages.

* cited by examiner

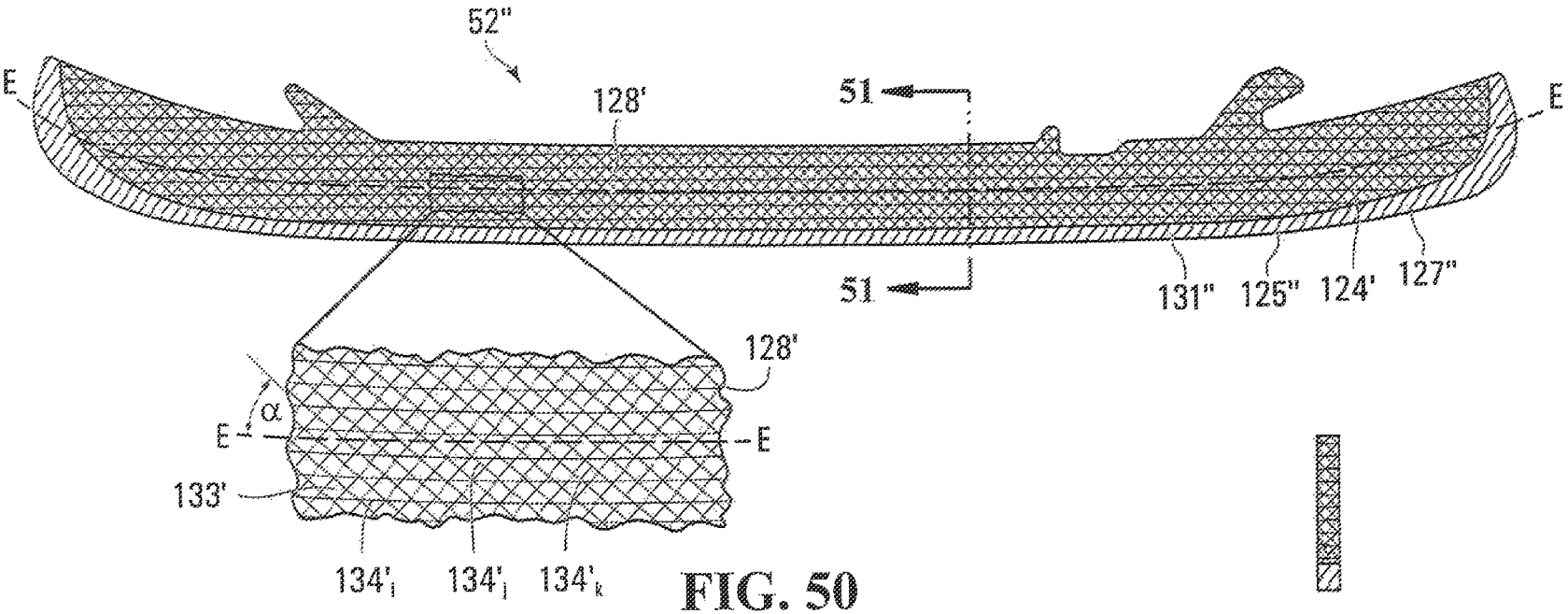
FIG. 51
FIG. 50
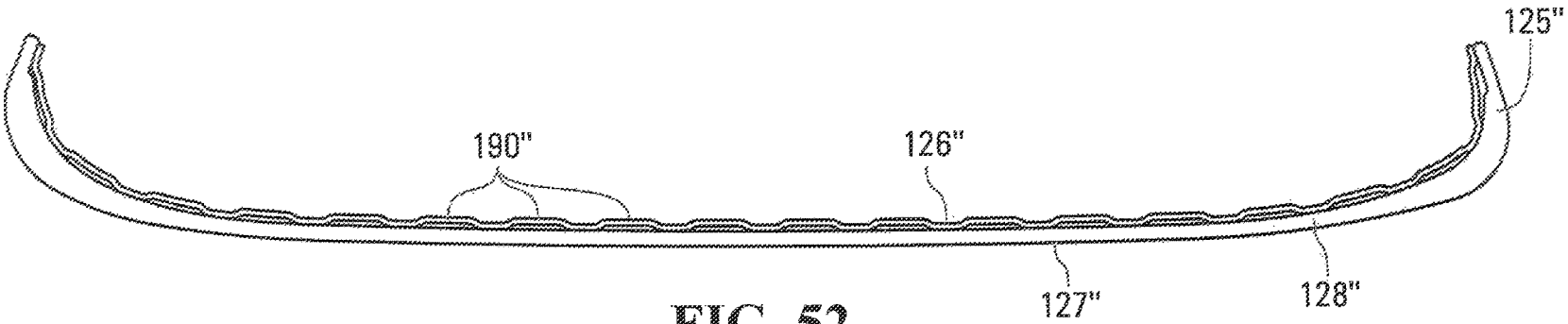
FIG. 52

ICE SKATE

CROSS-REFERENCE TO RELATED APPLICATION

This application is a continuation of U.S. patent application Ser. No. 14/212,468, filed on Mar. 14, 2014, which claims priority from U.S. Provisional Patent Application No. 61/783,590 filed on Mar. 14, 2013. The contents of the aforementioned applications are incorporated by reference herein.

FIELD OF THE INVENTION

The invention generally relates to ice skates, including their blade holder and their ice skate blade.

BACKGROUND OF THE INVENTION

Ice skates include a skate boot for receiving a skater's foot and a blade holder connecting a blade to the skate boot. Many different types of skate boots, blade holders and blades have been developed in order to provide skates which can accommodate different skating maneuvers as well as to provide general advantages to skaters.

It is typically desirable from a skater's perspective to have a skate which is relatively lightweight. This is because heavier skates impose a larger physical burden during use and can incrementally result in tiring the skater. From a manufacturer's perspective, it is important to be able to provide such advantages at a reduced cost.

While changes can be made to the skate boot itself, the skate boot can only be optimized to a certain point before reaching a substantial "plateau" in comfort, performance, production cost, etc. As such, it is important to also consider the design of the blade holder and the blade which can largely affect a skater's performance depending on the materials and design employed.

There is therefore an ongoing need in the industry to improve an ice skate, including its blade holder and its blade.

SUMMARY OF THE INVENTION

In accordance with an aspect of the invention, there is provided a blade holder for holding a blade of an ice skate. The ice skate comprises a skate boot for receiving a foot of a skater. The skate boot comprises a front portion for receiving toes of the foot, a rear portion for receiving a heel of the foot, and an intermediate portion between the front portion and the rear portion of the skate boot. The blade holder comprises an elongated blade-supporting base for supporting the blade. The blade holder also comprises a front pillar and a rear pillar that are spaced apart in a longitudinal direction of the blade holder. The front pillar extends from the elongated blade-supporting base towards the front portion of the skate boot, the rear pillar extends from the elongated blade-supporting base towards the rear portion of the skate boot, and the elongated blade-supporting base extends from the front pillar to the rear pillar. The blade holder is responsive to a skating movement of the skater to undergo an elastic torsion of each of the front pillar and the rear pillar which induces an elastic flexion of the elongated blade-supporting base and the blade in a widthwise direction of the blade holder.

In accordance with another aspect of the invention, there is provided a blade holder for holding a blade of an ice skate. The ice skate comprises a skate boot for receiving a foot of a skater. The skate boot comprises a front portion for receiving toes of the foot, a rear portion for receiving a heel of the foot, and an intermediate portion between the front portion and the rear portion of the skate boot. The blade holder comprises an elongated blade-supporting base for supporting the blade. The blade holder also comprises a front pillar and a rear pillar that are spaced apart in a longitudinal direction of the blade holder. The front pillar extends from the elongated blade-supporting base towards the front portion of the skate boot, the rear pillar extends from the elongated blade-supporting base towards the rear portion of the skate boot, and the elongated blade-supporting base extends from the front pillar to the rear pillar. A longitudinal spacing of the front pillar and the rear pillar is greater than a sum of a minimal longitudinal dimension of the front pillar and a minimal longitudinal dimension of the rear pillar. At least a front quarter and a rear quarter of the blade holder is free of any inter-pillar structure comparable to at least one of the front pillar and the rear pillar.

In accordance with another aspect of the invention, there is provided a blade holder for holding a blade of an ice skate. The ice skate comprises a skate boot for receiving a foot of a skater. The skate boot comprises a front portion for receiving toes of the foot, a rear portion for receiving a heel of the foot, and an intermediate portion between the front portion and the rear portion of the skate boot. The blade holder comprises an elongated blade-supporting base for supporting the blade. The blade holder also comprises a front pillar and a rear pillar that are spaced apart in a longitudinal direction of the blade holder. The front pillar extends from the elongated blade-supporting base towards the front portion of the skate boot, the rear pillar extends from the elongated blade-supporting base towards the rear portion of the skate boot, and the elongated blade-supporting base extends from the front pillar to the rear pillar. A longitudinal spacing of the front pillar and the rear pillar is greater than a sum of a minimal longitudinal dimension of the front pillar and a minimal longitudinal dimension of the rear pillar. At least a front quarter and a rear quarter of the blade holder is free of any inter-pillar structure substantially limiting a widthwise flexion of the elongated blade-supporting base while the skater skates.

In accordance with another aspect of the invention, there is provided a blade holder for holding a blade of an ice skate. The ice skate comprises a skate boot for receiving a foot of a skater. The skate boot comprises a front portion for receiving toes of the foot, a rear portion for receiving a heel of the foot, and an intermediate portion between the front portion and the rear portion of the skate boot. The blade holder comprises an elongated blade-supporting base for supporting the blade. The blade holder also comprises a front pillar and a rear pillar that are spaced apart in a longitudinal direction of the blade holder. The front pillar extends from the elongated blade-supporting base towards the front portion of the skate boot, the rear pillar extends from the elongated blade-supporting base towards the rear portion of the skate boot, and the elongated blade-supporting base extends from the front pillar to the rear pillar. A longitudinal spacing of the front pillar and the rear pillar is greater than a sum of a minimal longitudinal dimension of the front pillar and a minimal longitudinal dimension of the rear pillar. The elongated blade-supporting base is suspended only by the front pillar and the rear pillar.

In accordance with another aspect of the invention, there is provided a blade holder for holding a blade of an ice skate. The ice skate comprises a skate boot for receiving a foot of a skater. The skate boot comprises a front portion for receiving toes of the foot, a rear portion for receiving a heel of the foot, and an intermediate portion between the front portion and the rear portion of the skate boot. The blade holder comprises a U-shaped inner member and a U-shaped outer member spaced from the U-shaped inner member to define a hollow space between the U-shaped inner member and the U-shaped outer member. The U-shaped outer member comprises an elongated blade-supporting base for supporting the blade. The U-shaped outer member also comprises a front pillar and a rear pillar that are spaced apart in a longitudinal direction of the blade holder. The front pillar extends from the elongated blade-supporting base towards the front portion of the skate boot, the rear pillar extends from the elongated blade-supporting base towards the rear portion of the skate boot, and the elongated blade-supporting base extends from the front pillar to the rear pillar.

In accordance with another aspect of the invention, there is provided a blade holder for holding a blade of an ice skate. The ice skate comprises a skate boot for receiving a foot of a skater. The skate boot comprises a front portion for receiving toes of the foot, a rear portion for receiving a heel of the foot, and an intermediate portion between the front portion and the rear portion of the skate boot. The blade holder comprises an elongated blade-supporting base for supporting the blade. The blade holder also comprises a front pillar and a rear pillar that are spaced apart in a longitudinal direction of the blade holder. The front pillar extends from the elongated blade-supporting base towards the front portion of the skate boot, the rear pillar extends from the elongated blade-supporting base towards the rear portion of the skate boot, and the elongated blade-supporting base extends from the front pillar to the rear pillar. A longitudinal spacing of the front pillar and the rear pillar is greater than a sum of a minimal longitudinal dimension of the front pillar and a minimal longitudinal dimension of the rear pillar. At least part of the elongated blade-supporting base, the front pillar, and the rear pillar is made of a composite material.

In accordance with another aspect of the invention, there is provided a blade holder for holding a blade of an ice skate. The ice skate comprises a skate boot for receiving a foot of a skater. The skate boot comprises a front portion for receiving toes of the foot, a rear portion for receiving a heel of the foot, and an intermediate portion between the front portion and the rear portion of the skate boot. The blade holder comprises an elongated blade-supporting base for supporting the blade. The elongated blade-supporting base comprises an external wall defining an interior cavity. The external wall comprises a composite material. The blade holder also comprises a front pillar and a rear pillar that are spaced apart in a longitudinal direction of the blade holder. The front pillar extends from the elongated blade-supporting base towards the front portion of the skate boot, the rear pillar extends from the elongated blade-supporting base towards the rear portion of the skate boot, and the elongated blade-supporting base extends from the front pillar to the rear pillar.

In accordance with another aspect of the invention, there is provided a blade holder for holding a blade of an ice skate. The ice skate comprises a skate boot for receiving a foot of a skater. The blade holder comprises an upper structure for facing the skate boot and an elongated blade-supporting base for supporting the blade. The blade holder also comprises a resilient element disposed between the upper structure and the elongated blade-supporting base and configured to deform when the elongated blade-supporting base moves relative to the upper structure while the skater skates.

In accordance with another aspect of the invention, there is provided a blade for an ice skate. The ice skate comprises a skate boot for receiving a foot of a skater and a blade holder for holding the blade. The blade comprises a body for mounting to the blade holder. The body comprises a composite material. The composite material comprises a matrix and a plurality of fibers embedded in the matrix. The blade also comprises an ice-contacting surface for contacting an ice surface on which the skater skates. The ice-contacting surface comprises an ice-contacting material different from the composite material.

In accordance with a broad aspect, the present invention provides a blade holder for an ice skate, the ice skate comprising: a skate boot for receiving a foot of a skater, the skate boot comprising a front portion for receiving toes of the foot, a rear portion for receiving a heel of the foot, and an intermediate portion between the front portion and the rear portion of the skate boot, the blade holder comprising an elongated blade-supporting base; and a front pillar and a rear pillar that are spaced apart in a longitudinal direction of the blade holder, the front pillar extending from the elongated blade-supporting base towards the front portion of the skate boot, the rear pillar extending from the elongated blade-supporting base towards the rear portion of the skate boot, the elongated blade-supporting base extending from the front pillar to the rear pillar; and wherein at least part of the elongated blade-supporting base, the front pillar and the rear pillar is made of a composite material.

The composite material may be a fiber-matrix composite material and the elongated blade-supporting base, the front pillar and the rear pillar may be made of the fiber-matrix composite material.

The blade holder may comprise an ice skate blade mounted to the bottom blade portion of the elongated blade-supporting base of the blade holder.

In one variant, the bottom blade portion of the elongated blade-supporting base defines a recess and the ice skate blade has a top portion and a bottom portion defining an ice-contacting surface, the top portion of the ice skate blade comprising a projection affixed into the recess of the bottom blade portion of the elongated blade-supporting base.

In another variant, the bottom blade portion of the elongated blade-supporting base defines a projection and the ice skate blade has a top portion and a bottom portion defining an ice-contacting surface, the top portion of the ice skate blade comprising a recess in which the projection the bottom blade portion of the elongated blade-supporting base is affixed.

In a further variant, the ice skate blade has a top portion and a bottom portion defining an ice-contacting surface, the top portion of the ice skate blade comprising a plurality of anchoring members such that the top portion of the ice skate blade is within the fiber-matrix composite material of the elongated blade-supporting base for retaining the ice skate blade to the blade holder. The plurality of anchoring elements may comprise hooks, projections, channels or interlocking openings. The fiber-matrix composite material of the elongated blade-supporting base comprises layers of fibers and at least one layer of fibers is located within the anchoring elements such that the anchoring elements are embedded in the fiber-matrix composite material of the elongated blade-supporting base.

The blade holder may be responsive to a skating movement of the skater to undergo an elastic torsion of each of the front pillar and the rear pillar which induces an elastic flexion of the elongated blade-supporting base and the blade in a widthwise direction of the blade holder.

A longitudinal spacing of the front pillar and the rear pillar may be greater than a sum of a minimal longitudinal dimension of the front pillar and a minimal longitudinal dimension of the rear pillar and at least a front quarter and a rear quarter of the blade holder may be free of any inter-pillar structure comparable to at least one of the front pillar and the rear pillar. At least one of a front third and a rear third of the blade holder may be free of any inter-pillar structure comparable to at least one of the front pillar and the rear pillar. Each of the front third and the rear third of the blade holder may be free of any inter-pillar structure comparable to at least one of the front pillar and the rear pillar.

The blade holder may be free of any inter-pillar structure comparable to at least one of the front pillar and the rear pillar.

A longitudinal spacing of the front pillar and the rear pillar may be greater than a sum of a minimal longitudinal dimension of the front pillar and a minimal longitudinal dimension of the rear pillar and at least a front quarter and a rear quarter of the blade holder may be free of any inter-pillar structure substantially limiting a widthwise flexion of the elongated blade-supporting base while the skater skates.

At least one of a front third and a rear third of the blade holder may be free of any inter-pillar structure substantially limiting a widthwise flexion of the elongated blade-supporting base while the skater skates. Each of the front third and the rear third of the blade holder may be free of any inter-pillar structure substantially limiting a widthwise flexion of the elongated blade-supporting base while the skater skates.

the blade holder is free of any inter-pillar structure substantially limiting a widthwise flexion of the elongated blade-supporting base while the skater skates.

A longitudinal spacing of the front pillar and the rear pillar may be greater than a sum of a minimal longitudinal dimension of the front pillar and a minimal longitudinal dimension of the rear pillar and the elongated blade-supporting base may be suspended only by the front pillar and the rear pillar.

The elongated blade-supporting base, the front pillar and the rear pillar may be part of a U-shaped outer member and the blade holder may comprise a U-shaped inner member spaced from the U-shaped outer member to define a void between the U-shaped inner member and the U-shaped outer member. The blade holder may comprise a resilient element disposed between the U-shaped inner member and the U-shaped outer member that is configured to deform when the U-shaped inner and outer members move relative to each other while the skater skates.

The blade holder may comprise a front member defining a front peripheral wall with an upper surface for facing a bottom portion of the front portion of the skate boot and a rear member defining a rear peripheral wall with an upper surface for facing a bottom portion of the rear portion of the skate boot. The U-shaped inner member comprising an elongated portion, a front portion extending upwardly from the elongated portion and having an upper end integrally formed with the front member and a rear portion extending upwardly from the elongated portion and having an upper end integrally formed with the rear member, and the front pillar has an upper end integrally formed with the front member and the rear pillar has an upper end integrally formed with the rear member. Each of the front and rear peripheral walls of the front and rear members may comprise apertures for affixing the blade holder to the bottom portion of the front and rear portions of the skate boot. The blade holder may comprise an intermediate member extending between the front and rear members, the intermediate member having an upper surface for facing a bottom portion of the intermediate portion of the skate boot, the front and rear peripheral walls of the front and rear members and the intermediate member defining a pedestal for facing the bottom portion of the skate boot. The elongated portion of the U-shaped inner member overlaps a portion of the elongated blade-supporting base. The elongated portion of the U-shaped inner member may contact a portion of the elongated blade-supporting base. The blade holder may comprise a resilient element disposed between the elongated portion of the U-shaped inner member and the elongated blade-supporting base.

The U-shaped inner member may comprise fiber-matrix composite material that offers less resilience than the fiber-matrix composite material of the U-shaped outer member. The fiber-matrix composite material of the U-shaped inner member may comprise glass fibers or polypropylene fibers and the fiber-matrix composite material of the U-shaped outer member may comprise carbon fibers, graphite fibers or carbon graphite fibers.

The elongated blade-supporting base, the front pillar, the rear pillar, the elongated portion, front portion and rear portion of the U-shaped inner member, the front member or the rear member may comprise an external wall defining an interior cavity. The elongated blade-supporting base, the front pillar, the rear pillar or the elongated portion, front portion or rear portion of the U-shaped inner member may comprise a filler in the interior cavity. The filler may comprise foam.

According to another broad aspect, the invention provides a blade holder for an ice skate, the ice skate comprising a skate boot for receiving a foot of a skater, the skate boot comprising a front portion for receiving toes of the foot, a rear portion for receiving a heel of the foot, and an intermediate portion between the front portion and the rear portion of the skate boot, the blade holder comprising: a U-shaped inner member; and a U-shaped outer member spaced from the U-shaped inner member to define a hollow space between the U-shaped inner member and the U-shaped outer member, the U-shaped outer member comprising: an elongated blade-supporting base; and a front pillar and a rear pillar that are spaced apart in a longitudinal direction of the blade holder, the front pillar extending from the elongated blade-supporting base towards the front portion of the skate boot, the rear pillar extending from the elongated blade-supporting base towards the rear portion of the skate boot, the elongated blade-supporting base extending from the front pillar to the rear pillar; and wherein at least part of the elongated blade-supporting base, the front pillar and the rear pillar is made of a composite material. The composite material may be a fiber-matrix composite material and the elongated blade-supporting base, the front pillar and the rear pillar may be made of the fiber-matrix composite material.

According to a further broad aspect, the invention provides a blade holder for an ice skate, the ice skate comprising a skate boot for receiving a foot of a skater, the skate boot comprising a front portion for receiving toes of the foot, a rear portion for receiving a heel of the foot, and an intermediate portion between the front portion and the rear portion of the skate boot, the blade holder comprising: an elongated blade-supporting base; and a front pillar and a rear pillar that are spaced apart in a longitudinal direction of the blade holder, the front pillar extending from the elongated blade-supporting base towards the front portion of the skate boot, the rear pillar extending from the elongated blade-supporting base towards the rear portion of the skate boot, the elongated blade-supporting base extending from the front pillar to the rear pillar; wherein the elongated blade-supporting base, the front pillar and the rear pillar comprise an external wall defining an interior cavity, the external wall being at least partially made of a composite material. The composite material may be a fiber-matrix composite material and the elongated blade-supporting base, the front pillar and the rear pillar may be made of the fiber-matrix composite material.

According to another broad aspect, the invention provides an ice skate blade extending along a longitudinal axis, the ice skate blade comprising: an body extending along the longitudinal axis and comprising a composite material, the composite material comprising a matrix and a plurality of fibers embedded in the matrix, the body comprising a bottom portion and a top portion for mounting to a blade holder; and a runner extending along the longitudinal axis and comprising a top portion and a bottom portion having an ice-contacting surface for contacting an ice surface on which a skater skates. Respective ones of the fibers may be oriented to be in tension when the blade deflects while the skater skates. Respective ones of the fibers may extend parallel or at an oblique angle to a longitudinal axis of the blade. At least a majority of the fibers may extend parallel or at an oblique angle to the longitudinal axis of the blade. A totality of the fibers may extend parallel or at an oblique angle to the longitudinal axis of the blade.

The runner is made of metallic material. For example, the runner may be made of stainless steel, carbon steel, tungsten carbide or titanium), of a strip of engineering plastic or a strip that is at least partially made of ceramic material (e.g. aluminum titanate, aluminum zirconate, sialon, silicon nitride, silicon carbide, zirconia and partially stabilized zirconia or a combination of two or more of these materials).

In one variant, the bottom portion of the body defines a recess and the top portion of the runner comprises a projection affixed into the recess of the bottom portion of the body. In another variant, the bottom portion of the body defines a projection and the top portion of the runner comprises a recess in which the projection the bottom portion of the body is affixed. In a further variant, the top portion of the runner comprises a plurality of anchoring members such that the top portion of the runner is within the composite material of the body for retaining the runner to the body. The plurality of anchoring elements may comprise hooks, projections, channels or interlocking openings. The composite material of the body may comprise layers of fibers and at least one layer of fibers is located within the anchoring elements such that the anchoring elements are embedded in the composite material of the body.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the following drawings, in which:

FIG. 50 is a cross-sectional view of an ice skate blade in accordance with a further embodiment of the invention;

FIG. 51 is a cross-sectional view taken along line 50-50 of FIG. 49;

FIG. 52 is a side view of the runner of the ice skate blade of FIG. 50;

Figure 1:
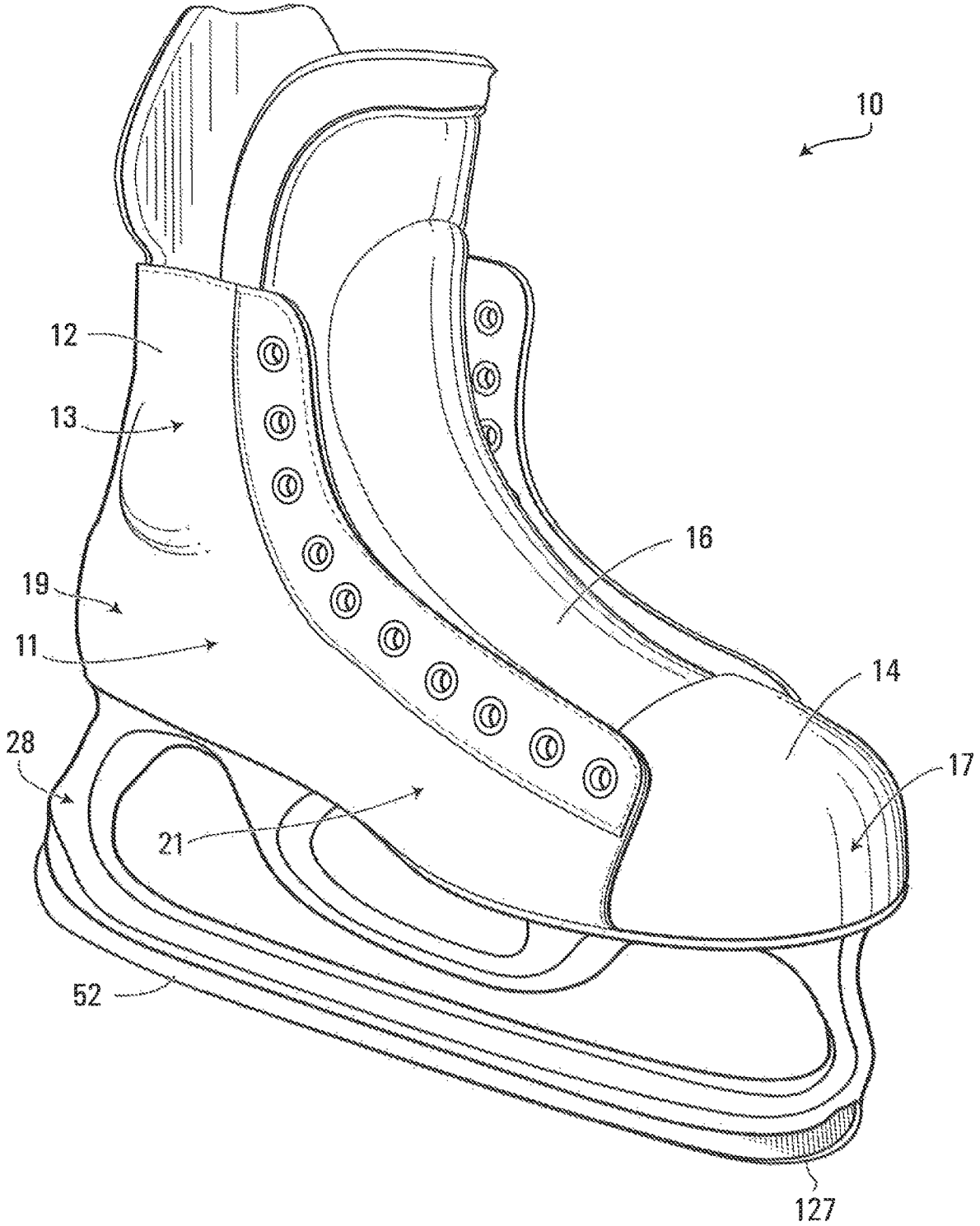
FIG. 1 is a perspective view of an ice skate in accordance with an embodiment of the invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF EMBODIMENTS

Figure 2:
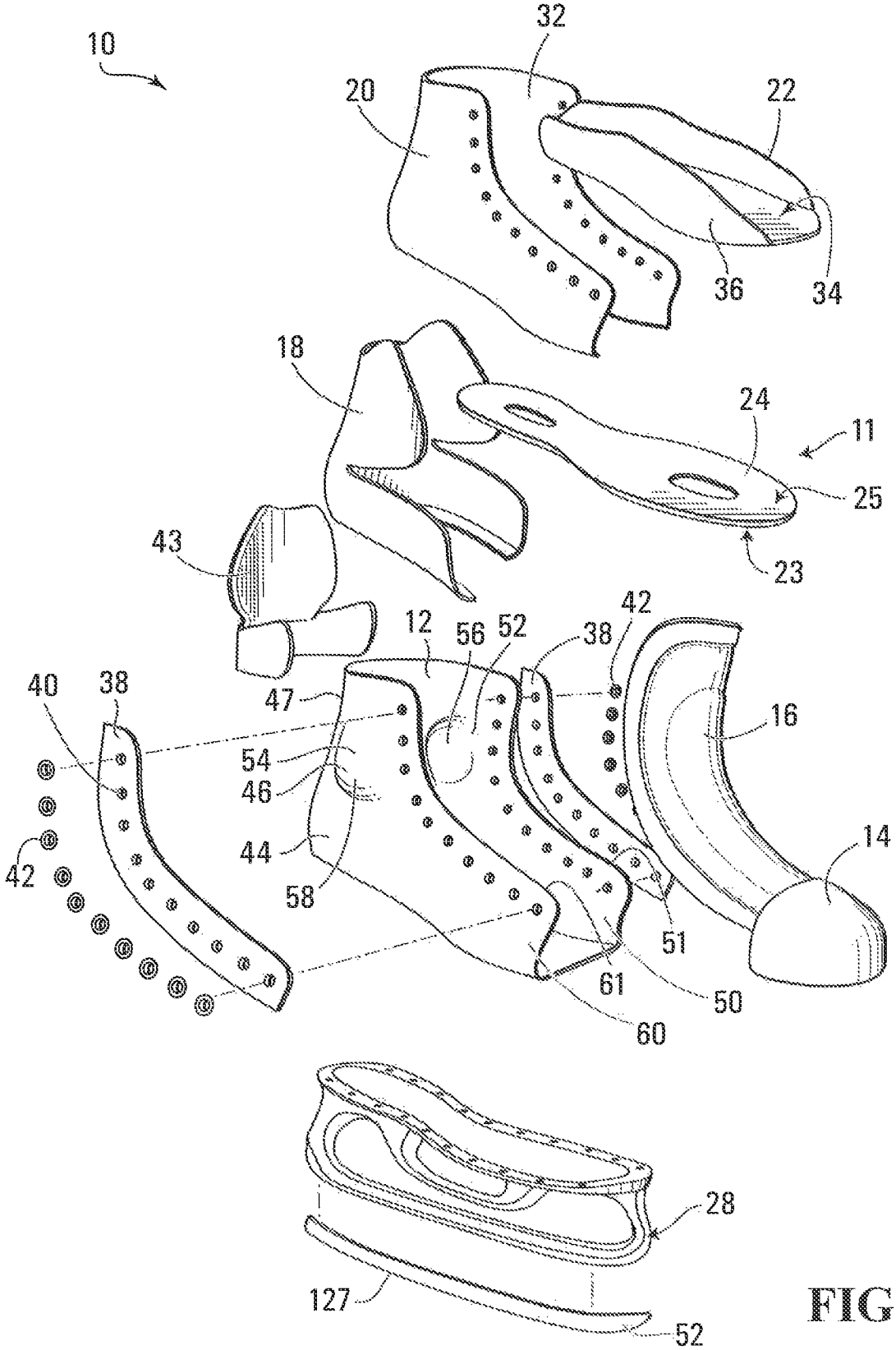
FIG. 2 is an exploded view of the ice skate of FIG. 1.
Figure 3:
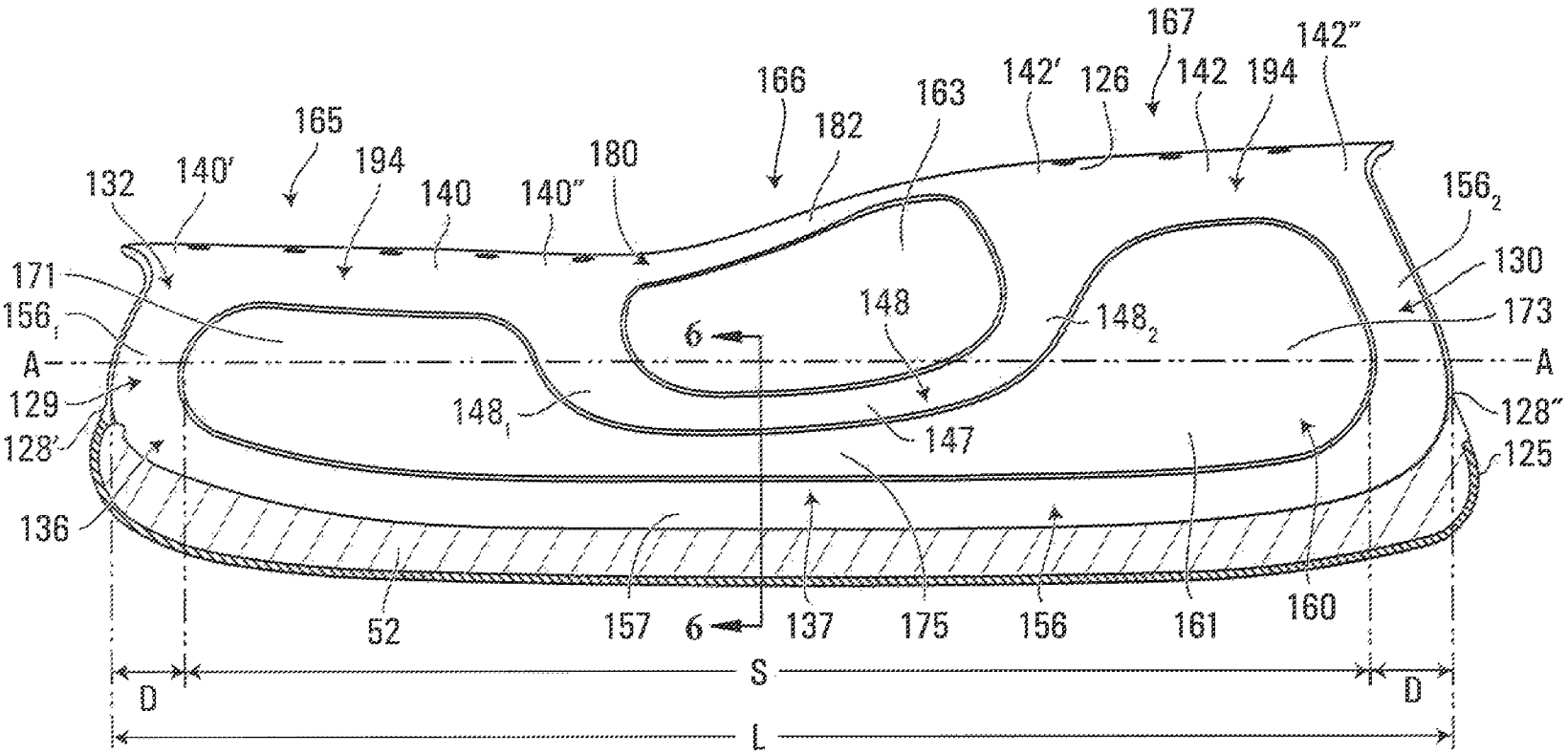
FIG. 3 is a side cross-sectional view of an ice skate blade holder of the ice skate.
Figure 4:
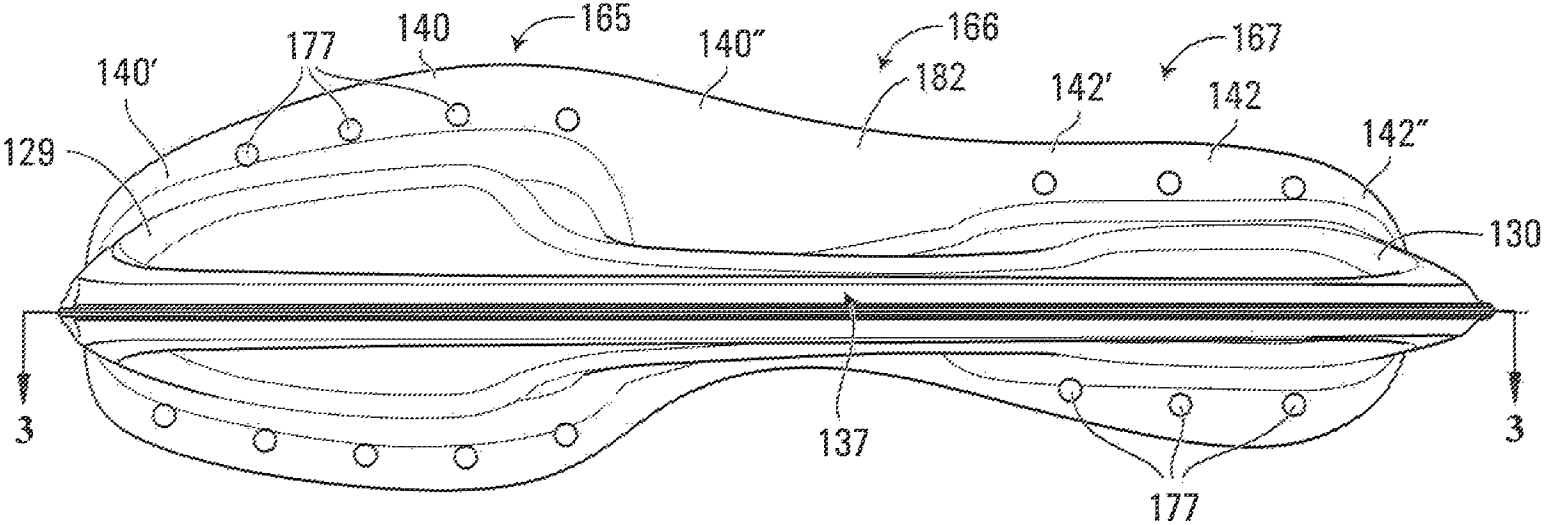
FIG. 4 is a bottom view of the ice skate blade holder.
Figure 6:
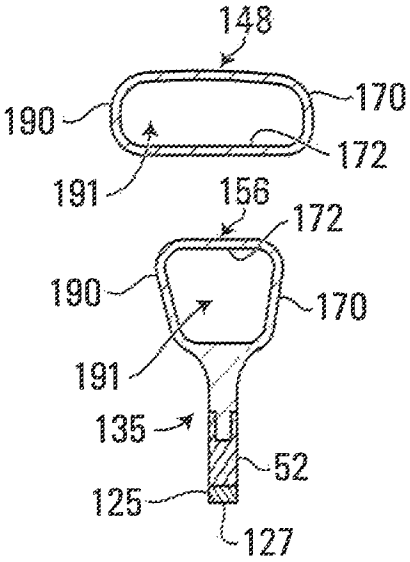
FIG. 6 is an enlarged cross-sectional view of the ice skate blade holder.
Figure 5:
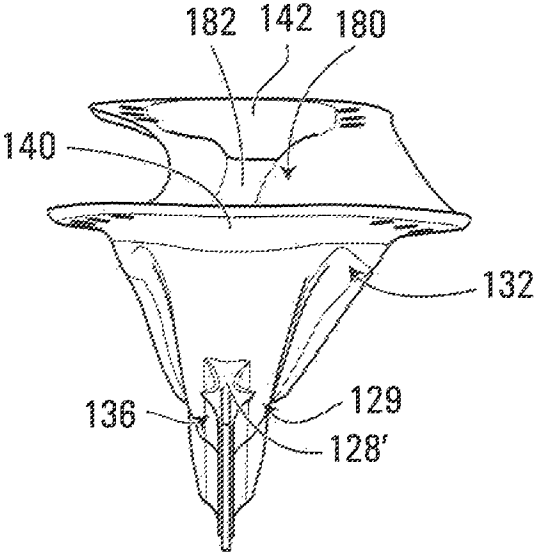
FIG. 5 is a front view of the ice skate blade holder.

FIGS. 1 and 2 show an example of an ice skate 10 in accordance with an embodiment of the invention. The ice skate 10 comprises a skate boot 11 for enclosing a skater's foot, a blade holder 28, and a ice skate blade 52 for contacting an ice surface on which the skater skates. In this embodiment, the ice skate 10 is a hockey skate designed for playing ice hockey. In other embodiments, the ice skate 10 may be designed for other types of skating activities. As further discussed below, the ice skate 10, including the ice skate blade holder 28, is lightweight and may provide other performance benefits to the skater (e.g., may facilitate and/or allow faster turns).

Figure 56:
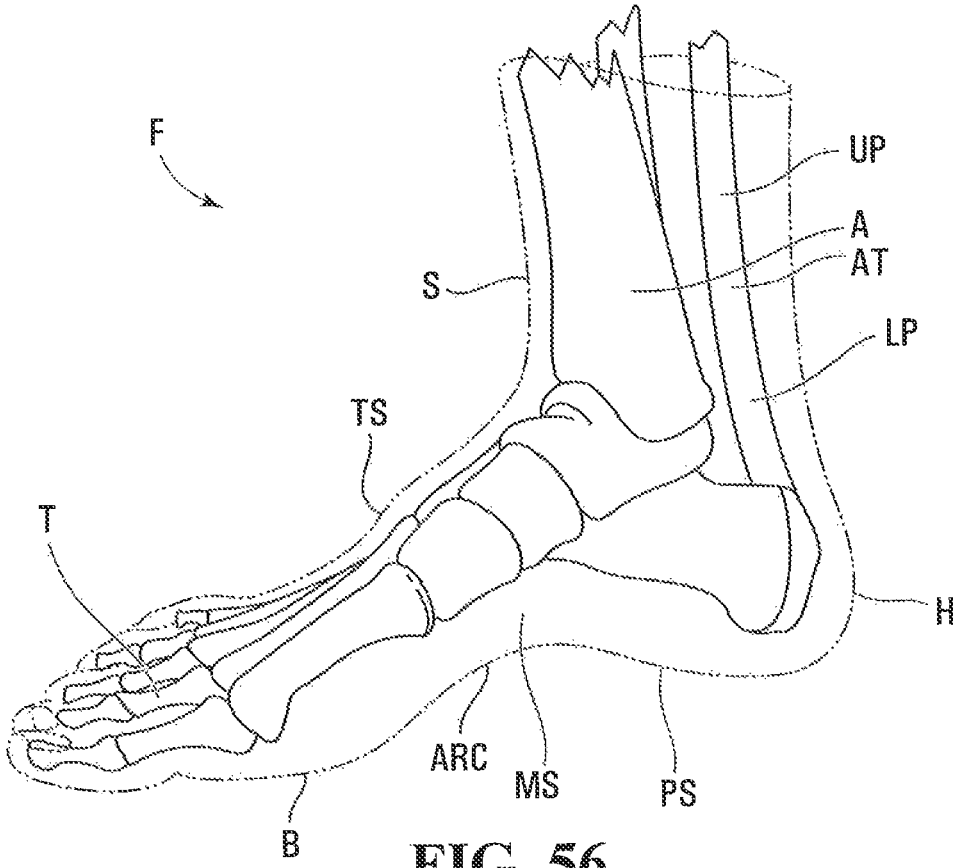
FIGS. 56 and 57 are side and front views of a right foot of a wearer of the ice skate with an integument of the foot shown in dotted lines and bones shown in solid lines.
Figure 57:
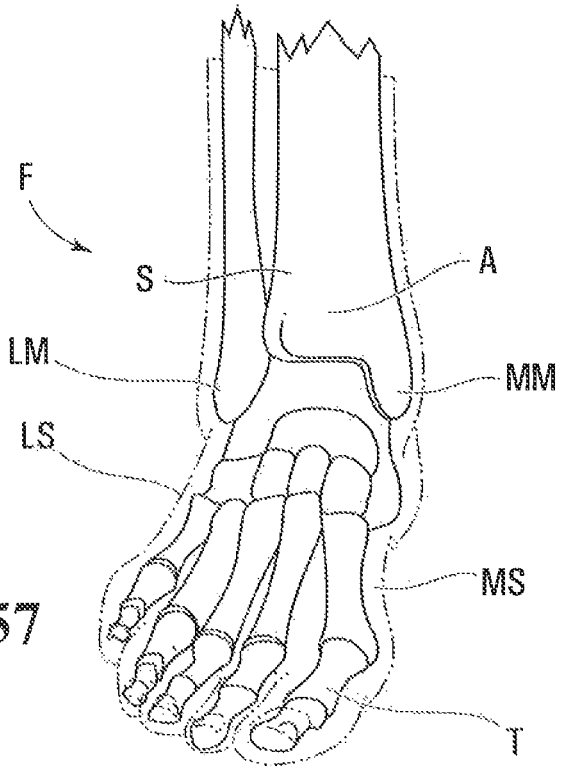

The skate boot 11 defines a cavity for receiving the skater's foot. With additional reference to FIGS. 56 and 57, the skater's foot includes toes T, a ball B, an arch ARC, a plantar surface PS, a top surface TS, a medial side MS and a lateral side LS. The top surface TS of the skater's foot is continuous with a lower portion of the skater's shin S. In addition, the skater has a heel H, an Achilles tendon AT, and an ankle A having a medial malleolus MM and a lateral malleolus LM that is at a lower position than the medial malleolus MM. The Achilles tendon AT has an upper part UP and a lower part LP projecting outwardly with relation to the upper part UP and merging with the heel H. A forefoot of the skater includes the toes T and the ball B, a hindfoot of the skater includes the heel H, and a midfoot of the skater is between the forefoot and midfoot.

In this embodiment, the skate boot 11 comprises a front portion 17 for receiving the toes T of the skater's foot, a rear portion 19 for receiving the heel H of the skater's foot, and an intermediate portion 21 between the front portion 17 and the rear portion 19.

More particularly, in this embodiment, the skate boot 11 comprises an outer shell 12, a toe cap 14 for facing the toes T, a tongue 16 extending upwardly and rearwardly from the toe cap 14 for covering the top surface TS of the skater's foot, a rigid insert 18 for providing more rigidity around the ankle A and the heel H of the skater's foot, an inner lining 20, a footbed 22, and an insole 24. The skate boot 11 also comprises lace members 38 and eyelets 42 punched into the lace members 38, the outer shell 12 and the inner lining 20 vis-à-vis apertures 40 in order to receive laces for tying on the skate 10.

The inner lining 20 is affixed to an inner surface of the outer shell 12 and comprises an inner surface 32 intended for contact with the heel H and medial and lateral sides MS, LS of the skater's foot and the skater's ankle A in use. The inner lining 20 is made of a soft material (e.g., a fabric made of NYLON® fibers or any other suitable fabric). The rigid insert 18 is sandwiched between the outer shell 12 and the inner lining 20 and may be affixed in any suitable way (e.g., glued to the inner surface of the outer shell 12 and stitched along its periphery to the outer shell 12). The footbed 22 is mounted inside the outer shell 12 and comprises an upper surface 34 for receiving the plantar surface PS of the skater's foot and a wall 36 projecting upwardly from the upper surface 34 to partially cup the heel H and extend up to a medial line of the skater's foot. The insole 24 has an upper surface 25 for facing the plantar surface PS of the skater's foot and a lower surface 23 on which the outer shell 12 may be affixed.

The outer shell 12 is thermoformed such that it comprises a heel portion 44 for receiving the heel H, an ankle portion 46 for receiving the ankle A, and medial and lateral side portions 50, 60 for facing the medial and lateral sides MS, LS of the skater's foot, respectively. The medial and lateral side portions 50, 60 include upper edges 51, 61 which connect to the lace members 38. The heel portion 44 may be thermoformed such that it is substantially cup shaped for following the contour of the heel H. The ankle portion 46 comprises medial and lateral ankle sides 52, 54. The medial ankle side 52 has a medial cup-shaped depression 56 for receiving the medial malleolus MM and the lateral ankle side 54 has a lateral cup-shaped depression 58 for receiving the lateral malleolus LM of the skater. The lateral depression 58 is located slightly lower than the medial depression 56, for conforming to the morphology of the skater's foot. The ankle portion 46 further comprises a rear portion 47 facing the lower part LP of the Achilles tendon AT. The rear portion 47 may be thermoformed such that it follows the lower part LP of the Achilles tendon AT. Furthermore, the skate boot 11 also includes a tendon guard 43 affixed to the rear portion 47 of the ankle portion 46 and extending upwardly therefrom.

The skate boot 11 may be constructed in any other suitable way in other embodiments. For example, in other embodiments, various components of the skate boot 11 mentioned above may be configured differently or omitted and/or the skate boot 11 may comprise any other components that may be made of any other suitable materials and/or using any other suitable processes.

With additional reference to FIGS. 3 to 6, the blade holder 28 comprises an upper structure 132 facing the skate boot 11 and a lower structure 136 supporting the ice skate blade 52. As further discussed later, in this embodiment, the upper structure 132 and the lower structure 136 of the blade holder 28 define a hollow space 160 which occupies a substantial portion of the blade holder 28. This reduces a weight of the blade holder 28 and may provide additional advantages (e.g., easier and/or faster turns) as described below.

The blade holder 28 has a longitudinal axis A-A extending from a front portion 129 of the blade holder 28 to a rear portion 130 of the blade holder 28. The front portion 129 of the blade holder 28 defines a frontmost point 128' of the blade holder 28 and extends beneath and along the skater's forefoot in use, while the rear portion 130 of the blade holder 28 defines a rearmost point 128" of the blade holder 28 and extends beneath and along the skater's hindfoot in use. A central portion 137 of the blade holder 28 is between the front and rear portions 129, 130 of the blade holder 28 and extends beneath and along the skater's midfoot in use. A length L of the blade holder 28 can be measured from the frontmost point 128' to the rearmost point 128". The longitudinal axis A-A of the blade holder 28 defines a longitudinal direction of the blade holder 28 (i.e., a direction generally parallel to its longitudinal axis) and transversal directions of the blade holder 28 (i.e., directions transverse to its longitudinal axis), including a widthwise direction of the blade holder 28 (i.e., a lateral direction generally perpendicular to its longitudinal axis). The blade holder 28 also has a height direction normal to its longitudinal and widthwise directions.

In this embodiment, the upper structure 132 and the lower structure 136 of the blade holder 28 form an outer member 156 and an inner member 148 which is disposed between the outer member 156 and the skate boot 11. A lower void 161 of the hollow space 160 extends between the inner member 148 and the outer member 156, while an upper void 163 of the hollow space 160 extends between the inner member 148 and the skate boot 11. In this example, each of the outer member 156 and the inner member 148 is a U-shaped member (e.g., a cradle-shaped member). The inner and outer members 148, 156 may have any other suitable shape in other examples of implementation.

More particularly, in this embodiment, the upper structure 132 of the blade holder 28 comprises the U-shaped inner member 148 as well as a front member 140, a rear member 142, and an intermediate member 182 that are configured to be affixed to the skate boot 11. The front member 140 is connected to the front portion 17 of the skate boot 11 for supporting the ball B and toes T of the skater's foot, the rear member 142 is connected to the rear portion 19 of the skate boot 11 for supporting the heel H of the skater's foot, and the intermediate member 182 interconnects the front and rear members 140, 142 and extends below the arch ARC of the skater's foot.

The front, rear and intermediate members 140, 142, 182 of the upper structure 132 of the blade holder 28 form an upper surface of the blade holder 28 that faces the skate boot 11. More particularly, in this embodiment, the front, rear and intermediate members 140, 142, 182 form a single pedestal 180 which extends across substantially an entirety of the plantar surface PS of the skater's foot. In this example, the pedestal 180 formed by the front, rear and intermediate members 140, 142, 182 includes an outsole 126 to be affixed to the skate boot 11.

The U-shaped inner member 148 of the upper structure 132 of the blade holder 28 includes an elongated base 147 and a front arm $\mathbf{148}_1$ and a rear arm $\mathbf{148}_2$ which extend upwardly from the elongated base 147. The front arm $\mathbf{148}_1$ of the U-shaped inner member 148 extends upwardly towards a rear portion 140" of the front member 140 and the rear arm $\mathbf{148}_2$ of the U-shaped inner member 148 extends upwardly towards a front portion 142' of the rear member 142. The elongated base 147 extends between the front and rear arms $\mathbf{148}_1$, $\mathbf{148}_2$ and, in this example, is elongated in the longitudinal direction of the blade holder 28.

The upper structure 132 of the blade holder 28 may be affixed to the skate boot 11 in any suitable way. For example, in this embodiment, the front, rear and intermediate members 140, 142, 182 of the upper structure 132 of the blade holder 28 may be fastened to the skate boot 11 by mechanical fasteners (e.g., rivets, screws, bolts) extending through openings 177 of these members, by an adhesive, and/or by any other fastening means.

The upper structure 132 of the blade holder 28 may be configured in various other ways in other embodiments.

The lower structure 136 of the blade holder 28 comprises an elongated blade-supporting base 157 for supporting the ice skate blade 52. The elongated blade-supporting base 157 is elongated in the longitudinal direction of the blade holder 28. More particularly, in this embodiment, the lower structure 136 comprises the U-shaped outer member 156 which includes the elongated blade-supporting base 157 and a front pillar $\mathbf{156}_1$ and a rear pillar 1562 which extend upwardly from the elongated blade-supporting base 157. The front pillar $\mathbf{156}_1$ extends towards the front portion 17 of the skate boot 11 and the rear pillar $\mathbf{156}_2$ extends towards the rear portion 19 of the skate boot 11. More specifically, in this embodiment, the front pillar $\mathbf{156}_1$ extends upwardly towards a front portion 140' of the front member 140 and the rear pillar $\mathbf{156}_2$ extends upwardly towards a rear portion 142" of the rear member 142. The elongated blade-supporting base 157 extends between the front and rear pillars $\mathbf{156}_1$, $\mathbf{156}_2$.

The front and rear pillars $\mathbf{156}_1$, $\mathbf{156}_2$ of the U-shaped outer member 156 support the skate boot 11 and transmit forces exerted while the skater skates to the ice skate blade 52. In this embodiment, the front and rear pillars $\mathbf{156}_1$, $\mathbf{156}_2$ allow controlled flexions of certain parts of the blade holder 28 while the skater skates that may be beneficial for the skater.

Figure 7:
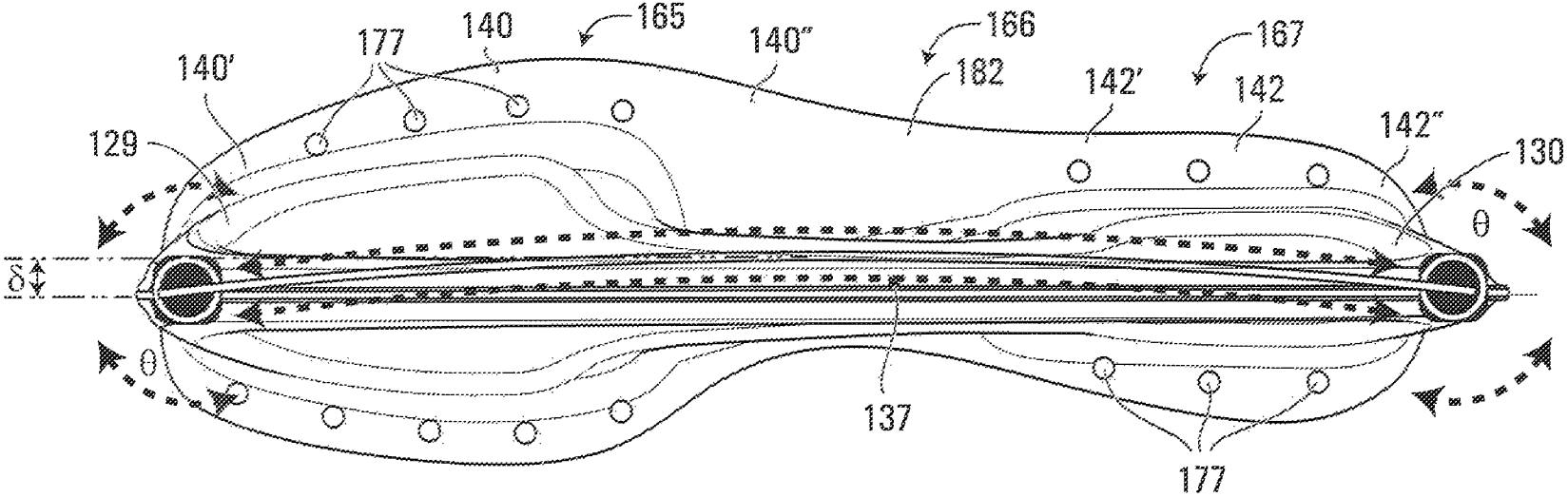
FIG. 7 is a bottom view of the ice skate blade holder experiencing a rotational deformation at its front and rear pillars which induces a flexion of its blade-supporting base.

Notably, in this embodiment, with additional reference to FIG. 7, the blade holder 28 is responsive to a skating movement (e.g., a turning movement or a pushing movement) of the skater to undergo an elastic torsion of each of the front and rear pillars $\mathbf{156}_1$, $\mathbf{156}_2$ which induces an elastic flexion of the elongated blade-supporting base 157 and the ice skate blade 52 in the widthwise direction of the blade holder 28. That is, the blade holder 28 is configured to allow or facilitate an elastic torsion of each of the front and rear pillars $\mathbf{156}_1$, $\mathbf{156}_2$ which induces an elastic flexion of the elongated blade-supporting base 157 and the ice skate blade 52 in the widthwise direction of the blade holder 28 while the skater skates. This may be beneficial for the skater. For example, this may allow the skater to turn more easily and/or faster due to the curvature of the ice skate blade 52. As another example, this may create a spring effect, or "kick-back", in the widthwise direction of the blade holder 28 as the elongated blade-supporting base 157 and the ice skate blade 52 regain their normal (non-deflected) shape, which may help skating dynamics. The elastic torsion of a given one of the front and rear pillars $\mathbf{156}_1$, $\mathbf{156}_2$ manifests itself as a rotational deformation 8 and the elastic flexion of the elongated blade-supporting base 157 and the ice skate blade 52 in the widthwise direction of the blade holder 28 manifests itself as a deflection δ in the widthwise direction of the blade holder 28 in which the elongated blade-supporting base 157 and the ice skate blade 52 acquire a certain curvature (e.g., a generally parabolic curvature).

Also, in this embodiment, the blade holder 28 allows an elastic flexion of a central portion of the upper structure 132 of the blade holder 28 located between the front and rear pillars $\mathbf{156}_1$, $\mathbf{156}_2$, which in this example includes the U-shaped inner member 148 and the intermediate member 182, in the height direction of the blade holder 28 while the skater skates. That would manifest itself as a deflection of the central portion of the upper structure 132 in the height direction of the blade holder 28 and may also be beneficial. For instance, it may create a kickback in the height direction of the blade holder 28, which may help with skating dynamics. For example, during a pushing action, the elongated base 147 of the U-shaped inner member 148 can approach the elongated blade-supporting base 157 of the U-shaped outer member 156, causing the hollow space 160 to temporarily change shape during compression of the blade holder 28. When the skater's pushing action ends, the U-shaped inner and outer members 148, 156 move away from one another and return to their initial position.

More particularly, in this embodiment, the front and rear pillars $\mathbf{156}_1$, $\mathbf{156}_2$ are significantly spaced apart and relatively short in the longitudinal direction of the blade holder 28. That is, a longitudinal spacing S of the front and rear pillars $\mathbf{156}_1$, $\mathbf{156}_2$ (i.e., a maximal distance between the front and rear pillars $\mathbf{156}_1$, $\mathbf{156}_2$ in the longitudinal direction of the blade holder 28) is relatively large and a minimal longitudinal dimension D of a cross-section of either of the front and rear pillars $\mathbf{156}_1$, $\mathbf{156}_2$ (i.e., a minimal dimension in the longitudinal direction of the blade holder 28 of either of the front and rear pillars $\mathbf{156}_1$, $\mathbf{156}_2$) is relatively small.

For example, in this embodiment, the longitudinal spacing S of the front and rear pillars $\mathbf{156}_1$, $\mathbf{156}_2$ is greater than a sum of the minimal longitudinal dimension D of each of the front and rear pillars $\mathbf{156}_1$, $\mathbf{156}_2$. For instance, in some embodiments, the longitudinal spacing S of the front and rear pillars $\mathbf{156}_1$, $\mathbf{156}_2$ may be at least three times greater, in some cases at least four times greater, in some cases at least five times greater, and in some cases at least six times greater than the sum of the minimal longitudinal dimension D of each of the front and rear pillars $\mathbf{156}_1$, $\mathbf{156}_2$, or may be even greater. In this example, the longitudinal spacing S of the front and rear pillars $\mathbf{156}_1$, $\mathbf{156}_2$ is about eight times greater than the sum of the minimal longitudinal dimension D of each of the front and rear pillars $\mathbf{156}_1$, $\mathbf{156}_2$.

As another example, in some embodiments, a ratio S/L of the longitudinal spacing S of the front and rear pillars $\mathbf{156}_1$, $\mathbf{156}_2$ over the length L of the blade holder 28 may be at least 0.6, in some cases at least 0.7, in some cases at least 0.8, in some cases at least 0.9, and in some cases even greater (e.g., 0.95 or more). The ratio S/L may have any other value in other embodiments.

As yet another example, in some embodiments, a ratio S/D of the longitudinal spacing S of the front and rear pillars $\mathbf{156}_1$, $\mathbf{156}_2$ over the minimal longitudinal dimension D of one of the front and rear pillars $\mathbf{156}_1$, $\mathbf{156}_2$ may be at least 4, in some cases at least 6, in some cases at least 8, in some cases at least 10, in some cases at least 12, in some cases at least 14, in some cases at least 16, in some cases at least 18, and in some cases even greater (e.g., 20 or more). The ratio S/D may have any other value in other embodiments.

For instance, in this embodiment, the length L of the blade holder 28 may be about 300 mm, the minimal longitudinal dimension D of each of the front and rear pillars $\mathbf{156}_1$, $\mathbf{156}_2$ may be about 15 mm, and the longitudinal spacing S of the front and rear pillars $\mathbf{156}_1$, $\mathbf{156}_2$ may be about 270 mm. The length L of the blade holder 28, the minimal longitudinal dimension D of each of the front and rear pillars $\mathbf{156}_1$, $\mathbf{156}_2$, and the longitudinal spacing S of the front and rear pillars $\mathbf{156}_1$, $\mathbf{156}_2$ may have any other values in other embodiments.

In addition to the front and rear pillars $\mathbf{156}_1$, $\mathbf{156}_2$ being significantly spaced apart and relatively short in the longitudinal direction of the blade holder 28, in this embodiment, at least a significant part of the blade holder 28 is free of any inter-pillar structure comparable to at least one of the front and rear pillars $\mathbf{156}_1$, $\mathbf{156}_2$, i.e., any structure (i) between the front and rear pillars $\mathbf{156}_1$, $\mathbf{156}_2$, (ii) extending downwardly to and secured at the elongated blade-supporting base 157, (iii) having a material composition corresponding to that of (i.e., made of a same material or combination of materials as) a given one of the front and rear pillars $\mathbf{156}_1$, $\mathbf{156}_2$, and (iv) having a minimal cross-sectional area (in a plane parallel to the longitudinal direction of the blade holder 28) corresponding to at least half of that of the given one of the front and rear pillars $\mathbf{156}_1$, $\mathbf{156}_2$. For example, in this embodiment, at least a front quarter and a rear quarter of the blade holder 28 (i.e., a front quarter and a rear quarter of the length L of the blade holder 28) are free of any inter-pillar structure comparable to at least one of the front and rear pillars $\mathbf{156}_1$, $\mathbf{156}_2$. More particularly, in this embodiment, at least one of (in this case both of) a front third and a rear third of the blade holder 28 are free of any inter-pillar structure comparable to at least one of the front and rear pillars $\mathbf{156}_1$, $\mathbf{156}_2$. Specifically, in this embodiment, the blade holder 28 (i.e., an entirety of the length L of the blade holder 28) is free of any inter-pillar structure comparable to at least one of the front and rear pillars $\mathbf{156}_1$, $\mathbf{156}_2$.

Another way of viewing the blade holder 28 is that, in this embodiment, at least a significant part of the blade holder 28 is free of any inter-pillar structure substantially limiting the widthwise flexion of the elongated blade-supporting base 157, i.e., any structure (i) between the front and rear pillars $\mathbf{156}_1$, $\mathbf{156}_2$, (ii) extending downwardly to and secured at the elongated blade-supporting base 157, (iii) having a material composition corresponding to that of (i.e., made of a same material or combination of materials as) a given one of the front and rear pillars $\mathbf{156}_1$, $\mathbf{156}_2$, and (iv) reducing the widthwise deflection of the elongated blade-supporting base 157 in response to a given load by at least 10%. For example, in this embodiment, at least a front quarter and a rear quarter of the blade holder 28 (i.e., a front quarter and a rear quarter of the length L of the blade holder 28) are free of any inter-pillar structure substantially limiting the widthwise flexion of the elongated blade-supporting base 157. More particularly, in this embodiment, at least one of (in this case both of) a front third and a rear third of the blade holder 28 are free of any inter-pillar structure substantially limiting the widthwise flexion of the elongated blade-supporting base 157. Specifically, in this embodiment, the blade holder 28 (i.e., an entirety of the length L of the blade holder 28) is free of any inter-pillar structure substantially limiting the widthwise flexion of the elongated blade-supporting base 157.

Figure 8:
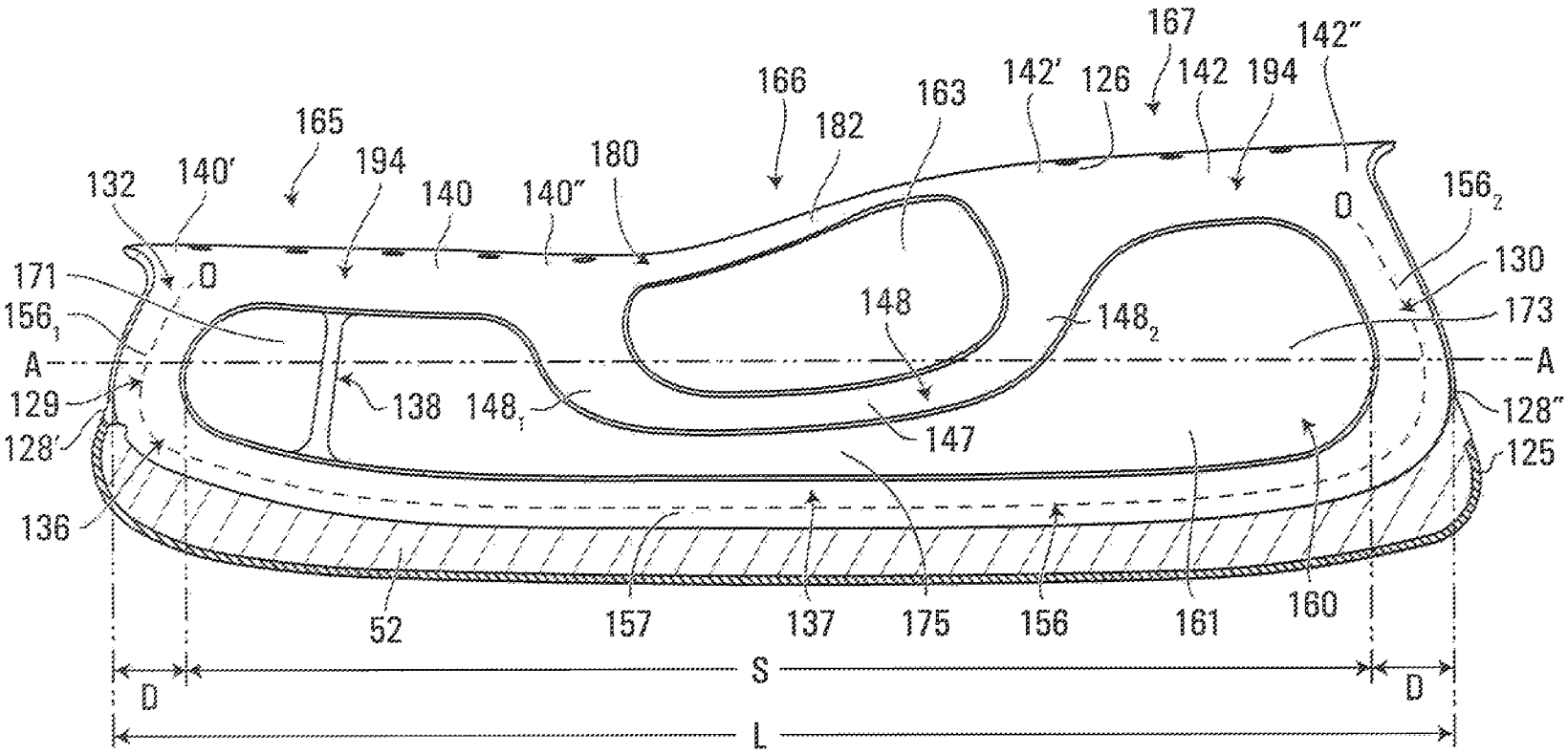
FIG. 8 is a side cross-sectional view of a variant of the ice skate blade holder including an inter-pillar structure in accordance with another embodiment of the invention.

As shown in FIG. 8, in some embodiments, the blade holder 28 may comprise an inter-pillar structure 138 extending downwardly to and secured at the elongated blade-supporting base 157, but the inter-pillar structure 138 may not substantially limit the widthwise flexion of the elongated blade-supporting base 157. The inter-pillar structure 138 would be deemed to substantially limit the widthwise flexion of the elongated blade-supporting base 157 if the widthwise deflection of the elongated blade-supporting base 157 in response to a given load was at least 10% greater if the inter-pillar structure 138 was severed but the blade holder 28 was otherwise identical. Otherwise, it would be deemed that the inter-pillar structure 138 does not substantially limit the widthwise flexion of the elongated blade-supporting base 157. It can thus be determined whether the inter-pillar structure 138 substantially limits the widthwise flexion of the elongated blade-supporting base 157 by (1) measuring the deflection of the elongated blade-supporting base 157 in response to a given load applied at a given point on the elongated blade-supporting base 157 in the widthwise direction of the blade holder 28, (2) severing (e.g., cutting through) the inter-pillar structure 138 but keeping the blade holder 28 otherwise identical, and (3) measuring the deflection of the elongated blade-supporting base 157 in response to the given load applied at the given point on the elongated blade-supporting base 157 in the widthwise direction of the blade holder 28 after the inter-pillar structure 138 has been severed. If the deflection of the elongated blade-supporting base 157 with the inter-pillar structure 138 severed is at least 10% greater than the deflection of the elongated blade-supporting base 157 with the inter-pillar structure 138 intact, the inter-pillar structure 138 is deemed to substantially limit the widthwise flexion of the elongated blade-supporting base 157; otherwise, it is deemed that the inter-pillar structure 138 does not substantially limit the widthwise flexion of the elongated blade-supporting base 157.

Referring back to FIGS. 3 to 6, in this embodiment, at least a significant part of the blade holder 28 is free of any inter-pillar structure (i.e., any structure between the front and rear pillars $\mathbf{156}_1$, $\mathbf{156}_2$) extending downwardly to and secured at the elongated blade-supporting base 157. For example, in this embodiment, at least a front quarter and a rear quarter of the blade holder 28 are free of any inter-pillar structure extending downwardly to and secured at the elongated blade-supporting base 157. More particularly, in this embodiment, at least one of (in this case both of) a front third and a rear third of the blade holder 28 are free of any inter-pillar structure extending downwardly to and secured at the elongated blade-supporting base 157. Specifically, in this embodiment, the blade holder 28 (i.e., an entirety of the length L of the blade holder 28) is free of any inter-pillar structure extending downwardly to and secured at the elongated blade-supporting base 157.

In this embodiment, therefore, the elongated blade-supporting base 157 is suspended only by the front and rear pillars $\mathbf{156}_1$, $\mathbf{156}_2$. The lower void 161 of the hollow space 160 extends from the front pillar $\mathbf{156}_1$ to the rear pillar $\mathbf{156}_2$. There is no structure extending upwardly from the U-shaped inner member 148 to the U-shaped outer member 156 between the front and rear pillars $\mathbf{156}_1$, $\mathbf{156}_2$. This may help to maximize an effect of the elastic flexion of the elongated blade-supporting base 157 and the ice skate blade 52 in the widthwise direction of the blade holder 28 while the skater skates, such as easier and/or faster turns and/or a transversal kickback, as discussed above. This may also help to maximize an effect of the elastic flexion of the central portion of the upper structure 132 of the blade holder 28 located between the front and rear pillars $\mathbf{156}_1$, $\mathbf{156}_2$, which in this example includes the U-shaped inner member 148 and the intermediate member 182, in the height direction of the blade holder 28 while the skater skates, such as a vertical kickback as previously mentioned.

The hollow space 160 of the blade holder 28 may be configured in various ways. For example, in this embodiment, the lower void 161 of the hollow space 160, which extends between the U-shaped inner and outer member 148, 156, is U-shaped. That is, each of a front region 171 and a rear region 173 of the lower void 161 has a greater height than an intermediate region 175 of the void 161. In this example of implementation, the front region 171 of the lower void 161 occupies most of a length and a height of the front portion 129 of the blade holder 28, which generally extends beneath and along the skater's forefoot in use. Similarly, the rear region 173 of the lower void 161 occupies most of a length and a height of the rear portion 130 of the blade holder 28, which extends beneath and along the skater's hindfoot in use. Also, in this embodiment, the upper void 163 of the hollow space 160 tapers in the longitudinal direction of the blade holder 28. Specifically, in this example, the upper void 163 tapers towards the front portion of the blade holder 28. The hollow space 160 may have any other suitable configuration in other embodiments.

A void of the hollow space 160 of the blade holder 28, such as the lower void 161 or the upper void 163, extends in the longitudinal direction of the blade holder 28 from a given one of the front and rear pillars $\mathbf{156}_1$, $\mathbf{156}_2$ for at least a substantial portion of the longitudinal spacing S of the front and rear pillars $\mathbf{156}_1$, $\mathbf{156}_2$. For example, in some embodiments, a void of the hollow space 160 may extend in the longitudinal direction of the blade holder 28 from a given one of the front and rear pillars $\mathbf{156}_1$, $\mathbf{156}_2$ for at least one-quarter of the longitudinal spacing S of the front and rear pillars $\mathbf{156}_1$, $\mathbf{156}_2$, in some cases at least one-third of the longitudinal spacing S of the front and rear pillars $\mathbf{156}_1$, $\mathbf{156}_2$, in some cases at least one half of the longitudinal spacing S of the front and rear pillars $\mathbf{156}_1$, $\mathbf{156}_2$, and in some cases even more. In this embodiment, the lower void 161 of the hollow space 160 extends in the longitudinal direction of the blade holder 28 from the front pillar $\mathbf{156}_1$ to the rear pillar $\mathbf{156}_2$, i.e., for an entirety of the longitudinal spacing S of the front and rear pillars $\mathbf{156}_1$, $\mathbf{156}_2$.

The hollow space 160 of the blade holder 28, which is substantial, thus helps to reduce the weight of the blade holder 28 and may facilitate the elastic widthwise flexion of the elongated blade-supporting base 157 and the ice skate blade 52 and/or the elastic vertical flexion of the central portion of the upper structure 132 of the blade holder 28 while the skater skates, as discussed above.

Figure 9:
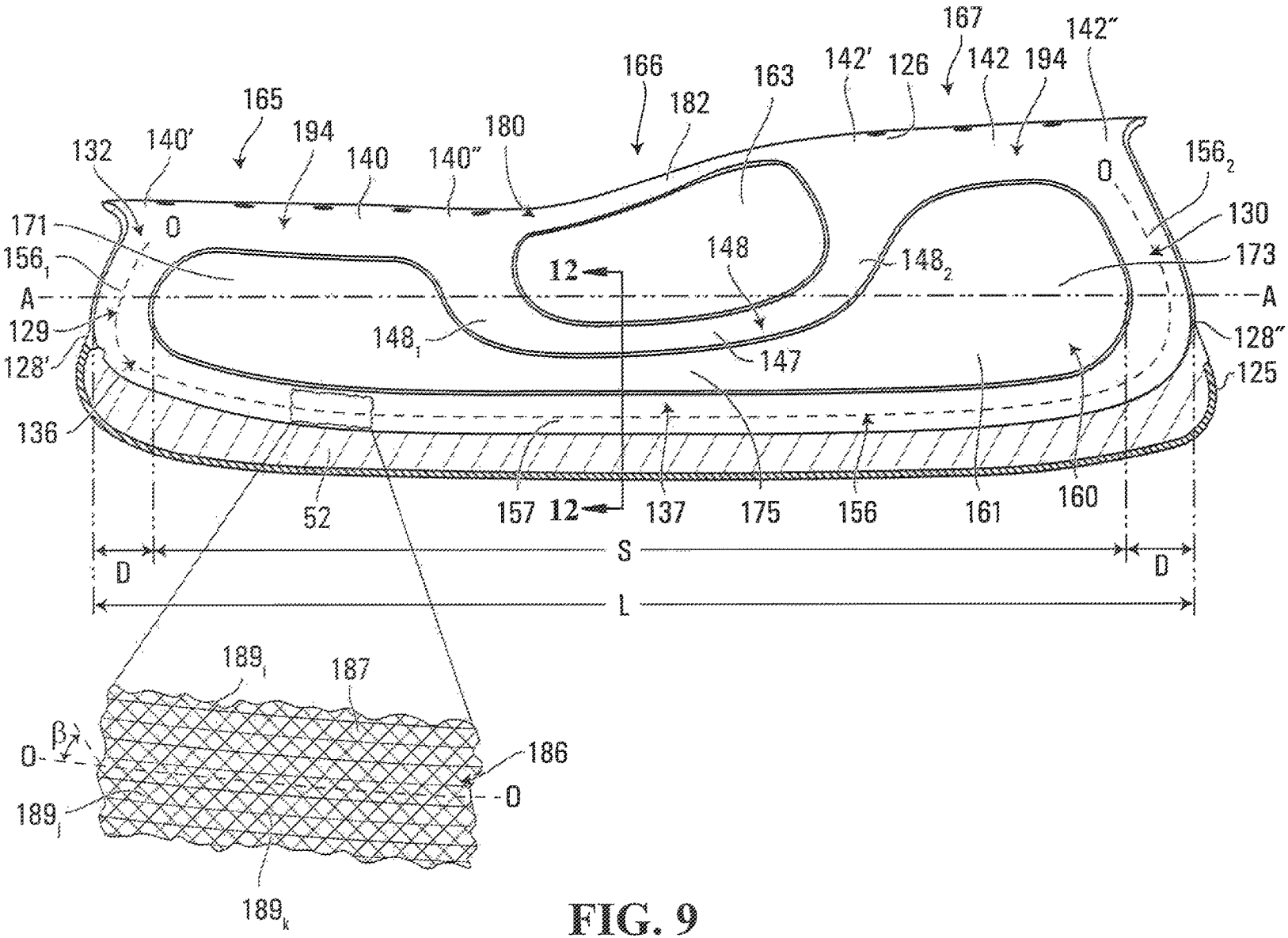
FIG. 9 illustrates a composite material of the ice skate blade holder.

The blade holder 28 can be made of any suitable material. In this embodiment, with additional reference to FIG. 9, the blade holder 28 is at least mainly (i.e., mainly or entirely) made of a composite material 186. More particularly, in this embodiment, the composite material 186 is a fiber-matrix composite material that comprises a matrix 187 in which fibers $\mathbf{189}_1$-$\mathbf{189}_F$ are embedded.

The matrix 187 may include any suitable substance. In this embodiment, the matrix 187 is a polymeric matrix. For example, the polymeric matrix 187 may include any other suitable polymeric resin, such as a thermosetting polymeric material (e.g., polyester, vinyl ester, vinyl ether, polyurethane, epoxy, cyanate ester, phenolic resin, etc.), a thermoplastic polymeric material (e.g., polyethylene, polypropylene, acrylic resin, polyether ether ketone (PEEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyamide-imide, self-reinforcing polyphenylene, etc.), or a hybrid thermosetting-thermoplastic polymeric material.

The fibers $\mathbf{189}_1$-$\mathbf{189}_F$ may be made of any suitable material. In this embodiment, the fibers $\mathbf{189}_1$-$\mathbf{189}_F$ are carbon fibers. The composite material 186 is thus a carbon-fiber-reinforced plastic in this example of implementation. Any other suitable type of fibers may be used in other embodiments (e.g., polymeric fibers such as aramid fibers (e.g., Kevlar fibers), boron fibers, silicon carbide fibers, metallic fibers, glass fibers, ceramic fibers, etc.).

In this embodiment, respective ones of the fibers $\mathbf{189}_1$-$\mathbf{189}_F$ that are located in the U-shaped outer member 156 are oriented to be in tension when the elongated blade-supporting base 157 and the ice skate blade 52 are deflected by the deflection δ in the widthwise direction of the blade holder 28 due to the elastic flexion of the elongated blade-supporting base 157 and the ice skate blade 52 in the widthwise direction of the blade holder 28. This fiber tension tends to force the elongated blade-supporting base 157 and the ice skate blade 52 back into their normal (non-deflected) shape, thereby enhancing the kickback in the widthwise direction of the blade holder 28.

For example, in this embodiment, respective ones of the fibers $\mathbf{189}_1$-$\mathbf{189}_F$ that are located in the U-shaped outer member 156 extend in a direction having at least a component parallel to a longitudinal axis O-O of the U-shaped outer member 156. In other words, respective ones of the fibers $\mathbf{189}_1$-$\mathbf{189}_F$ that are located in the U-shaped outer member 156 extend parallel or at an oblique angle to the longitudinal axis O-O of the U-shaped outer member 156. For instance, in some embodiments, an angle β between a fiber $\mathbf{189}_x$ located in the U-shaped outer member 156 and the longitudinal axis O-O of the U-shaped outer member 156 may be from 0° (parallel) to 45°.

More particularly, in this embodiment, at least a majority of the fibers $\mathbf{189}_1$-$\mathbf{189}_F$ that are located in the elongated blade-supporting base 157 of the U-shaped outer member 156 extend parallel or at an oblique angle to the longitudinal axis O-O of the U-shaped outer member 156 in the elongated blade-supporting base 157. In this example of implementation, a totality of the fibers $\mathbf{189}_1$-$\mathbf{189}_F$ that are located in the elongated blade-supporting base 157 of the U-shaped outer member 156 extend parallel or at an oblique angle to the longitudinal axis O-O of the U-shaped outer member 156 in the elongated blade-supporting base 157.

The fibers $\mathbf{189}_1$-$\mathbf{189}_F$ may be arranged in any other suitable manner in other embodiments.

In order to further reduce the weight of the blade holder 28, in this embodiment, each of the U-shaped inner and outer members 148, 156 is hollow. That is, each of the U-shaped inner and outer members 148, 156 comprises an external wall 190 defining a cavity 191 which is empty. More particularly, in this embodiment, each of the U-shaped inner and outer members 148, 156 is a tubular member having an external surface 170 and an internal surface 172. The external wall 190 extends from the external surface 170 to the internal surface 172, while the cavity 191 is delimited by the internal surface 172. In this case, the cavity 191 of each of the U-shaped inner and outer members 148, 156 opens into a cavity 194 of each of the front and rear members 140, 142 of the upper structure 132 of the blade holder 28.

The U-shaped inner and outer members 148, 156 may have any suitable cross-sectional shape. For example, in this embodiment, the U-shaped inner member 148 has a cross-sectional shape that is oblong in the widthwise direction of the blade holder 28. The U-shaped outer member 156 has a cross-sectional shape that is generally trapezoidal, tapering downwardly, and shorter than the cross-sectional shape of the U-shaped inner member 148 in the widthwise direction of the blade holder 28. Also, in this embodiment, the cross-sectional shape of each of the U-shaped inner and outer members 148, 156 is substantially uniform over that member's length.

The blade holder 28 can be manufactured in any suitable manner using various processes. In this embodiment, the blade holder 28 is a one-piece molded blade holder made by a molding process. More particularly, in this embodiment, a plurality of layers of fibers, which are destined to provide the fibers $\mathbf{189}_1$-$\mathbf{189}_F$ of the blade holder 28, are layered onto one another on a support which is then placed in a mold to consolidate the composite material 186 of the blade holder 28. In this example, each of these layers of fibers is provided as a pre-preg (i.e., pre-impregnated) layer of fibers held together by an amount of matrix material, which is destined to provide a respective portion of the matrix 187 of the blade holder 28. Also, in this example, the support comprises one or more inflatable bladders (e.g., air bladders) on which the pre-preg layers are layered such that the one or more inflatable bladders can be inflated to define the external wall 190 and the cavity 191 of each of the U-shaped inner and outer members 148, 156 during molding in the mold. The support may also comprise one or more other components (e.g., silicone mold parts) on which the pre-preg layers may be layered to form other parts of the blade holder 28 (e.g., the front and rear members 140, 142 of the upper structure 132 of the blade holder 28) during molding in the mold. Various other manufacturing methods may be used to make the blade holder 28 in other embodiments.

Figure 10:
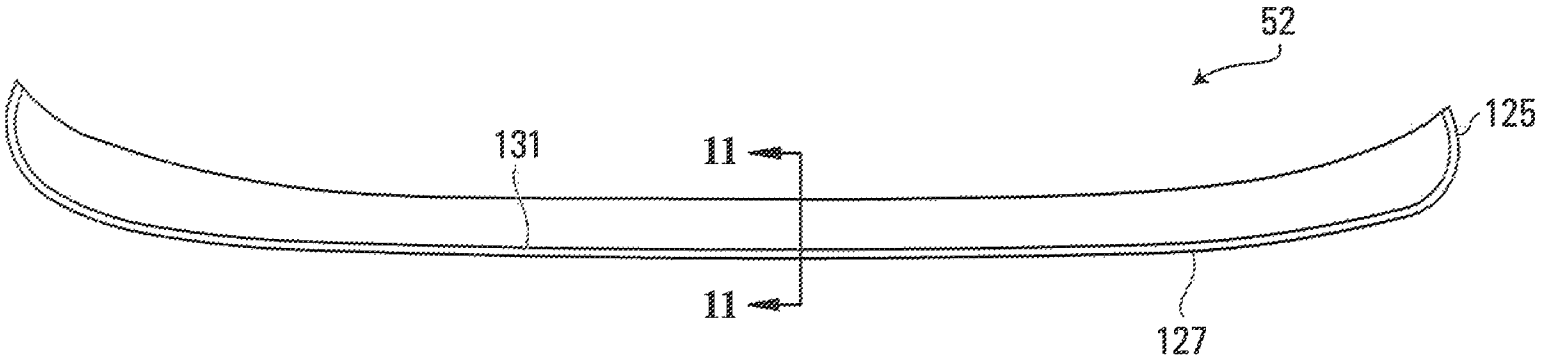
FIG. 10 is a side view of an ice skate blade of the blade holder.
Figure 11:
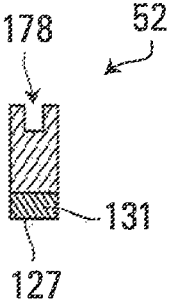
FIG. 11 is a cross-sectional view of the ice skate blade.

With additional reference to FIGS. 10 and 11, the ice skate blade 52 may comprise a runner or strip 125 that is at least mainly made of an ice-contacting material 131 and comprises an ice-contacting surface 127 for sliding on the ice while the skater skates. The ice skate blade 52 may be constructed in any suitable way. In one embodiment, an entirety of the runner 125 of the ice skate blade 52 is made of the ice-contacting material 131. In this example of implementation, the ice-contacting material 131 is a metallic material (e.g., stainless steel). The ice skate blade 52 may be implemented in various other manners in other embodiments. The ice skate blade 52 can be attached to the blade holder 28 in any suitable way. For example, the elongated blade-supporting base 157 of the blade holder 28 comprises a bottom blade-attaching portion 135 for attaching the ice skate blade 52. More particularly, the bottom blade-attaching portion 135 is configured to fit and be adhesively retained in a recess 178 of the ice skate blade 52. Any suitable adhesive may be used to retain the ice skate blade 52 to the bottom blade-attaching portion 135 of the blade holder 28 (e.g., an epoxy-based adhesive, a polyurethane-based adhesive, etc.).

The runner 125 and the blade body may be retained together in various ways. For example, the runner 125' may be adhesively affixed. Any suitable adhesive may be used to affix the runner 125 (e.g., an epoxy-based adhesive, a polyurethane-based adhesive, etc.). As another example, in addition to or instead of being adhesively fastened, the runner 125 may be fastened using one or more mechanical fasteners (e.g., rivets, screws, etc.). In other embodiments, the runner 125 and the blade body may be mechanically interlocked via a plurality of interlocking portions of one of the runner and the blade body that extend in a plurality of interlocking openings of the other one of the runner and the blade body (e.g., the blade body may be overmolded onto the runner 125).

The ice skate 10, including the blade holder 28, may be constructed in various other ways in other embodiments.

Figure 12:
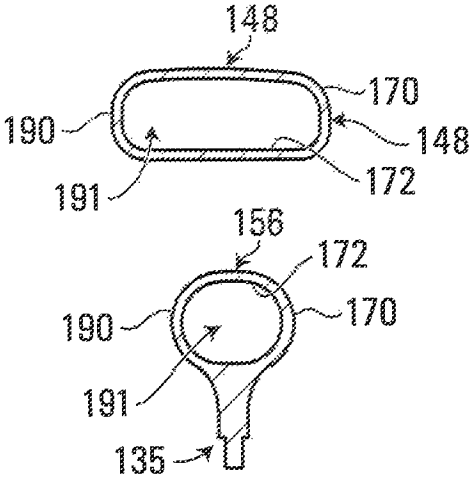
FIG. 12 is a cross-sectional view of a variant of the ice skate blade holder in accordance with another embodiment of the invention.
Figure 13A:
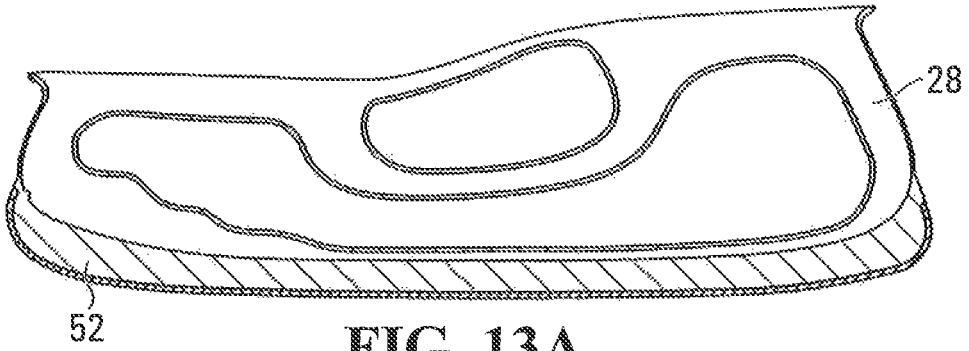
FIGS. 13A and 13B are side cross-sectional views of variants of the ice skate blade holder in accordance with other embodiments of the invention.
Figure 13B:
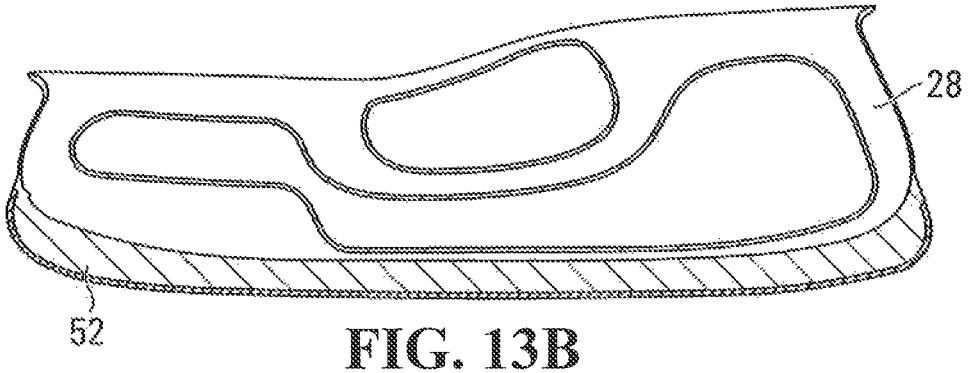
Figure 14A:
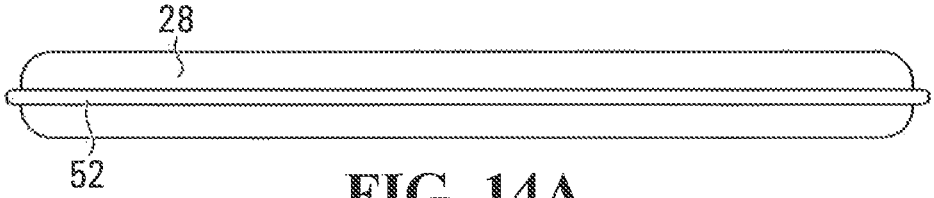
FIGS. 14A to 14F are bottom views of variants of an outline of the blade-supporting base of the ice skate blade holder in accordance with other embodiments of the invention.
Figure 14B:
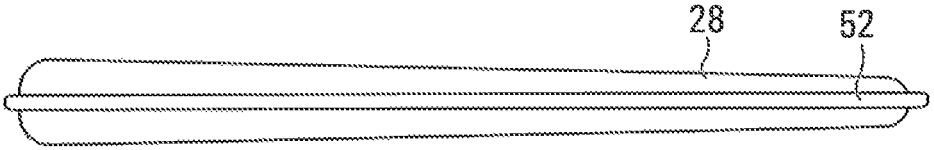
Figure 14C:
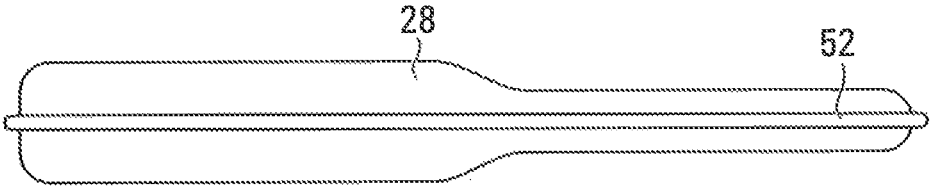
Figure 14D:
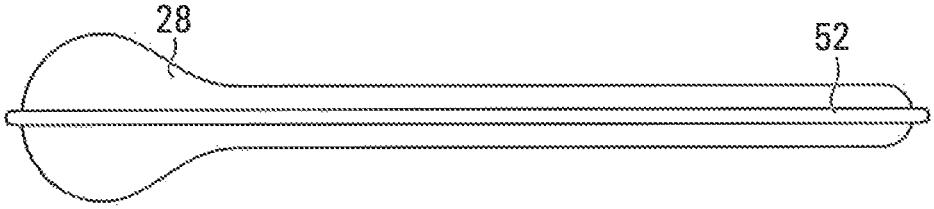
Figure 14E:
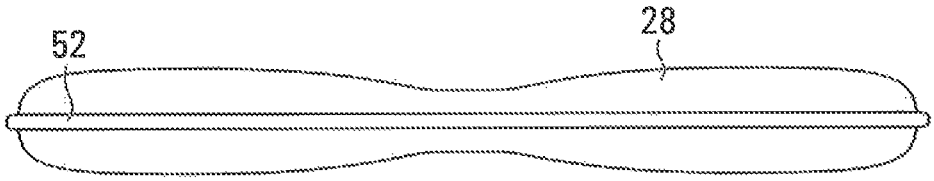
Figure 14F:
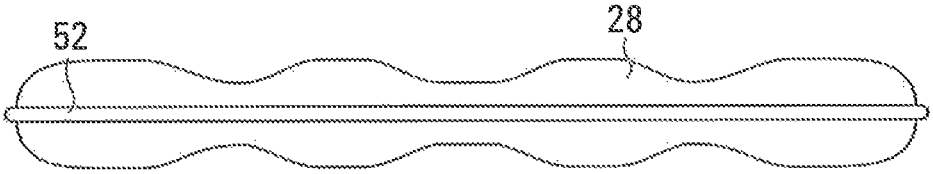

For instance, in other embodiments, the U-shaped inner and outer members 148, 156 may be shaped in various other ways. For example, the U-shaped inner and outer members 148, 156 may have any other desired cross-sectional shape. FIG. 12 shows an embodiment in which the U-shaped outer member 156 has a cross-sectional shape that is generally circular. As another example, the cross-sectional shape of the U-shaped inner member 148 or the U-shaped outer member 156 may vary along that member's length. FIGS. 13A to 14F show embodiments in which the cross-sectional shape of the elongated blade-supporting base 157 of the U-shaped outer member 156 varies in width and/or height.

While in this embodiment the minimal longitudinal dimension D of each of the front and rear pillars $\mathbf{156}_1$, $\mathbf{156}_2$ of the U-shaped outer member 156 is substantially identical, the minimal longitudinal dimension D the front pillar $\mathbf{156}_1$ may be substantially different from (i.e., larger or smaller than) the minimal longitudinal dimension D of the rear pillar $\mathbf{156}_2$.

Figure 15:
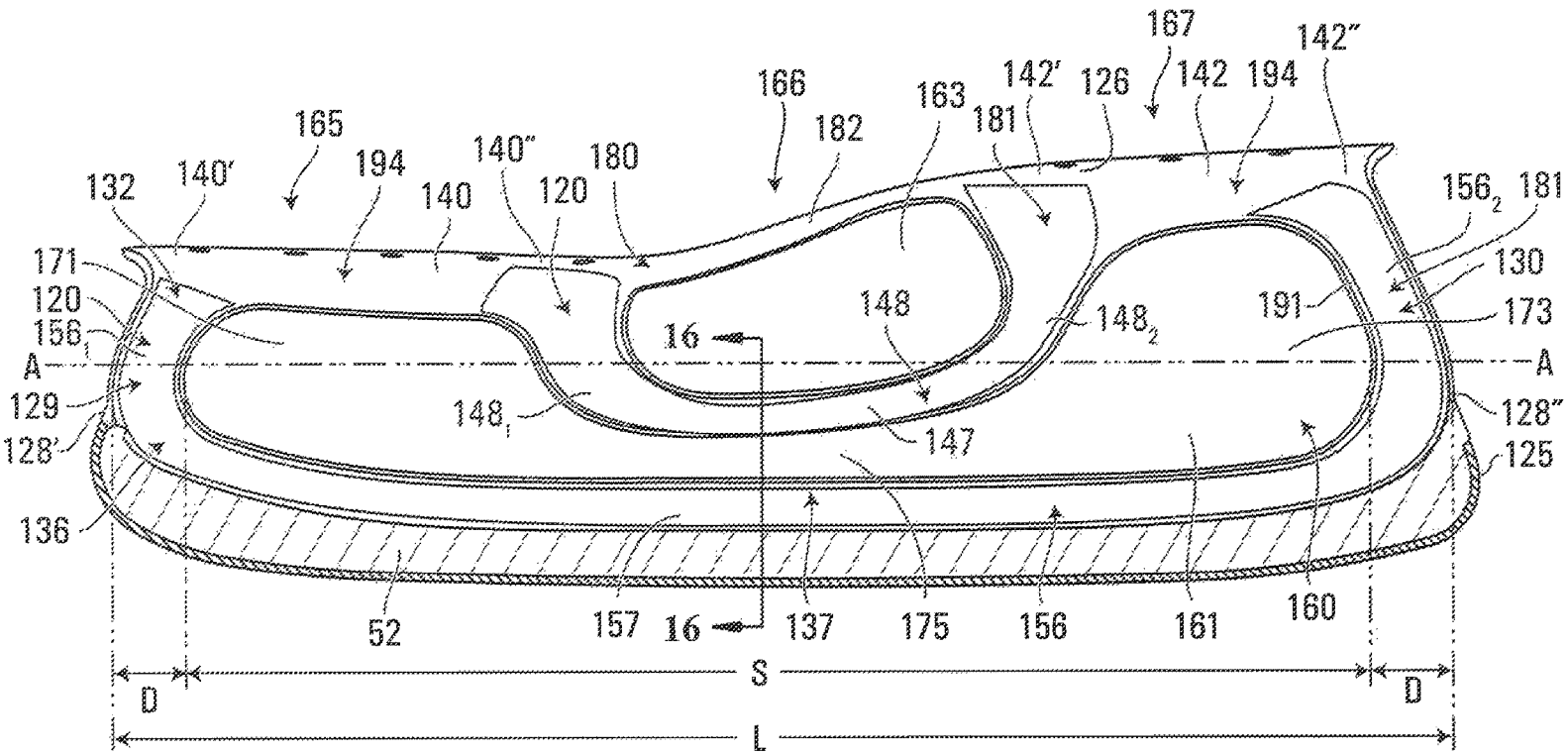
FIG. 15 is a side cross-sectional view of a variant of the ice skate blade holder including internal material in accordance with another embodiment of the invention.
Figure 16:
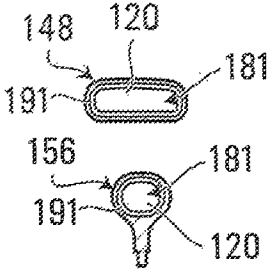
FIG. 16 is a cross-sectional view of the ice skate blade holder of FIG. 15.

Instead of being empty as in embodiments considered above, in other embodiments, as shown in FIGS. 15 and 16, the cavity 191 of at least one, in this case both, of the U-shaped inner and outer members 148, 156 may contain internal material 181.

More particularly, in this embodiment, the internal material 181 includes a filler 120 that fills at least part of the cavity 191. In this example of implementation, the filler 120 is foam. This may help to improve impact resistance and/or absorb vibrations while the skater skates. For instance, the foam 120 may be polystyrene (PS) foam, polyurethane (PU) foam, ethylene vinyl acetate (EVA) foam, polypropylene (PP) foam, polyethylene (PE) foam, vinyl nitrile (VN) foam, or any other suitable foam. In some examples of implementation, the foam 120 may have been pre-molded to form an internal frame of the blade holder 28 over which the composite material 186 may subsequently be molded. For instance, in some cases, instead of using an inflatable bladder as discussed above, the internal frame formed by the pre-molded foam 120 may constitute at least part of the support onto which the pre-preg layers of fibers are layered to mold the composite material 186. In other examples of implementation, the foam 120 may be injected into the cavity 191 after the composite material 186 has been molded.

Figure 17:
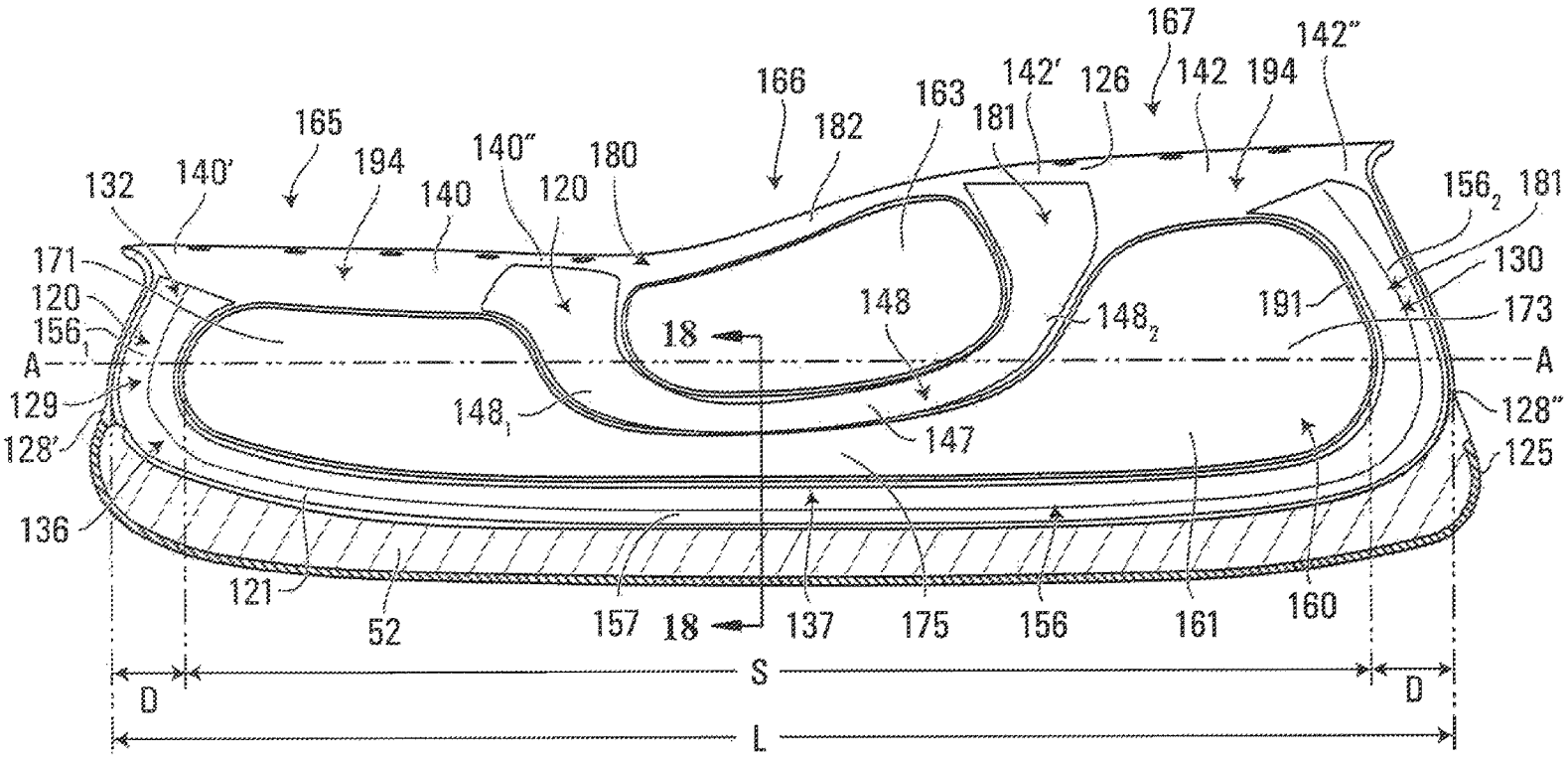
FIG. 17 is a side cross-sectional view of a variant of the ice skate blade holder including internal material comprising a filler and a reinforcement in accordance with another embodiment of the invention.
Figure 18:
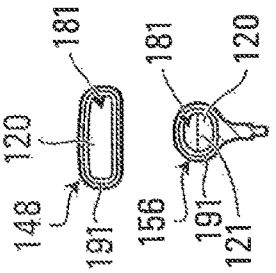
FIG. 18 is a cross-sectional view of the ice skate blade holder of FIG. 17.

In some embodiments, as shown in FIGS. 17 and 18, the internal material 181 contained in the cavity 191 of at least one of the U-shaped inner and outer members 148, 156, in this case only the U-shaped outer member 156, may include a reinforcement 121 along with the filler 120 to reinforce that member. In this embodiment, the reinforcement 121 is embedded in the filler 120. More particularly, in this example of implementation, the reinforcement 121 is a beam extending along the U-shaped outer member 156 and made of a material stiffer than the foam 120. In this case, the beam 121 is made of carbon fiber. The reinforcement 121 may be configured in various other ways in other embodiments (e.g., may be made of any other suitable material, have any other suitable shape, extend along a shorter extent of the U-shaped outer member 156, etc.).

Figure 35:
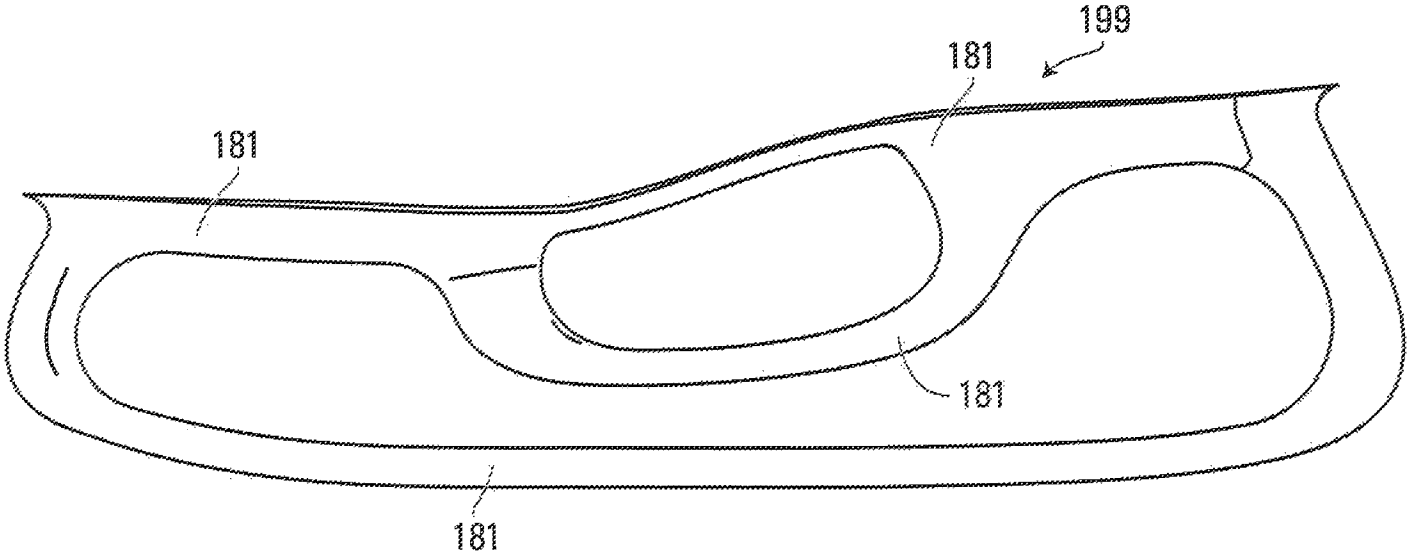
FIGS. 35 and 36 are side and top views of an internal frame of the ice skate blade holder in accordance with another embodiment of the invention.
Figure 36:
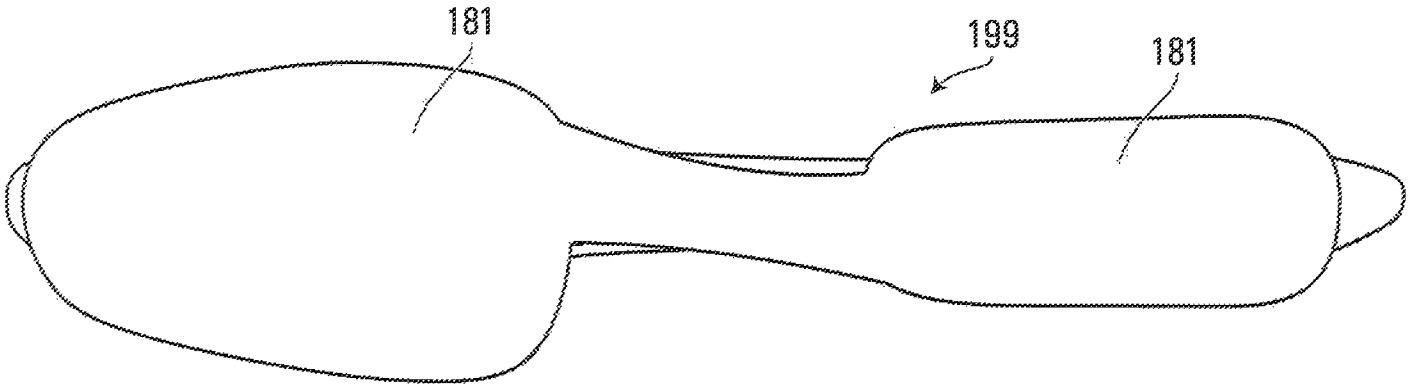
Figure 37:
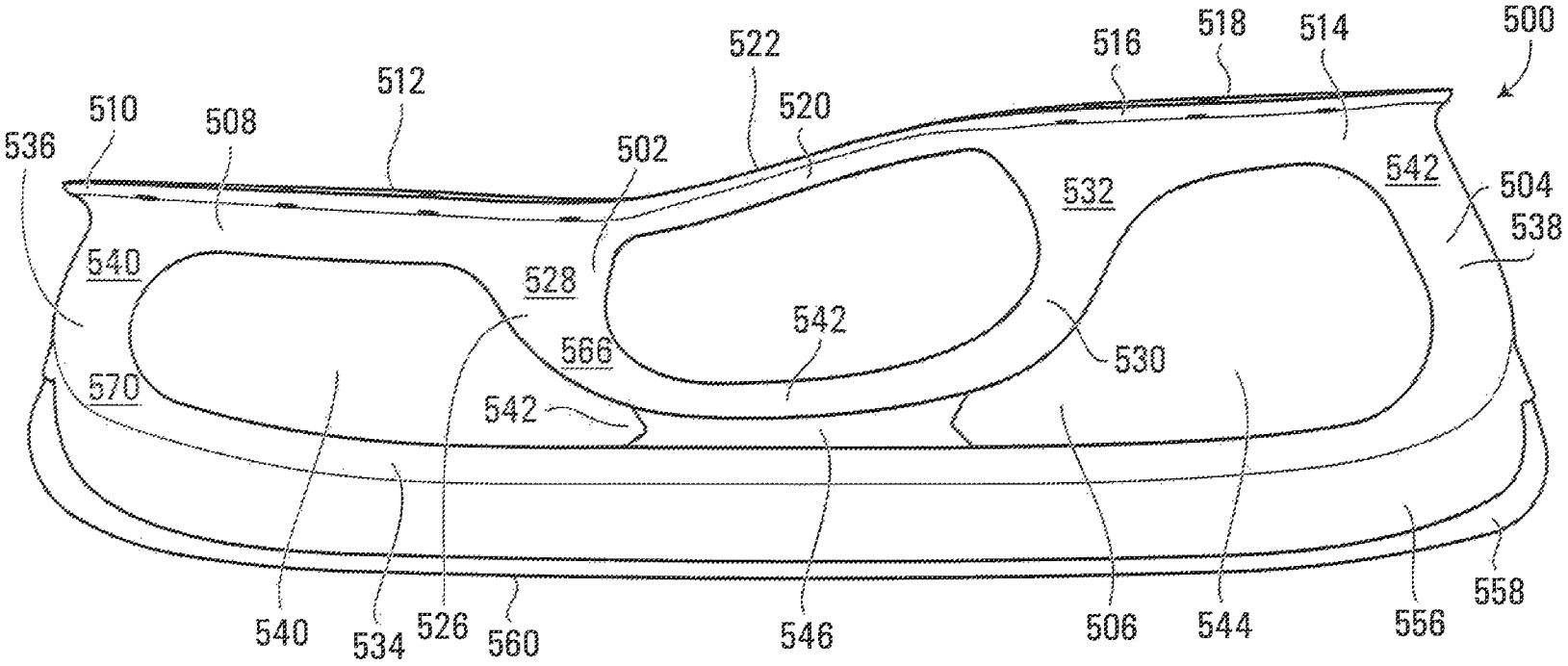
FIG. 37 is a side view of an ice skate blade holder in accordance with another embodiment of the invention.

Instead of being provided only in the cavity 191 of each of the U-shaped inner and outer members 148, 156, in other embodiments, the internal material 181 may also occupy the cavity 194 of each of the front and rear members 140, 142 of the upper structure 132 of the blade holder 28 such that it substantially occupies an entirety of a hollow space defined by the composite material 186 of the blade holder 28. For example, in some cases, as shown in FIGS. 35 and 36, the internal material 181 may thus be pre-molded into an internal frame 199 providing the support onto which the pre-preg layers of fibers are layered to mold the composite material 186 of the entire blade holder 28.

In some embodiments, at least part (e.g., some or all) of the internal material 181 may be removed after the composite material 186 has been molded to leave empty at least part of the cavity 191 of each of the U-shaped inner and outer members 148, 156 and/or of the cavity 194 of each of the front and rear members 140, 142 of the upper structure 132 of the blade holder 28. For example, in some embodiments, at least part of the internal material 181 may be dissolved by a solvent. For instance, in this embodiment in which the internal material 181 includes foam, the solvent may be acetone. Any other suitable solvent may be used in other embodiments.

Figure 20:
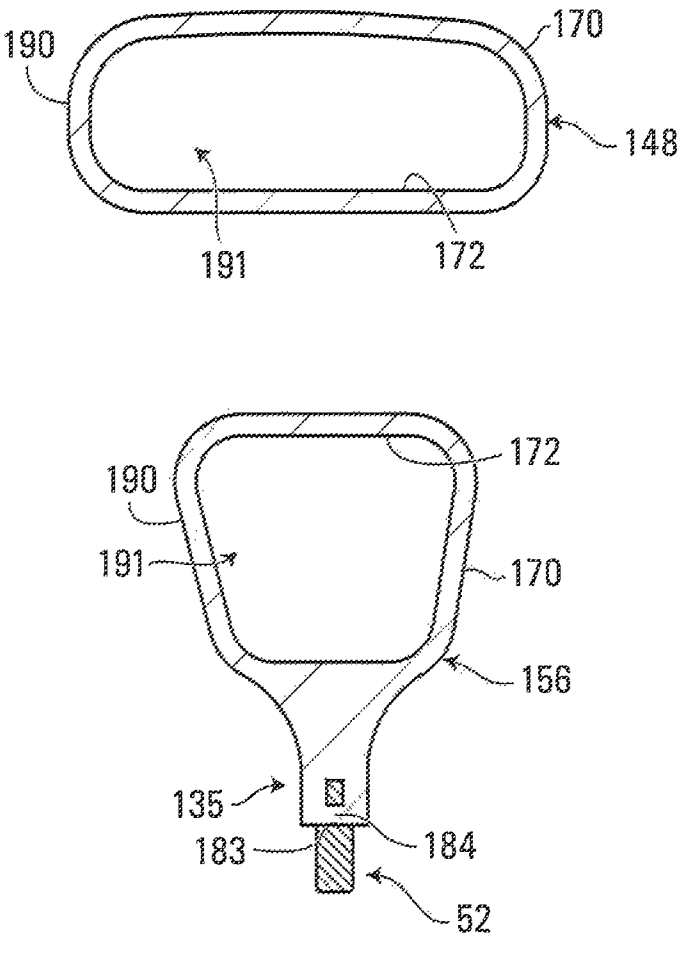
FIG. 20 is a cross-sectional view of a variant of the ice skate blade holder.
Figure 19:
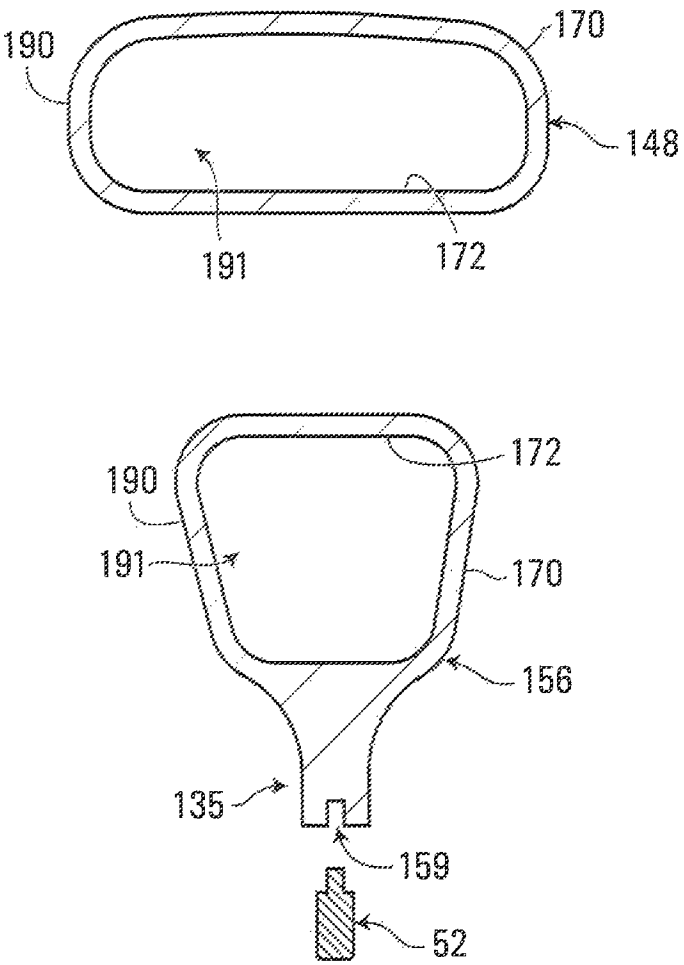
FIG. 19 is a cross-sectional view of a variant of the ice skate blade holder.

In other embodiments, the ice skate blade 52 can be attached to the blade holder 28 in various other manners. For example, in some embodiments, as shown in FIG. 19, the elongated blade-supporting base 157 of the blade holder 28 may comprise a recess 159 to receive an upper part of the ice skate blade 52, which can be adhesively retained in the recess 159. As another example, instead of or in addition to using an adhesive, in some embodiments, the ice skate blade 52 and the elongated blade-supporting base 157 of the blade holder 28 may be retained together by one or more mechanical fasteners (e.g., rivets, screws, bolts, etc.). As yet another example, in some embodiments, as shown in FIG. 20, the ice skate blade 52 and the elongated blade-supporting base 157 of the blade holder 28 may be mechanically interlocked via an interlocking portion 184 of one of the elongated blade-supporting base 157 and the ice skate blade 52 that extends into an interlocking void 183 of the other one of the elongated blade-supporting base 157 and the ice skate blade 52. For instance, the ice skate blade 52 can be positioned in a mold used for molding the blade holder 28 such that, during molding, an interlocking portion 184 of the material of the elongated blade-supporting base 157 flows into the interlocking void 183 of the ice skate blade 52 (i.e., the blade holder 28 is overmolded onto the blade 52).

Figure 21A:
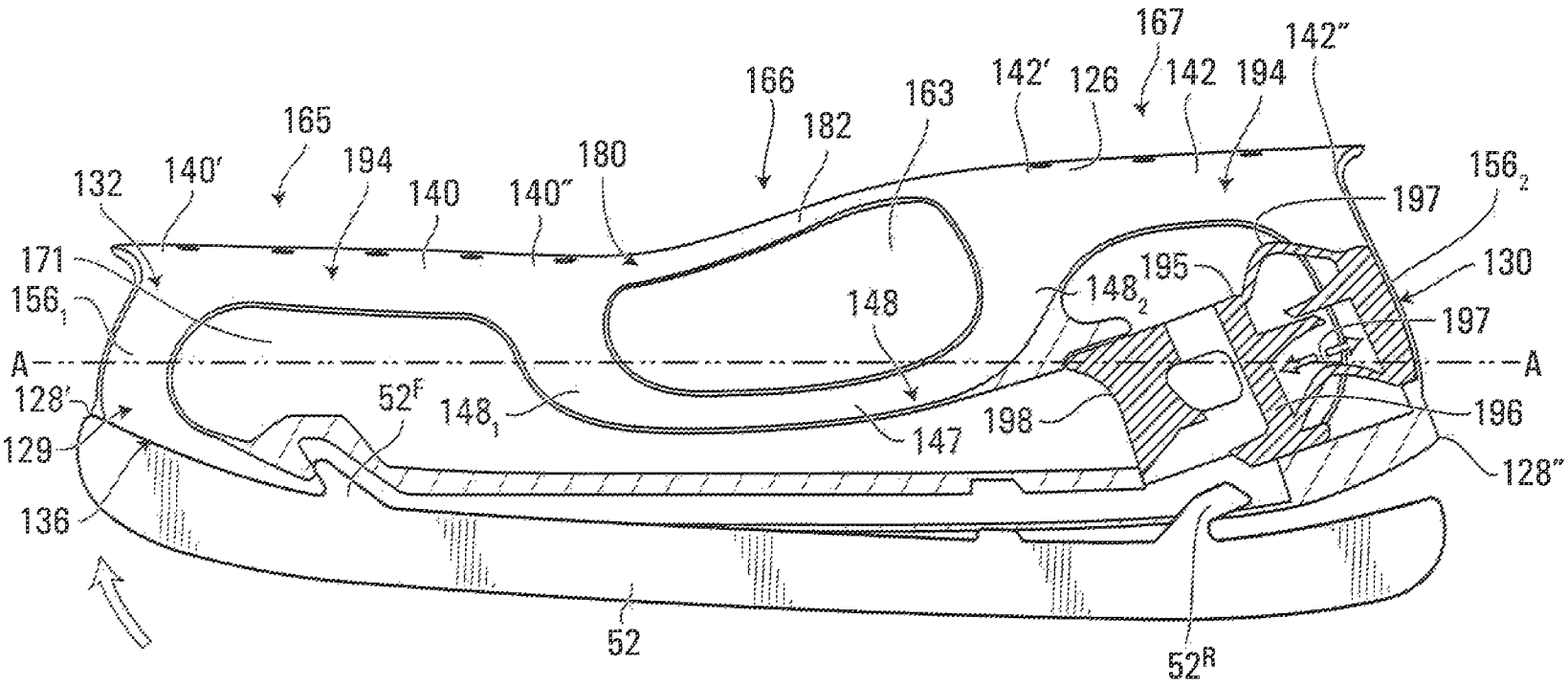
FIGS. 21A to 21C are side cross-sectional views of a variant of the ice skate blade holder including a blade-detachment mechanism in accordance with another embodiment of the invention.
Figure 21B:
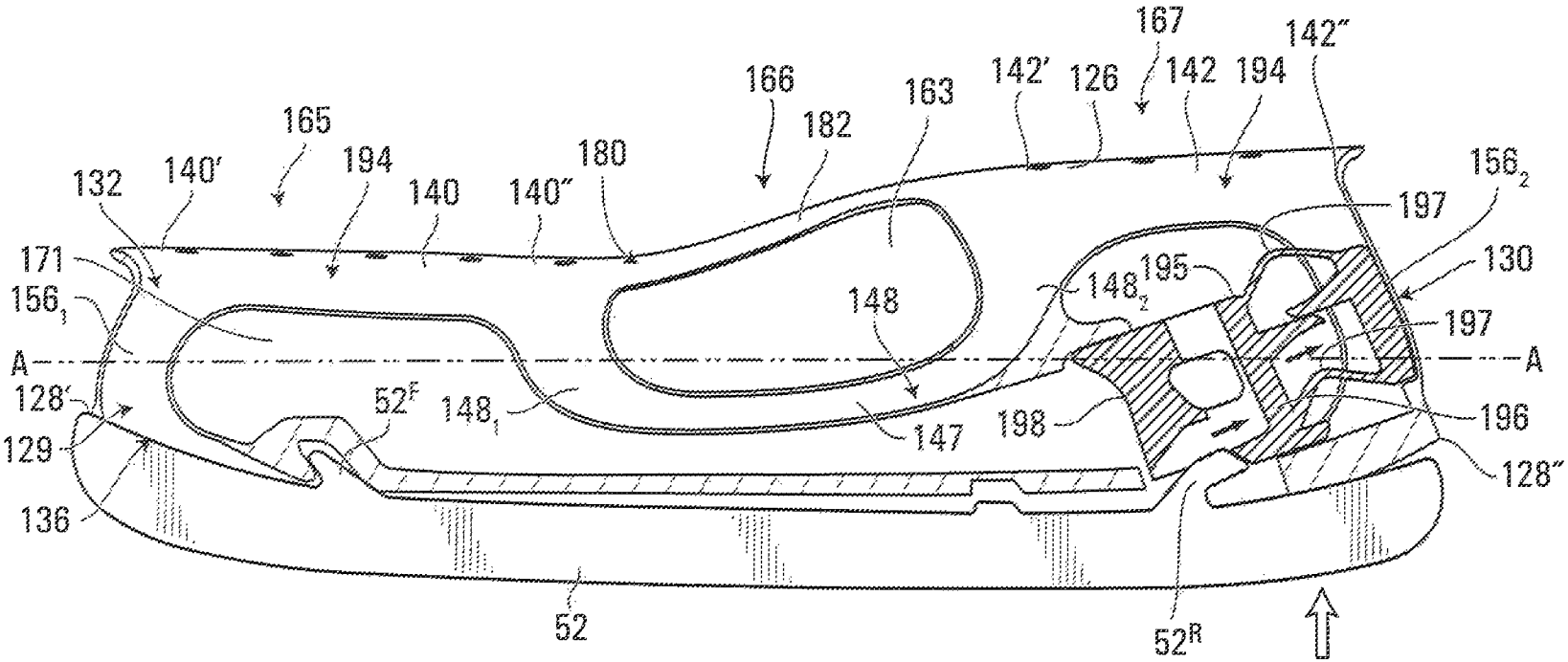
Figure 21C:
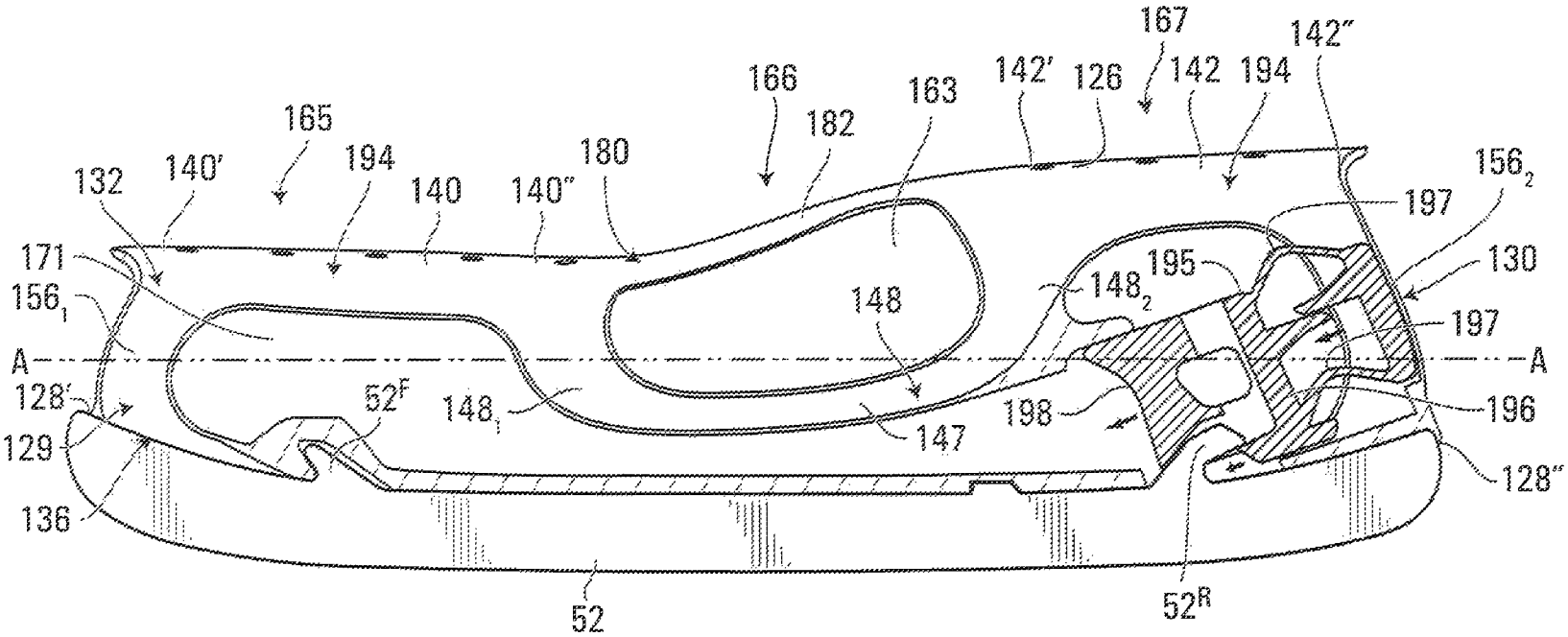

While in some embodiments the ice skate blade 52 may be permanently attached to the blade holder 28, in other embodiments, as shown in FIGS. 21A to 21C, the blade holder 28 may comprise a blade-detachment mechanism 195 such that the ice skate blade 52 is detachable and removable from the blade holder 28 (e.g., when the ice skate blade 52 is worn out or otherwise needs to be replaced or removed from the blade holder 28). In this embodiment, the ice skate blade 52 includes a plurality of projections, including a front projection $\mathbf{52}^F$ and a rear projection $\mathbf{52}^R$, the rear projection having a "hook" shape. The blade-detachment mechanism 195 includes an actuator 196 and biasing members 197 which bias the actuator 196 in a direction towards the front portion 129 of the blade holder 28. To position the ice skate blade 52 onto the blade holder 28, the front projection $\mathbf{52}^F$ is first positioned within a corresponding depression (or hole) on the blade holder 28 (see FIG. 21A). The rear projection $\mathbf{52}^R$ can then be pushed upwardly, thereby causing the biasing members 197 to bend and the actuator 196 to move in a rearward direction (see FIG. 21B). The rear projection $\mathbf{52}^R$ will eventually reach a position which will allow the biasing members 197 to force the actuator 196 towards the front portion 129 of the blade holder 28, thereby locking the ice skate blade 52 in place (see FIG. 21C). The ice skate blade 52 can then be removed by pushing against a finger actuating surface 198 on the actuator 196 to release the rear projection $\mathbf{52}^R$ from its corresponding depression (or hole) on the blade holder 28. The blade-detachment mechanism 195 may be configured in various other ways in other embodiments.

Figure 22:
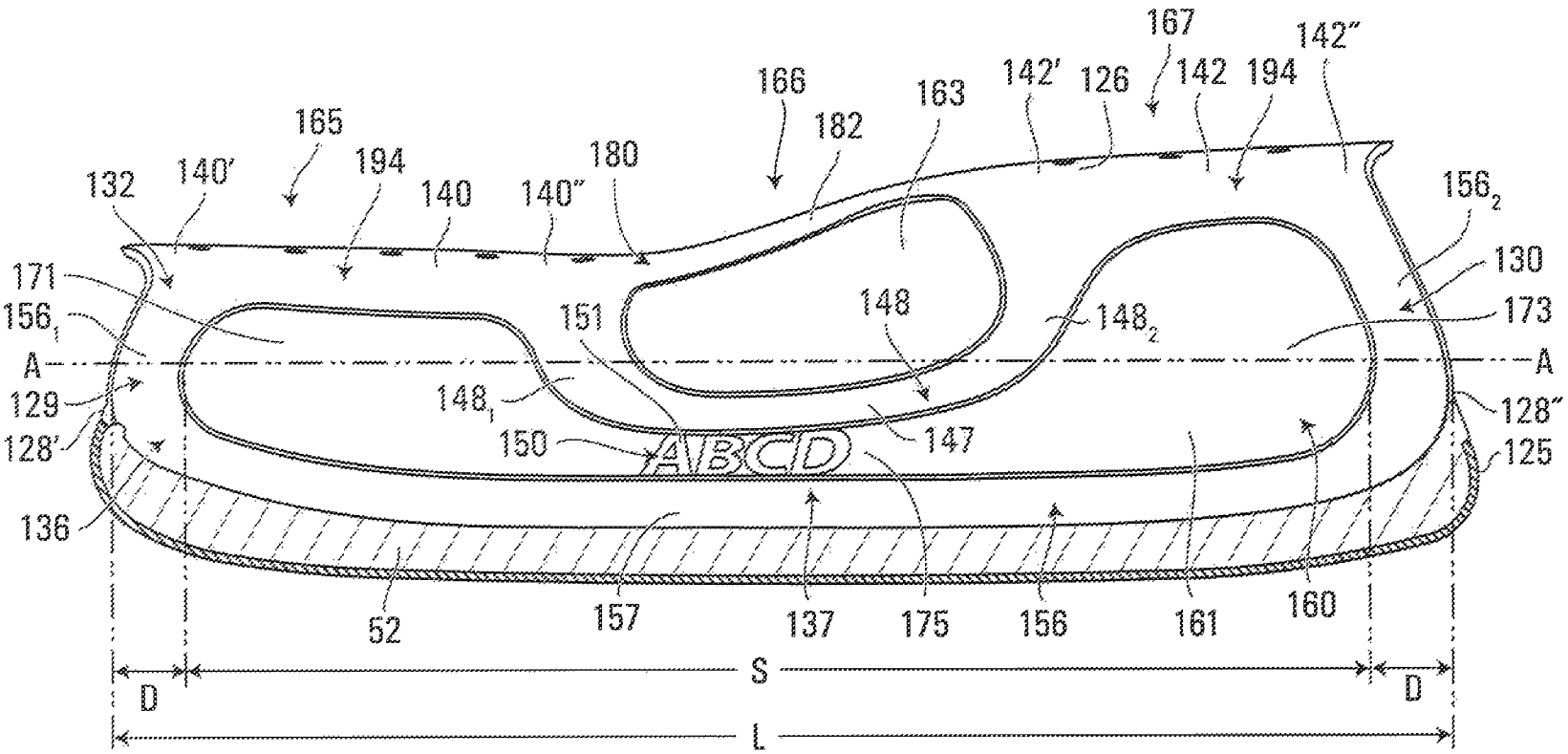
FIG. 22 is a side view of a variant of the ice skate blade holder including a resilient element in accordance with another embodiment of the invention.
Figure 23A:
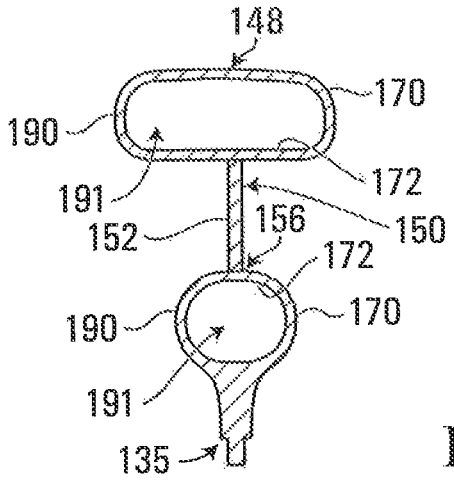
FIGS. 23A to 23G are cross-sectional views of variants of the ice skate blade holder in accordance with other embodiments of the invention.
Figure 23B:
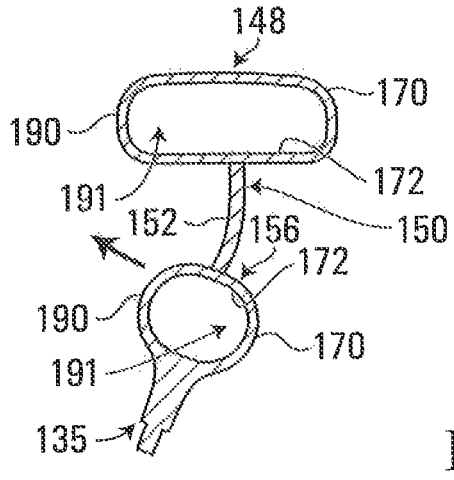
Figure 23C:
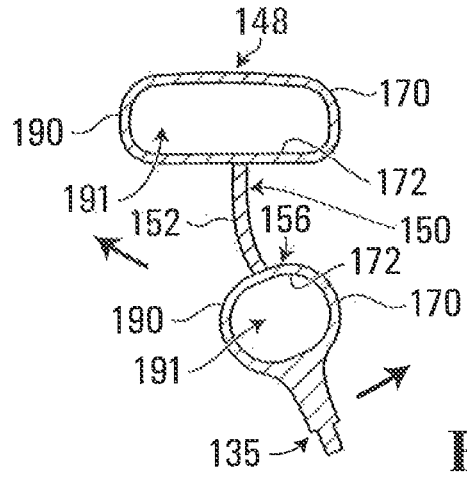
Figure 23D:
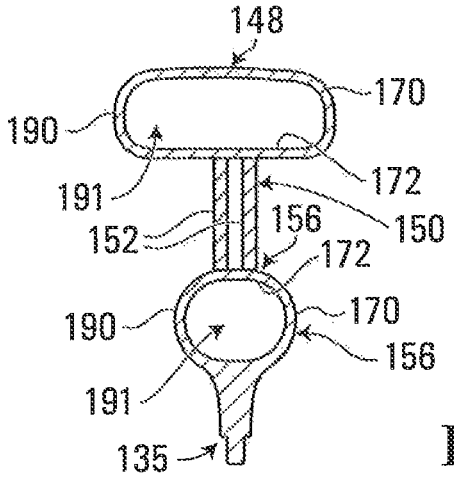
Figure 23E:
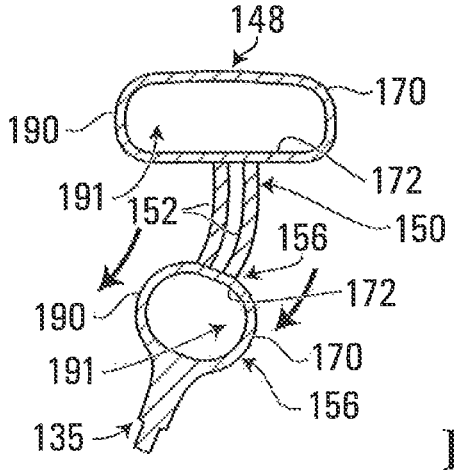
Figure 23F:
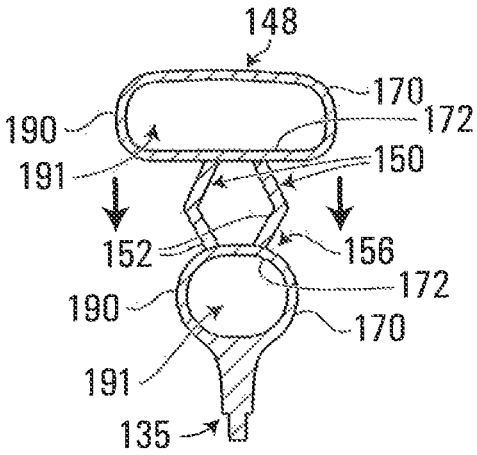
Figure 23G:
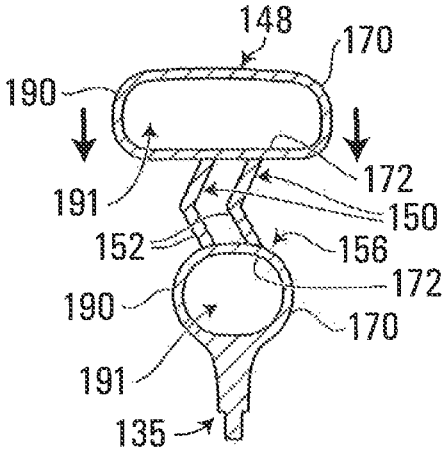

In some embodiments, as shown in FIG. 22, the blade holder 28 may comprise a resilient element 150 disposed between its upper structure 132 and its lower structure 136 and resiliently deformable (i.e., configured to change in shape under load and subsequently recover its original shape) while the skater skates. In this embodiment, the resilient element 150 is a damper to dampen vibrations in the blade holder 28 while the skater skates. Notably, in this example, the resilient element 150 dampens vibrations due to the elastic flexion of the elongated blade-supporting base 157 of the U-shaped outer member 156 while the skater skates. This absorption of vibrations may also help to reduce noise generated by the blade holder 28 while the skater skates.

In this embodiment, the resilient element 150 extends upwardly from the U-shaped outer member 156. More particularly, in this embodiment, the resilient element 150 extends from the U-shaped outer member 156 to the U-shaped inner member 148. The resilient element 150 is positioned between the elongated blade-supporting base 157 of the U-shaped outer member 156 and the elongated base 147 of the U-shaped inner member 148. More specifically, the resilient element 150 is positioned in the central arch-underlying portion 166 of the blade holder 28 and engages with the external surfaces 170 of the U-shaped inner and outer members 148, 156. As such, in addition to its vibration absorption capability, the resilient element 150 may also be used to adjust a degree of movement permitted between the U-shaped inner and outer members 148, 156, in the width-wise direction and/or the height direction of the blade holder 28.

The resilient element 150 can be implemented in any suitable way. For example, in this embodiment, the resilient element 150 comprises a cushion 151 (i.e., an elastic body) for reducing vibrations. More particularly, in this embodiment, the cushion 151 is made of an elastic material (i.e., a material capable of recovering size and shape after deformation) different from the composite material 186 of the blade holder 28. The elastic material of the cushion 151 may be relatively soft. For instance, in this embodiment, the elastic material of the cushion 151 may have a hardness of no more than 95 durometers Shore A. The hardness of the elastic material of the cushion 151 may have any other suitable value in other embodiments. In this example of implementation, the elastic material of the cushion 151 is polyurethane. Any other suitable elastic material may be used for the cushion 151 in other examples of implementation (e.g., rubber, thermoplastic elastomer, foam, etc.)

The resilient element 150 can be secured between the upper structure 132 and the lower structure 136 of the blade holder 28 in any suitable way. For example, in this embodiment, the resilient element 150 is adhesively secured to each of the U-shaped inner and outer members 148, 156 by an adhesive at these members' respective interfaces. In other embodiments, the resilient element 150 may be secured to one or both of the U-shaped inner and outer members 148, 156 by one or more mechanical fasteners (e.g., rivets, screws, bolts, etc.).

In this embodiment, the resilient element 150 is shaped as a graphical element that conveys information to an observer. For example, in this embodiment, the resilient element 150 is configured as a word (i.e. a combination of characters, in this case "ABCD") which may be associated with a brand of the blade holder 28 and/or the ice skate 10. In other embodiments, the resilient element 150 may be shaped as a logo or any other graphical element associated with a team of the skater or a brand of the blade holder 28 and/or the ice skate 10, or as any other desired graphical element.

The resilient element 150 can be constructed in various other manners in other embodiments. For example, in some embodiments, as shown in FIGS. 23A to 23G, the resilient element 150 may comprise at least one thin flexible arm 152 that extends from the U-shaped outer member 156 to the U-shaped inner member 148 and bends when the U-shaped inner and outer members 148, 156 move relative to one another. In such embodiments, the thin flexible arm 152 may be made of the composite material 186 of the blade holder 28 or of a different material.

Figure 24A:
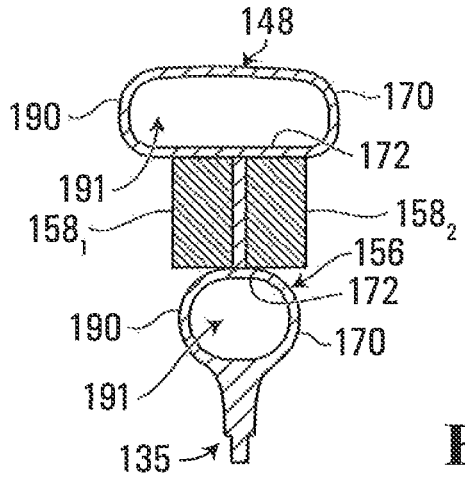
FIGS. 24A to 24C are cross-sectional views of variants of the ice skate blade holder in accordance with other embodiments of the invention.
Figure 24B:
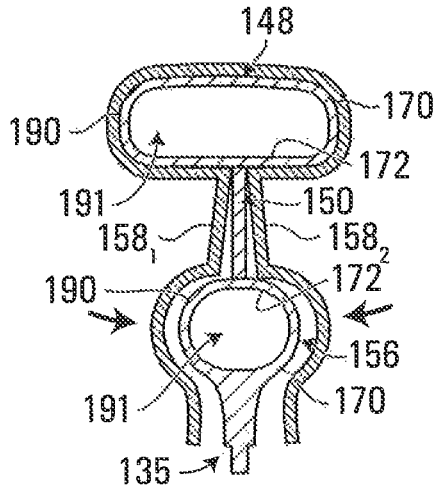
Figure 24C:
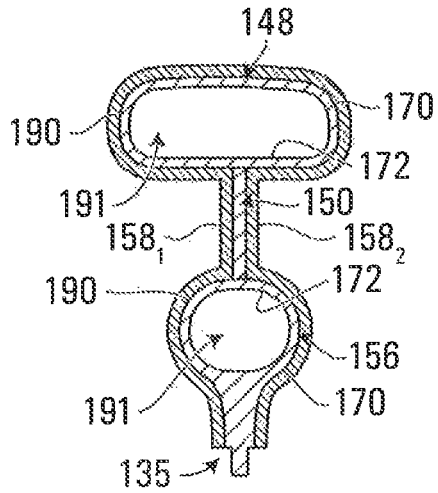

While in embodiments considered above the resilient element 150 is permanently secured to the U-shaped inner and outer members 148, 156, in other embodiments, as shown in FIGS. 24A to 24C, the resilient element 150 may be attachable to and detachable from the blade holder 28. This may allow a customization of the blade holder 28 by allowing the skater to use or not use the resilient element 150 and/or use a selected one of a plurality of different resilient elements like the resilient element 150 which have different properties. For instance, in this embodiment, the resilient element 150 comprises a pair of cushions $\mathbf{158}_1$, $\mathbf{158}_2$ that can be retained on respective sides of a centerline bisecting the U-shaped inner and outer members 148, 156 by a mechanical fastener (e.g., a screw, a bolt, a clamp, etc.).

Figure 25:
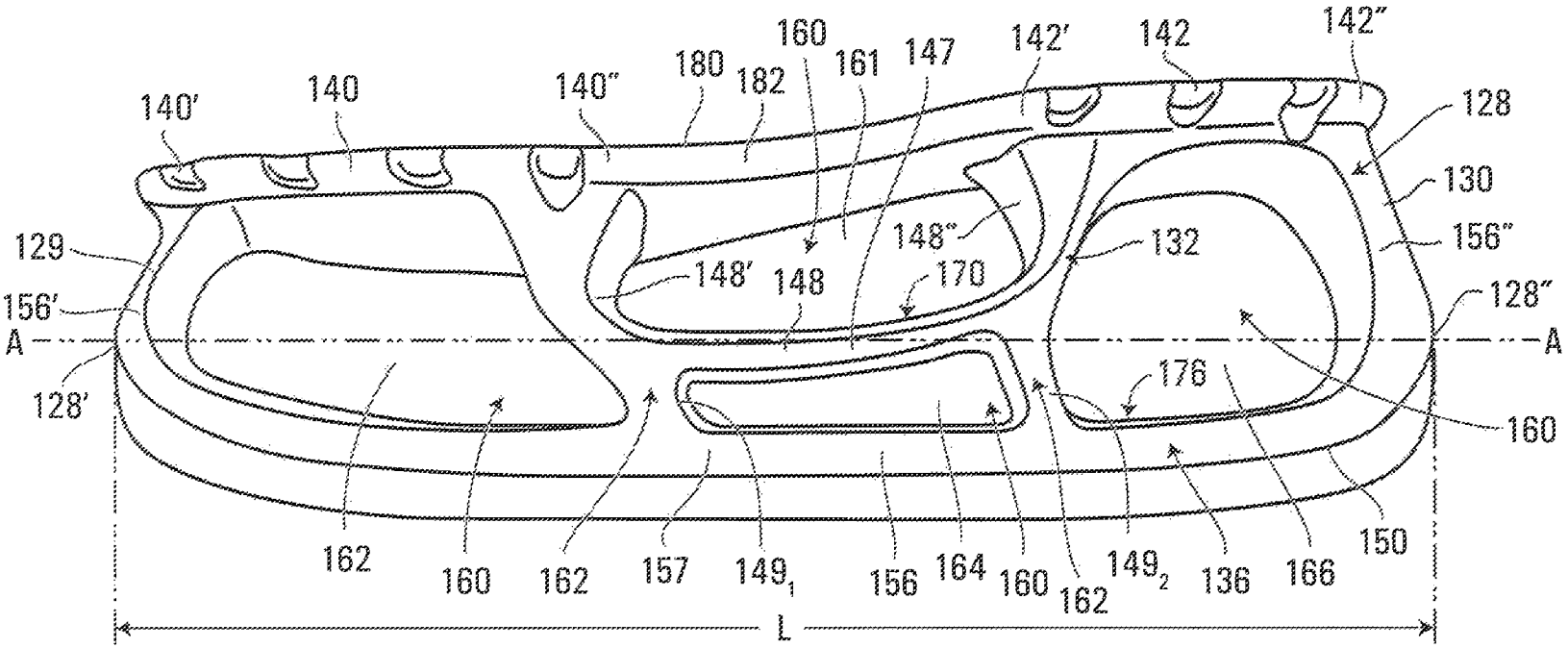
FIG. 25 is a side view of a variant of the ice skate blade holder in accordance with another embodiment of the invention.

In some embodiments, as shown in FIG. 25, the blade holder 28 may comprise an inter-pillar structure 162 between the front and rear pillars $\mathbf{156}_1$, $\mathbf{156}_2$ and extending downwardly to and secured at the elongated blade-supporting base 157 of the U-shaped outer member 156. More particularly, in this embodiment, the inter-pillar structure 162 comprises a plurality of ribs $\mathbf{149}_1$, $\mathbf{149}_2$ which extend downwardly from the U-shaped inner member 148 to the U-shaped outer member 156. In this example, each of the ribs $\mathbf{149}_1$, $\mathbf{149}_2$ has a similar construction to the U-shaped inner and outer members 148, 156 (i.e., each of the ribs $\mathbf{149}_1$, $\mathbf{149}_2$ is made of the same composite material as the U-shaped inner and outer members 148, 156). In fact, in this example, the ribs $149_1$, $149_2$ are molded with the U-shaped inner and outer members 148, 156 during molding of the blade holder 28.

The inter-pillar structure 162 may be implemented in any other suitable way in other embodiments. For example, in other embodiments, the inter-pillar structure 162 may comprise a different number of ribs similar to ribs $149_1$, $149_2$ to connect the U-shaped inner and outer members 148, 156 (i.e., a single rib or more than two ribs). As another example, while the ribs $149_1$, $149_2$ are shown to extend in a direction almost perpendicular to the longitudinal axis A-A of the blade holder 28, a rib similar to ribs $149_1$, $149_2$ may extend in any direction in other embodiments. As yet another example, in other embodiments, the ribs $149_1$, $149_2$ may be made of a different material than the U-shaped inner and outer members 148, 156 and/or may be full.

The blade holder 28 may have any other desirable configuration in other embodiments.

Figure 26:
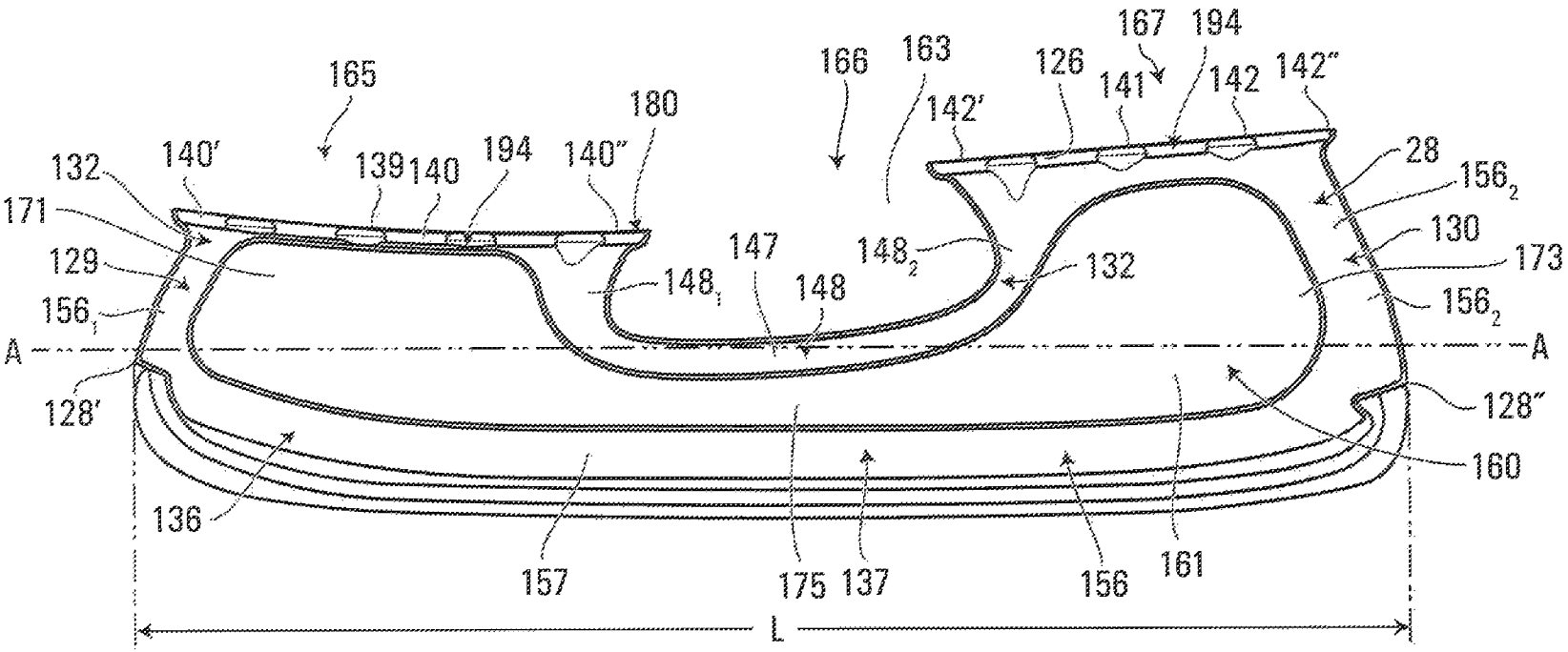
FIG. 26 is a side view of a variant of the ice skate blade holder in accordance with another embodiment of the invention.
Figure 27:
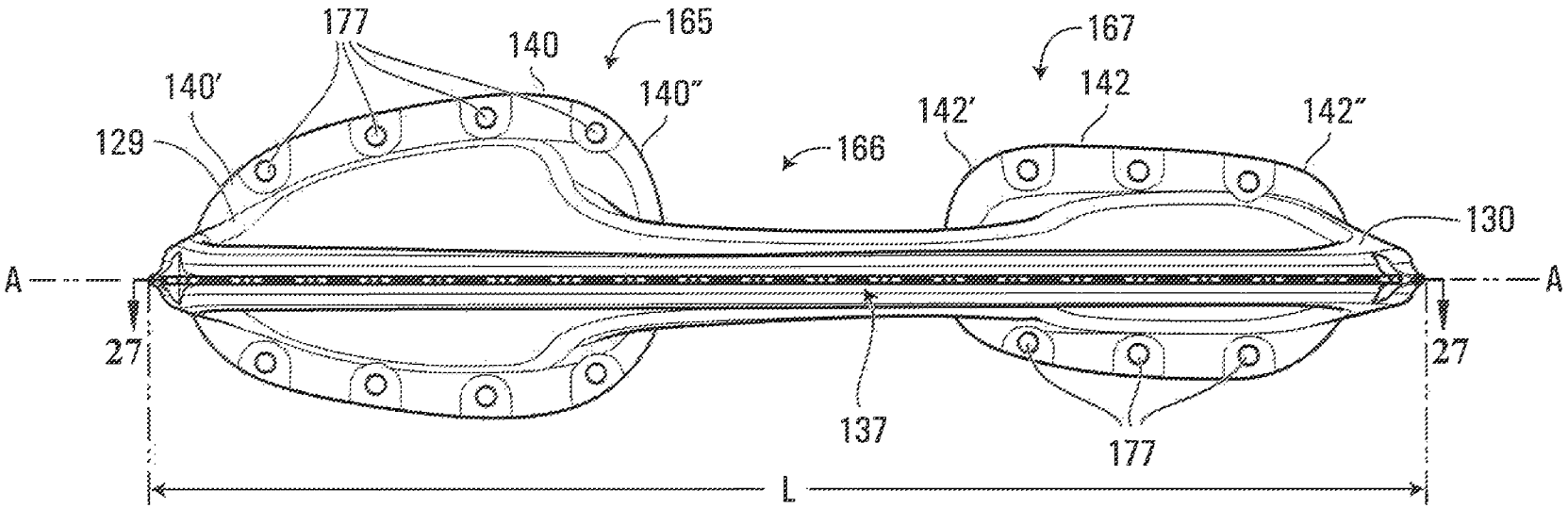
FIG. 27 is a bottom view of the ice skate blade holder of FIG. 26.
Figure 28:
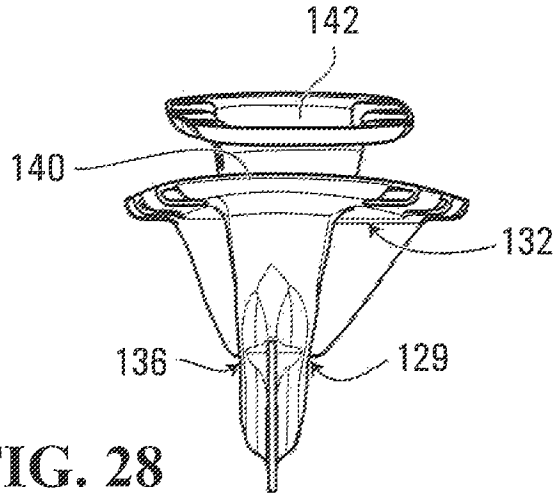
FIG. 28 is a front view of the ice skate blade holder of FIG. 26.

For example, in some embodiments, as shown in FIGS. 26 to 28, the upper structure 132 of the blade holder 28 comprises the U-shaped inner member 148 as well as the front member 140 and the rear member 142 that are configured to be affixed to the skate boot 11, but is free of an intermediate member (such as intermediate member 182) extending between the front and rear members 140, 142 and affixed to the skate boot 11. The front member 140 is connected to the front portion of the skate boot 11 for supporting the ball B and toes T of the skater's foot F and the rear member 142 is connected to the rear portion of the skate boot 11 for supporting the heel H of the skater's foot F. With the U-shaped inner member 148 being located in between and generally lower than the front and rear members 140, 142, the front and rear members 140, 142 form upper surfaces of front and rear pedestals 139, 141 of the blade holder 28.

Figure 29:
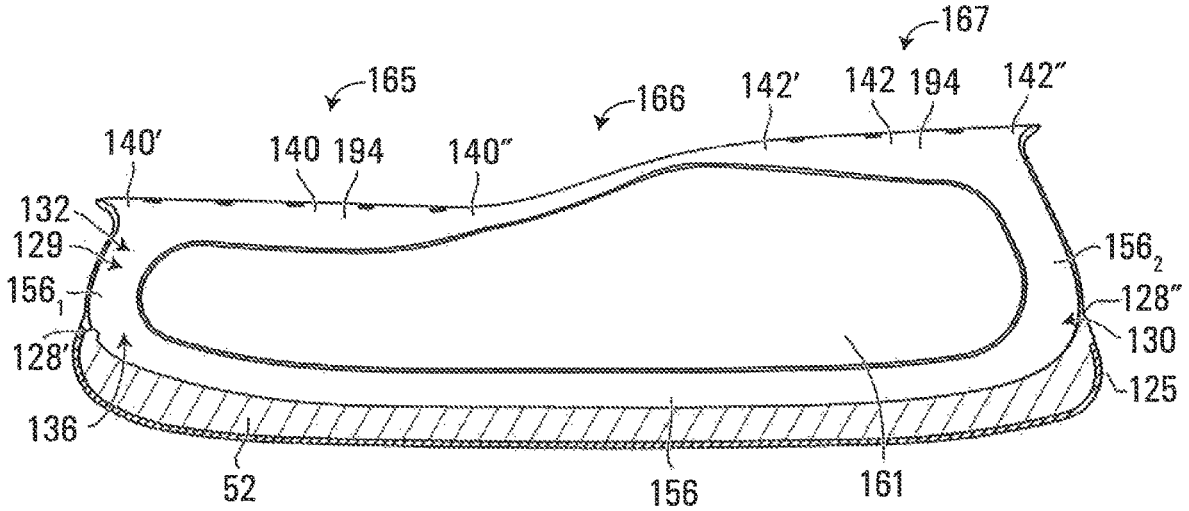
FIGS. 29 and 30 are side cross-sectional views of variants of the ice skate blade holder in accordance with other embodiments of the invention.
Figure 30:
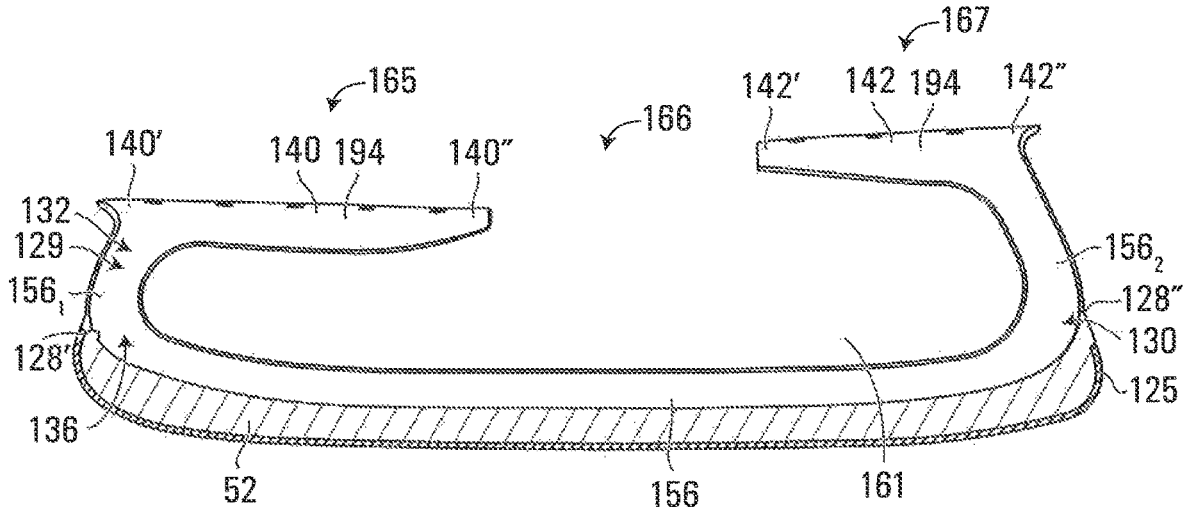

As another example, in some embodiments, as shown in FIG. 29, the upper structure 132 of the blade holder 28 comprises the front member 140, the rear member 142 and the intermediate member 182 that are configured to be affixed to the skate boot 11, but is free of a U-shaped inner member like the U-shaped inner member 148. In other embodiments, as shown in FIG. 30, the upper structure 132 of the blade holder 28 comprises the front member 140 and the rear member 142 that are configured to be affixed to the skate boot 11, but is free of a U-shaped inner member like the U-shaped inner member 148.

Figure 31:
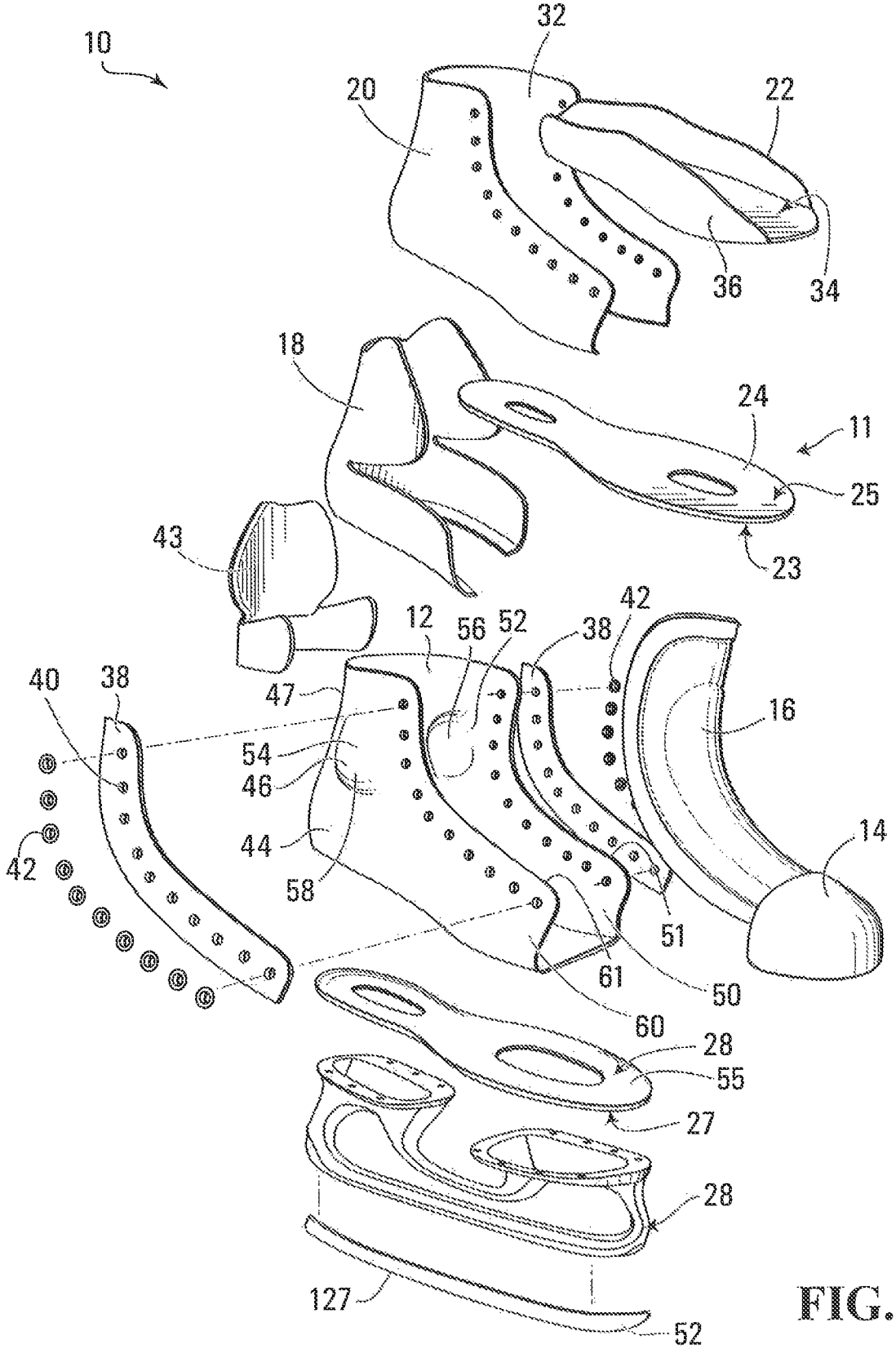
FIG. 31 is an exploded view of a variant of the ice skate including an outsole which is separate from the ice skate blade holder in accordance with another embodiment of the invention.

While in certain embodiments considered above the upper structure 132 of the blade holder 28 includes the outsole 126 to be affixed to the skate boot 11, in other embodiments, as shown in FIG. 31, the skate boot 11 may itself include an outsole 55. The outsole 55 of the skate boot 11 includes an upper surface 28 on which the outer shell 12 may be affixed and a lower surface 27 on which the blade holder 28 is mounted.

The blade holder 28 may be made using any other suitable manufacturing process in other embodiments. For example, in other embodiments, the blade holder 28 may be formed as a single piece via compression molding or injection molding. In other embodiments, the blade holder 28 may be formed of two separate pieces that are pressed onto either side of the ice skate blade 52 and affixed to one another via any appropriate fastening means (e.g., rivets, screws, adhesive, heat-melt welding, etc.).

Figure 32:
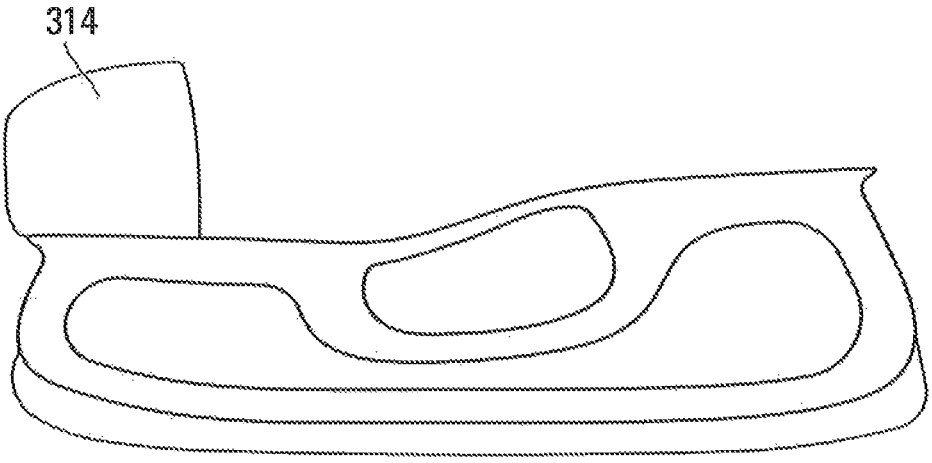
FIG. 32 is a side view of a variant in which the ice skate blade holder and a toe cap of a skate boot of the ice skate are integrally formed in accordance with another embodiment of the invention.

In some embodiments, certain parts of the skate boot 11 may be integrally molded with the blade holder 28. For example, in some embodiments, as shown in FIG. 32, instead of the skate boot 11 having the toe cap 14 separately affixed, a toe cap 314 of the skate boot 11 may be integrally molded with the blade holder 28 such that the blade holder 28 and the toe cap 314 constitute a one-piece molded component.

Figure 33:
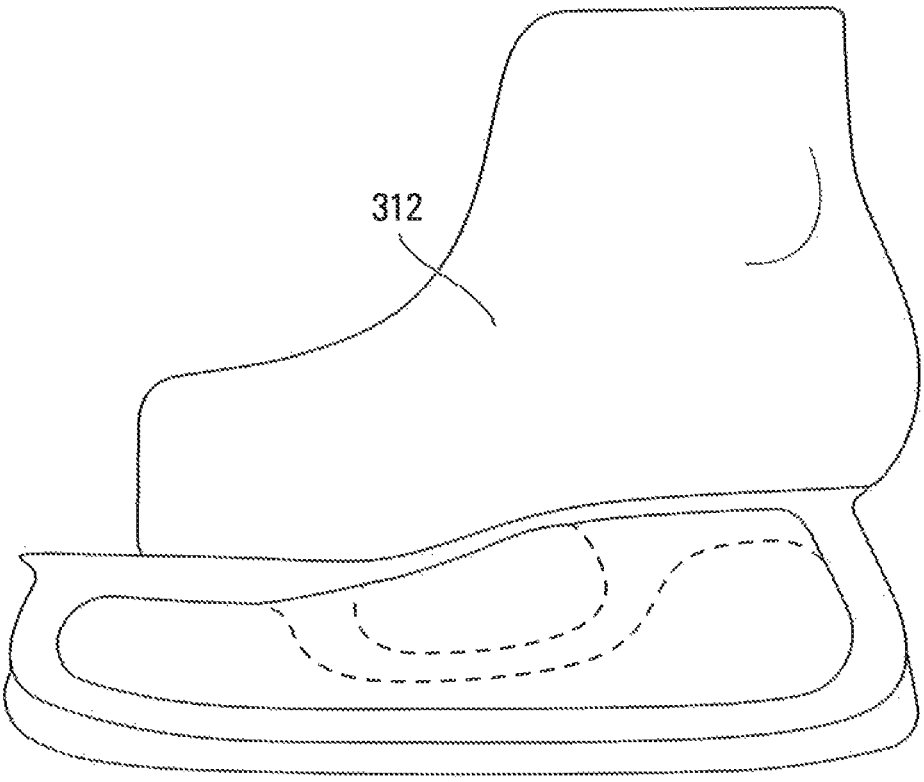
FIG. 33 is a side view of a variant in which the ice skate blade holder and an outer shell of the skate boot are integrally formed in accordance with another embodiment of the invention.
Figure 34:
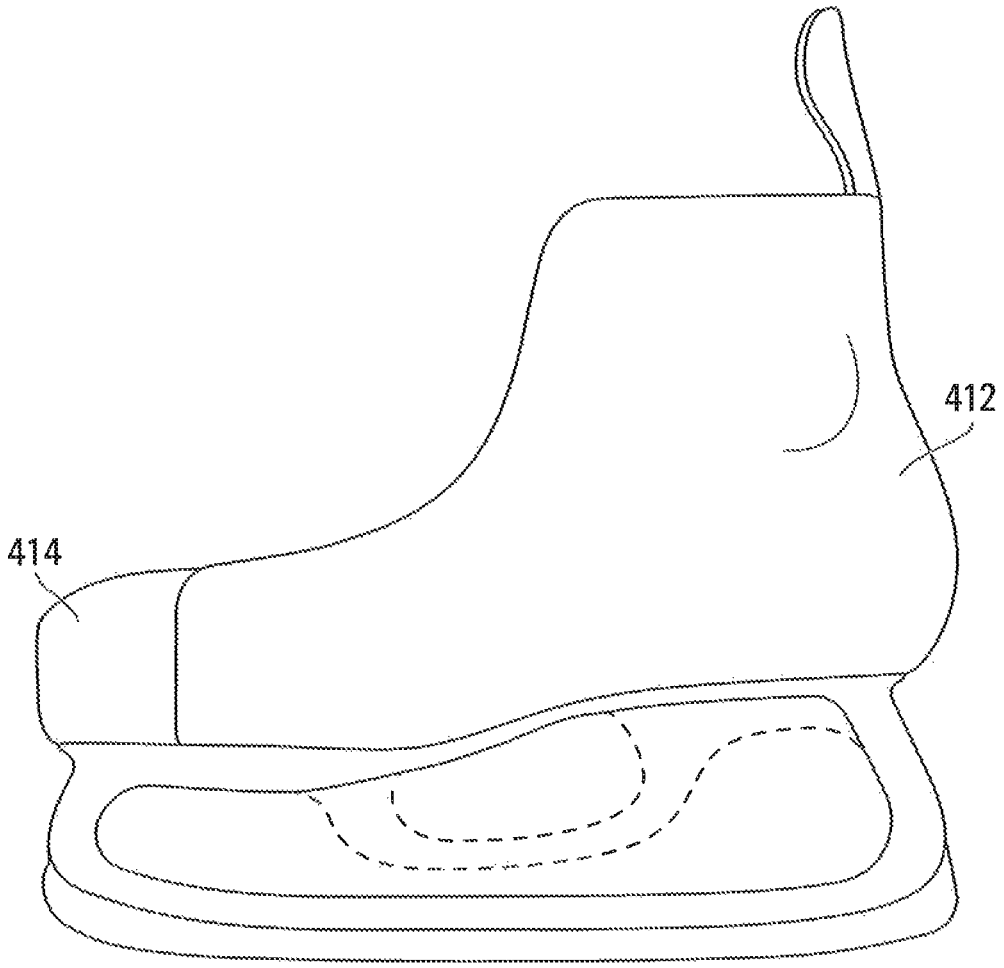
FIG. 34 is a side view of a variant in which the ice skate blade holder, the toe cap of the skate boot and the outer shell of the skate boot are integrally formed in accordance with another embodiment of the invention.

As another example, in some embodiments, as shown in FIG. 33, instead of the outer shell 12 of the skate boot 11 having been manufactured separately from the blade holder 28, an outer shell 312 of the skate boot 11 may be integrally molded with the blade holder 28 such that the blade holder 28 and the outer shell 312 constitute a one-piece molded component. As yet another example, in some embodiments, as shown in FIG. 34, an outer shell 412 and a toe cap 414 of the skate boot 11 may be integrally molded with the blade holder 28 such that the blade holder 28, the outer shell 412 and the toe cap 414 constitute a one-piece molded component.

Referring to FIGS. 37 to 41, a blade holder in accordance with a further embodiment is identified at numeral 500. The blade holder 500 comprises a U-shaped inner member 502 and a U-shaped outer member 504 spaced from the U-shaped inner member 502 to define a void or hollow space 506 between the U-shaped inner member 502 and the U-shaped outer member 504.

Figure 38:
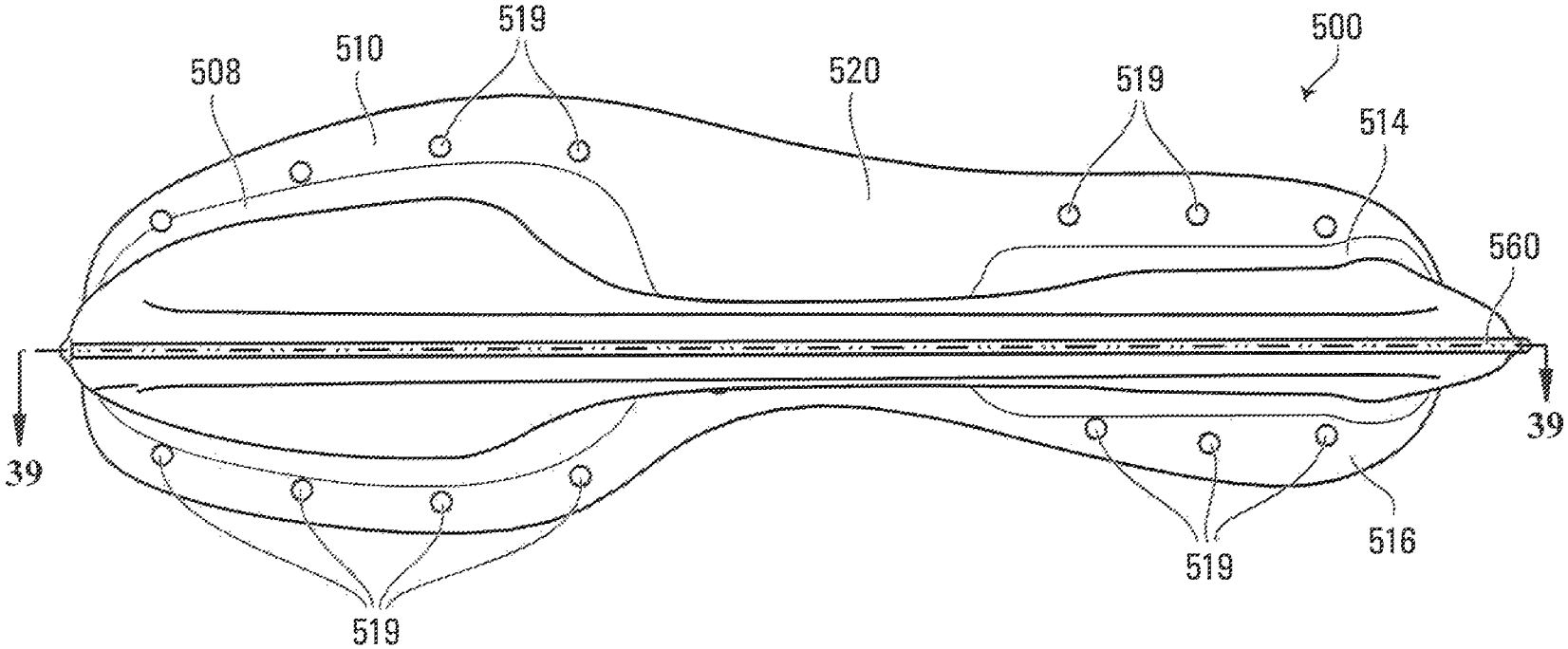
FIG. 38 is a bottom view of the ice skate blade holder of FIG. 37.

The blade holder 500 also comprises a front member 508 defining a front peripheral wall 510 with an upper surface 512 for facing a bottom portion of the front portion 17 of the skate boot 11 and a rear member 514 defining a rear peripheral wall 516 with an upper surface 518 for facing a bottom portion of the rear portion 19 of the skate boot 11. As best seen in FIG. 38, each of the front and rear peripheral walls 510, 516 of the front and rear members 508, 514 comprises apertures 519 for affixing the blade holder 500 to the bottom portion of the front and rear portions 17, 19 of the skate boot 11. As it is well known in the art, rivets may pass in the apertures 519 for affixing the blade holder 500 to the skate boot 11.

The blade holder 500 also comprises an intermediate member 520 extending between the front and rear members 508, 514, the intermediate member 520 having an upper surface 522 for facing a bottom portion of the skate boot 11 between the front and rear portions 17, 19. The front and rear peripheral walls 510, 516 of the front and rear members 508, 514 and the intermediate member 520 define a pedestal for facing the bottom portion of the skate boot 11. Instead of being integrally formed with the front and rear members 508, 514 of the blade holder 500, in another embodiment, the intermediate member may be a separate component that is affixed to the bottom portion of the skate boot.

The U-shaped inner member 502 comprises an elongated portion 524, a front portion 526 extending upwardly from the elongated portion 524 and having an upper end 528 integrally formed with the front member 508 and a rear portion 530 extending upwardly from the elongated portion 524 and having an upper end 532 integrally formed with the rear member 514.

The U-shaped outer member 504 comprises an elongated blade-supporting base 534, a front pillar 536 and a rear pillar 538. The front and rear pillars 536, 538 are spaced apart in the longitudinal direction of the blade holder 500. The front pillar 536 extends from the elongated blade-supporting base 534 towards the front portion 17 of the skate boot 11 (towards the front portion of the front member 508) and the rear pillar 538 extends from the elongated blade-supporting base 534 towards the rear portion 19 of the skate boot 11 (towards the rear portion of the rear member 514). The front pillar 536 has an upper end 540 integrally formed with the front member 508 and the rear pillar 538 has an upper end 542 integrally formed with the rear member 514. The elongated blade-supporting base 534 extends from the front pillar 536 to the rear pillar 538.

The elongated portion 524 of the U-shaped inner member 502 overlaps a portion of the elongated blade-supporting base 534 and is spaced apart from the elongated blade-supporting base 534. In another embodiment, the elongated portion of the U-shaped inner member may rather contact the elongated blade-supporting base 534.

The hollow space 506 of the blade holder 500 may be configured in various ways. For example, the hollow space 506 may be defined by a front hollow region 540, an intermediate hollow region 542 and a rear hollow region 544, which together extend between the U-shaped inner member 502 and the U-shaped outer member 504 and define the U-shaped hollow region or space 506. That is, each of the front hollow region 540 and the rear hollow region 544 of the hollow space 506 has a greater height than the intermediate hollow region 542 of the hollow space 506.

In this embodiment, the front hollow region 540 of the hollow space 506 occupies most of a length and a height of the front portion of the blade holder 500, which generally extends beneath and along the skater's forefoot in use. Similarly, the rear hollow region 544 of the hollow space 506 occupies most of a length and a height of the rear portion of the blade holder 500, which extends beneath and along the skater's hindfoot in use. The hollow space 506 may have any other suitable configuration in other embodiments.

The blade holder 500 may also comprise a resilient element 546 disposed between the elongated portion 524 of the U-shaped inner member 502 and the elongated blade-supporting base 534 of the U-shaped outer member 504. The resilient element 546 is configured to deform (i.e., configured to change in shape under load and subsequently recover its original shape) when the U-shaped inner member 502 and the U-shaped outer member 504 move relative to each other while the skater skates.

The resilient element 546 may be a damper to dampen vibrations in the blade holder 500 while the skater skates. Notably, in this example, the resilient element 546 dampens vibrations due to the elastic flexion of the elongated blade-supporting base 534 of the U-shaped outer member 504 while the skater skates. This absorption of vibrations may also help to reduce noise generated by the blade holder 500 while the skater skates.

In addition to its vibration absorption capability, because the resilient element 546 is disposed between the elongated portion 524 of the U-shaped inner member 502 and the elongated blade-supporting base 534, it may also be used to adjust a degree of movement permitted between the U-shaped inner and outer members 502, 504, in the widthwise direction and/or the height direction of the blade holder 500.

The resilient element 546 may comprise a cushion (i.e., an elastic body) for reducing vibrations. The resilient element 546 may be made of an elastic material (i.e., a material capable of recovering size and shape after deformation) different from the fiber-matrix composite material of the blade holder 500. The elastic material of the resilient element 546 may be relatively soft. For instance, the elastic material of the resilient element 546 may have a hardness of no more than 95 durometers Shore A.

The hardness of the elastic material of the resilient element 546 may have any other suitable value in other embodiments. The resilient element 546 may be made of polyurethane. Any other suitable elastic material may be used in other examples of implementation (e.g., rubber, thermoplastic elastomer, foam, etc.)

The resilient element 546 may be associated with a brand of the blade holder 546 and/or the ice skate 10. In other embodiments, the resilient element 546 may be shaped as a logo or any other graphical element associated with a team of the skater or a brand of the blade holder 500 and/or the ice skate 10, or as any other desired graphical element.

Figure 39:
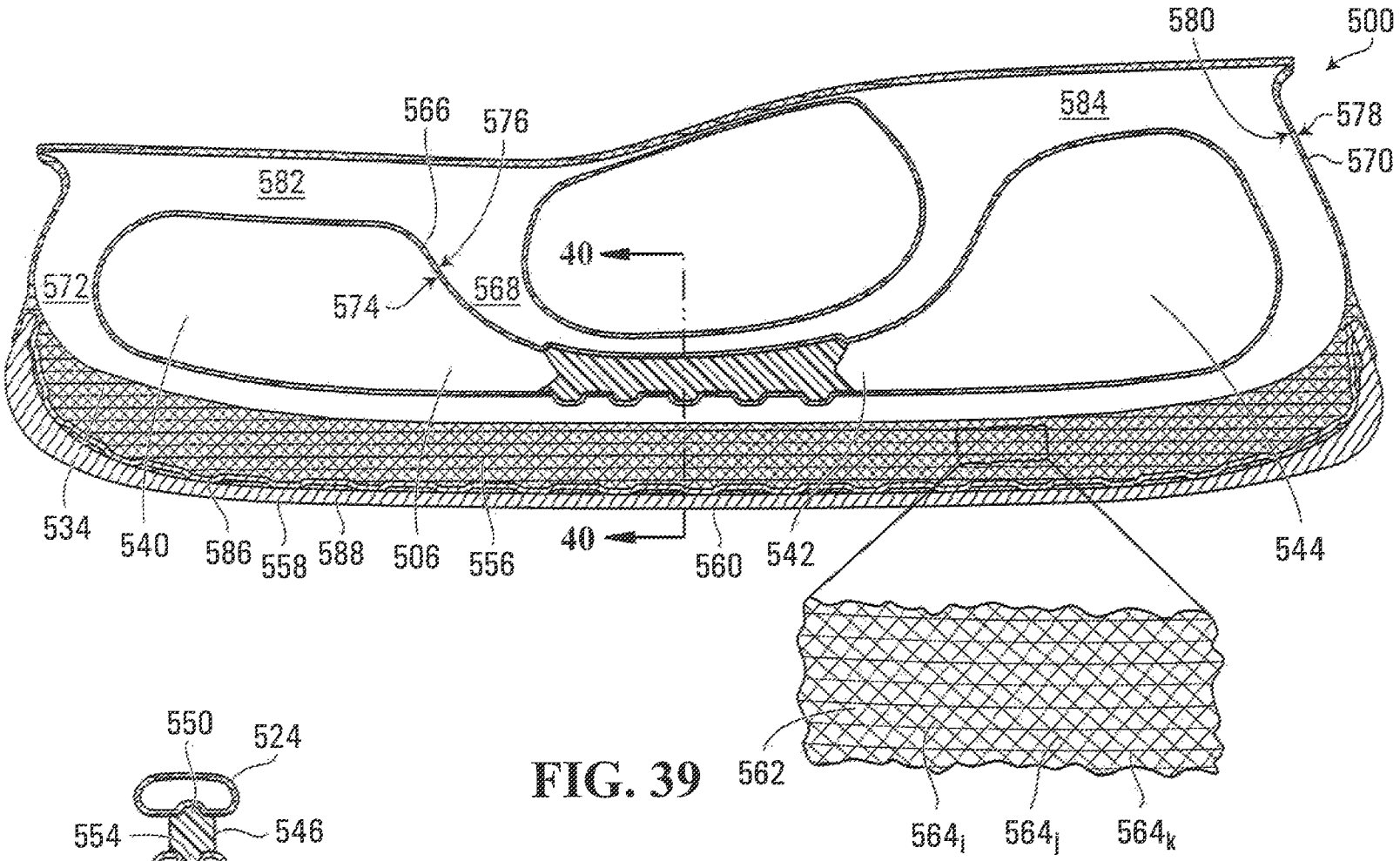
FIG. 39 is a cross-sectional view taken along line 39-39 of FIG. 38.
Figure 40:
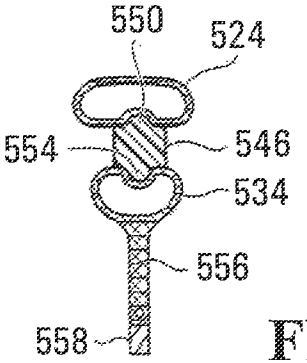
FIG. 40 is a cross-sectional view taken along line 40-40 of FIG. 39.
Figure 41:
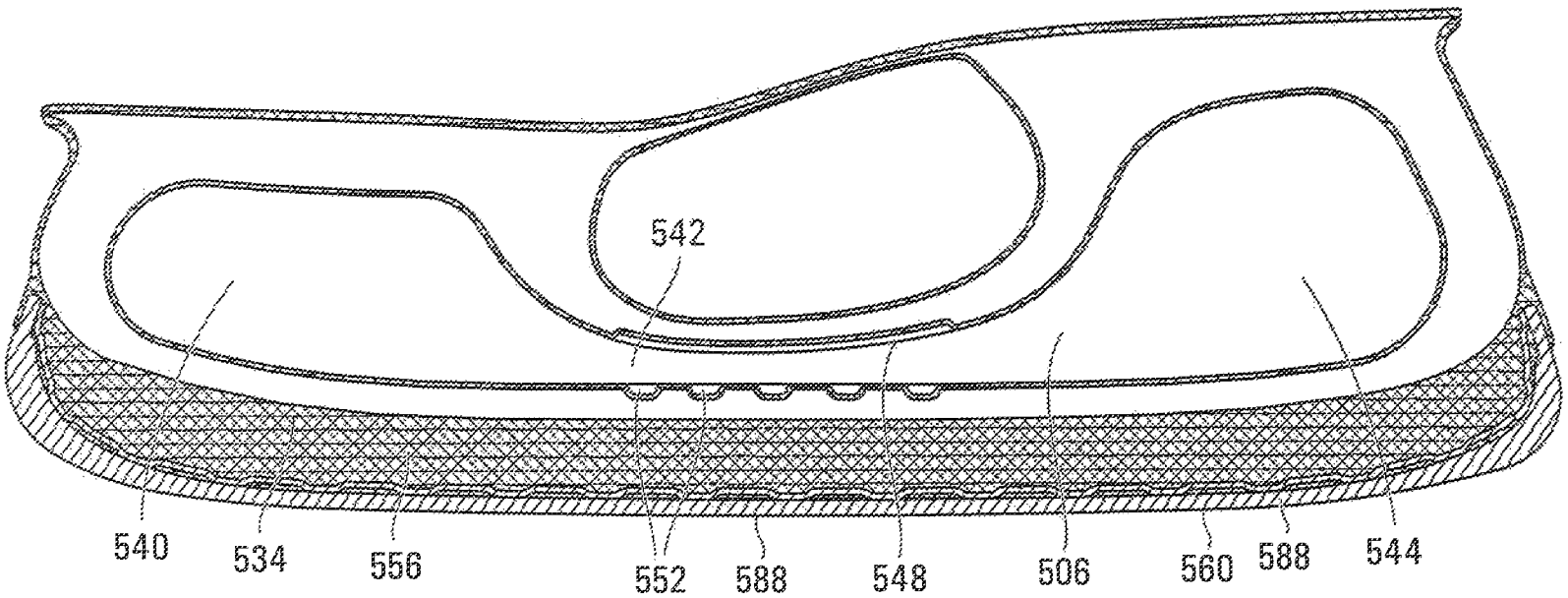
FIG. 41 is a cross-sectional view identical to FIG. 40 without the resilient element.
Figure 42:
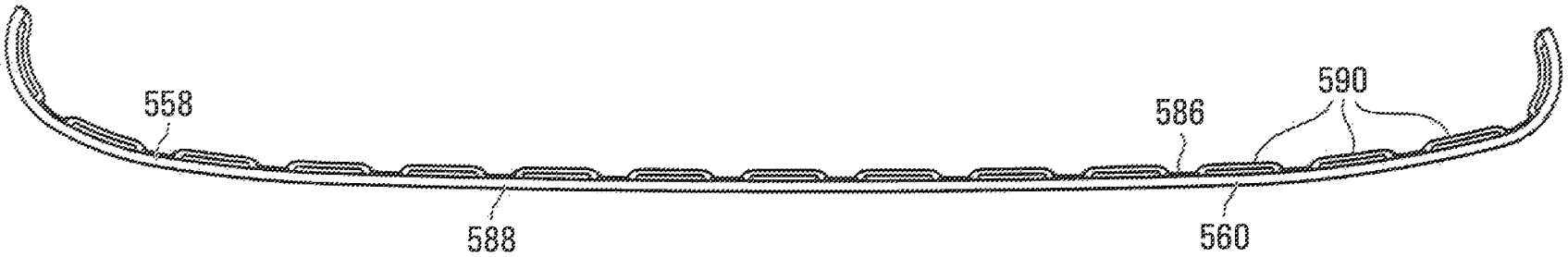
FIG. 42 is a side view of the runner of the ice skate blade holder of FIG. 37.

The resilient element 546 can be secured between the elongated portion 524 of the U-shaped inner member 502 and the elongated blade-supporting base 534 in any suitable way. For example, the resilient element 546 may be permanently secured to the elongated portion 524 of the U-shaped inner member 502 and the elongated blade-supporting base 534. In other embodiments, the resilient element 546 may be attachable to and detachable from the blade holder 500. More particularly, as best seen in FIGS. 39 to 41, the elongated portion 524 of the U-shaped inner member 502 may comprise a recess or groove 548 for receiving a projection 550 provided on the upper portion of the resilient element 546 and the elongated blade-supporting base 534 may comprise a plurality of indentations or depressions 552 for receiving pegs or projections 554 provided on the bottom portion of the resilient element 546. This may allow a customization of the blade holder 500 by allowing the skater to use or not use the resilient element 546 and/or use a selected one of a plurality of different resilient elements like the resilient element 546 which have different properties.

The elongated blade-supporting base 534 also comprises a bottom blade portion 556 extending downwardly therefrom and the blade holder 500 also comprises an ice skate blade 558 having a top portion mounted or affixed to the bottom blade portion 556 and a bottom portion defining an ice-contacting surface 560. The ice skate blade 558 may be made of a strip that is at least partially made of metal (e.g. stainless steel, carbon steel, tungsten carbide or titanium), of a strip of engineering plastic or a strip that is at least partially made of ceramic material (e.g. aluminum titanate, aluminum zirconate, sialon, silicon nitride, silicon carbide, zirconia and partially stabilized zirconia or a combination of two or more of these materials).

At least part of the elongated blade-supporting base 534, front pillar 536, rear pillar 538, U-shaped inner member 502, front member 508, rear member 514 and intermediate member 520 is made of a composite material. For example, the composite material may be a fiber-matrix composite material that comprises a matrix 562 in which fibers $\mathbf{564}_1$-$\mathbf{564}_F$ are embedded.

The matrix 562 may include any suitable substance. In this embodiment, the matrix 562 is a polymeric matrix. For example, the polymeric matrix 562 may include any other suitable polymeric resin, such as a thermosetting polymeric material (e.g., polyester, vinyl ester, vinyl ether, polyurethane, epoxy, cyanate ester, phenolic resin, etc.), a thermoplastic polymeric material (e.g., polyethylene, polypropylene, acrylic resin, polyether ether ketone (PEEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyamide-imide, self-reinforcing polyphenylene, etc.), or a hybrid thermosetting-thermoplastic polymeric material.

The fibers $\mathbf{564}_1$-$\mathbf{564}_F$ may be made of any suitable material. In this embodiment, the fibers $\mathbf{564}_1$-$\mathbf{564}_F$ are carbon fibers. The composite material is thus a carbon-fiber-reinforced plastic in this example of implementation. Any other suitable type of fibers may be used in other embodiments (e.g., polymeric fibers such as graphite fibers, carbon graphite fibers, aramid fibers (e.g., Kevlar fibers), boron fibers, silicon carbide fibers, ceramic fibers, metallic fibers, glass fibers, polypropylene fibers, etc.).

In one embodiment, respective ones of the fibers $564_1$-$564_F$ that are located in the elongated blade-supporting base 534 (and its bottom blade portion 556) are oriented to be in tension when the elongated blade-supporting base 534 and the ice skate blade 558 are deflected by the deflection in the widthwise direction of the blade holder 500 due to the elastic flexion of the elongated blade-supporting base 534 (including its bottom blade portion 556) and the ice skate blade 558 in the widthwise direction of the blade holder 500. This fiber tension tends to force the elongated blade-supporting base 534 (including its bottom blade portion 556) and the ice skate blade 558 back into their normal (non-deflected) shape, thereby enhancing the kickback in the widthwise direction of the blade holder 500. The blade holder 500 may thus be responsive to the skating movement of the skater to undergo an elastic torsion of each of the front pillar and the rear pillar 536, 538 which induces an elastic flexion of the elongated blade-supporting base 534 (and its bottom blade portion 556) and the ice skate blade 558 in the widthwise direction of the blade holder 500.

For example, at least a majority of the fibers $564_1$-$564_F$ that are located in the elongated blade-supporting base 534 (and its bottom blade portion 556) may extend parallel or at an oblique angle to the longitudinal axis of the elongated blade-supporting base 534 (and its bottom blade portion 556) or a totality of the fibers $564_1$-$564_F$ that are located in the elongated blade-supporting base 534 (and its bottom blade portion 556) may extend parallel or at an oblique angle to the longitudinal axis of the elongated blade-supporting base 534 (and its bottom blade portion 556).

The fibers $564_1$-$564_F$ may be arranged in any other suitable manner in other embodiments.

The U-shaped inner member 502 may comprise fiber-matrix composite material that offers less resilience than the fiber-matrix composite material of the U-shaped outer member 504. For example, the fiber-matrix composite material of the U-shaped inner member 502 may comprise glass fibers or polypropylene fibers and the fiber-matrix composite material of the U-shaped outer member 504 may comprise carbon fibers, graphite fibers or carbon graphite fibers.

Each of the U-shaped inner and outer members 502, 504 may be hollow. That is, the U-shaped inner member 502 comprises an external wall 566 defining a cavity 568 and the outer member 504 comprises an external wall 570 defining a cavity 572. The U-shaped inner member 502 may be a tubular member having an external surface 574 and an internal surface 576. The external wall 566 extends from the external surface 574 to the internal surface 576, while the cavity 568 is delimited by the internal surface 576. The elongated blade-supporting base 534 and front and rear pillars 536, 538 of the U-shaped outer member 504 may be a tubular member having an external surface 578 and an internal surface 580. The external wall 570 extends from the external surface 578 to the internal surface 580, while the cavity 578 is delimited by the internal surface 580. In this case, the cavities 568, 572 of the U-shaped inner and outer members 502, 504 opens into cavities 582, 584 of the front and rear members 508, 514 of the blade holder 500. It is understood that the external walls 566, 570 may be part of the external walls of the blade holder 500 and that the cavities 568, 572, 582, 584 may define a single empty cavity of the blade holder 500.

The U-shaped inner and outer members 502, 504 may have any suitable cross-sectional shape. For example, as best seen in FIG. 40, the U-shaped inner member 502 may have a cross-sectional shape that is oblong in the widthwise direction of the blade holder 500. The U-shaped outer member 504 may have a cross-sectional shape that is generally trapezoidal, tapering downwardly, and shorter than the cross-sectional shape of the U-shaped inner member 502 in the widthwise direction of the blade holder 500. Also, the cross-sectional shape of each of the U-shaped inner and outer members 502, 504 may be substantially uniform over the length of the tubular part of the member.

The blade holder 500 can be manufactured in any suitable manner using various processes. For example, a plurality of layers of fibers, which are destined to provide the fibers $564_1$-$564_F$ of the blade holder 500, are layered onto one another on a support which is then placed in a mold to consolidate the composite material of the blade holder 500. In this example, each of these layers of fibers is provided as a pre-preg (i.e., pre-impregnated) layer of fibers held together by an amount of matrix material, which is destined to provide a respective portion of the matrix 562 of the blade holder 500. The support may comprise one or more inflatable bladders (e.g., air bladders) on which the pre-preg layers are layered such that the one or more inflatable bladders can be inflated to define the external walls 566, 570 and the cavities 568, 572 of each of the U-shaped inner and outer members 502, 504 during molding in the mold. The support may also comprise one or more other components (e.g., silicone mold parts or foam parts) on which the pre-preg layers may be layered to form other parts of the blade holder 500 (e.g., the front and rear members 508, 514) during molding in the mold. Various other manufacturing methods may be used to make the blade holder 500 in other embodiments.

Figure 43:
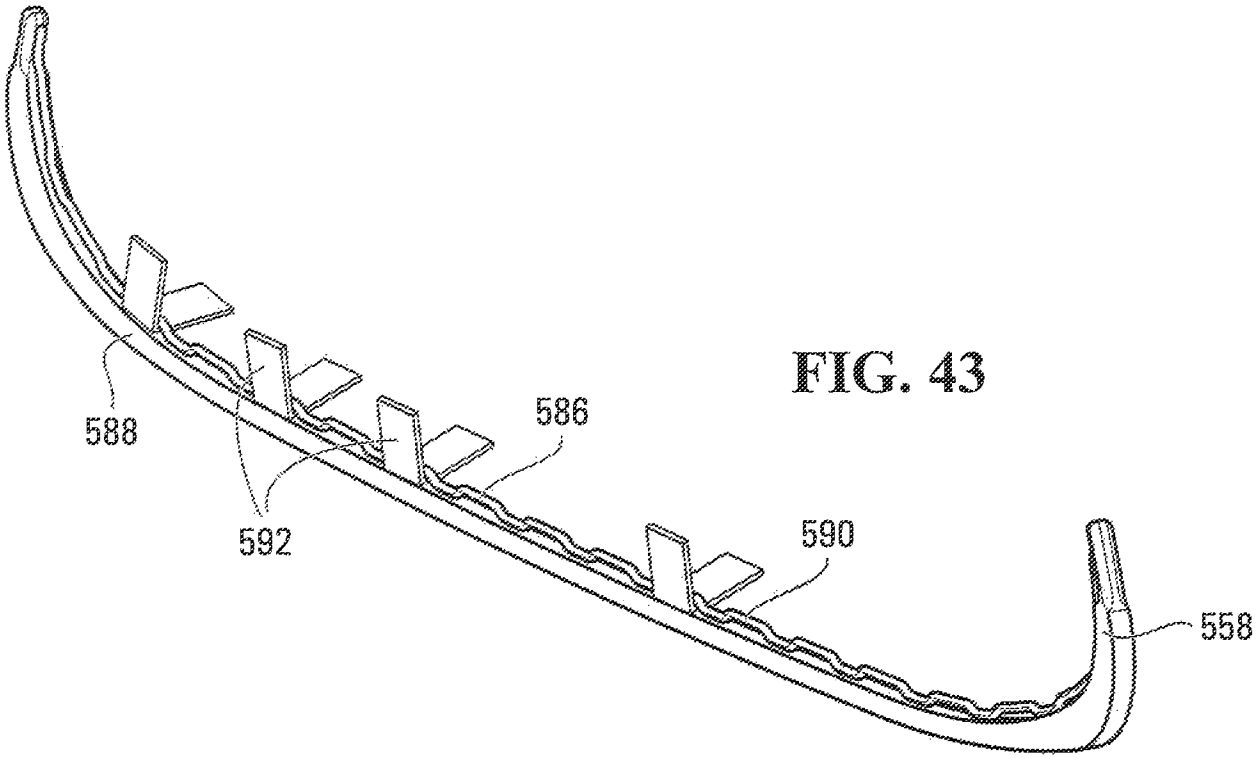
FIG. 43 shows the runner of FIG. 42 with layers of fibers used for the composite material.
Figure 44:
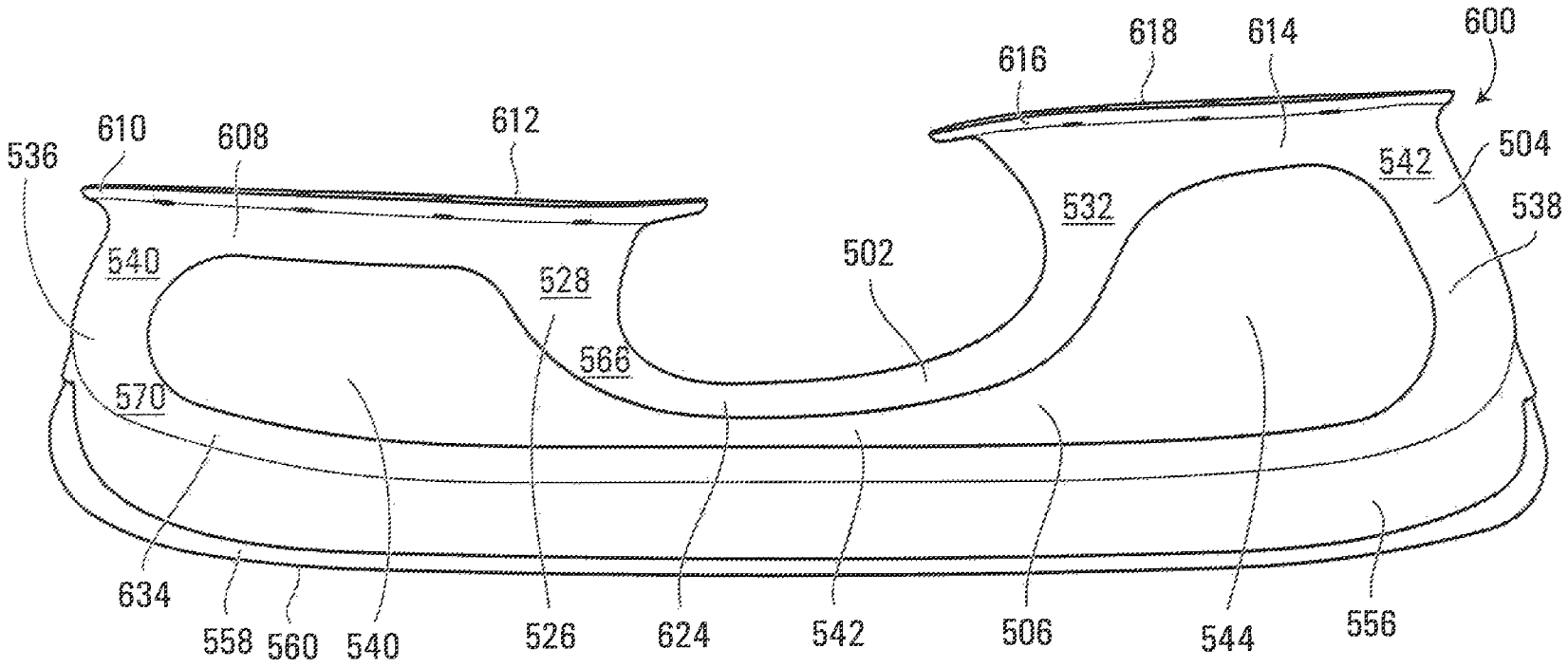
FIG. 44 is a side view of an ice skate blade holder in accordance with another embodiment of the invention.
Figure 45:
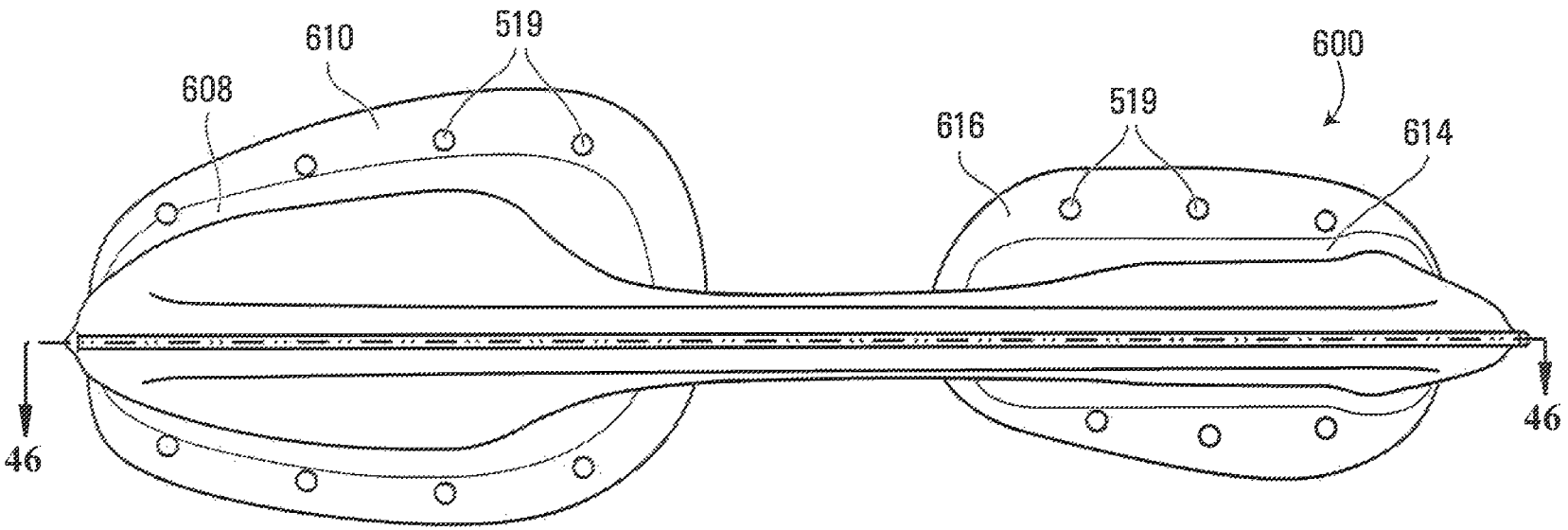
FIG. 45 is a bottom view of the ice skate blade holder of FIG. 44.
Figure 46:
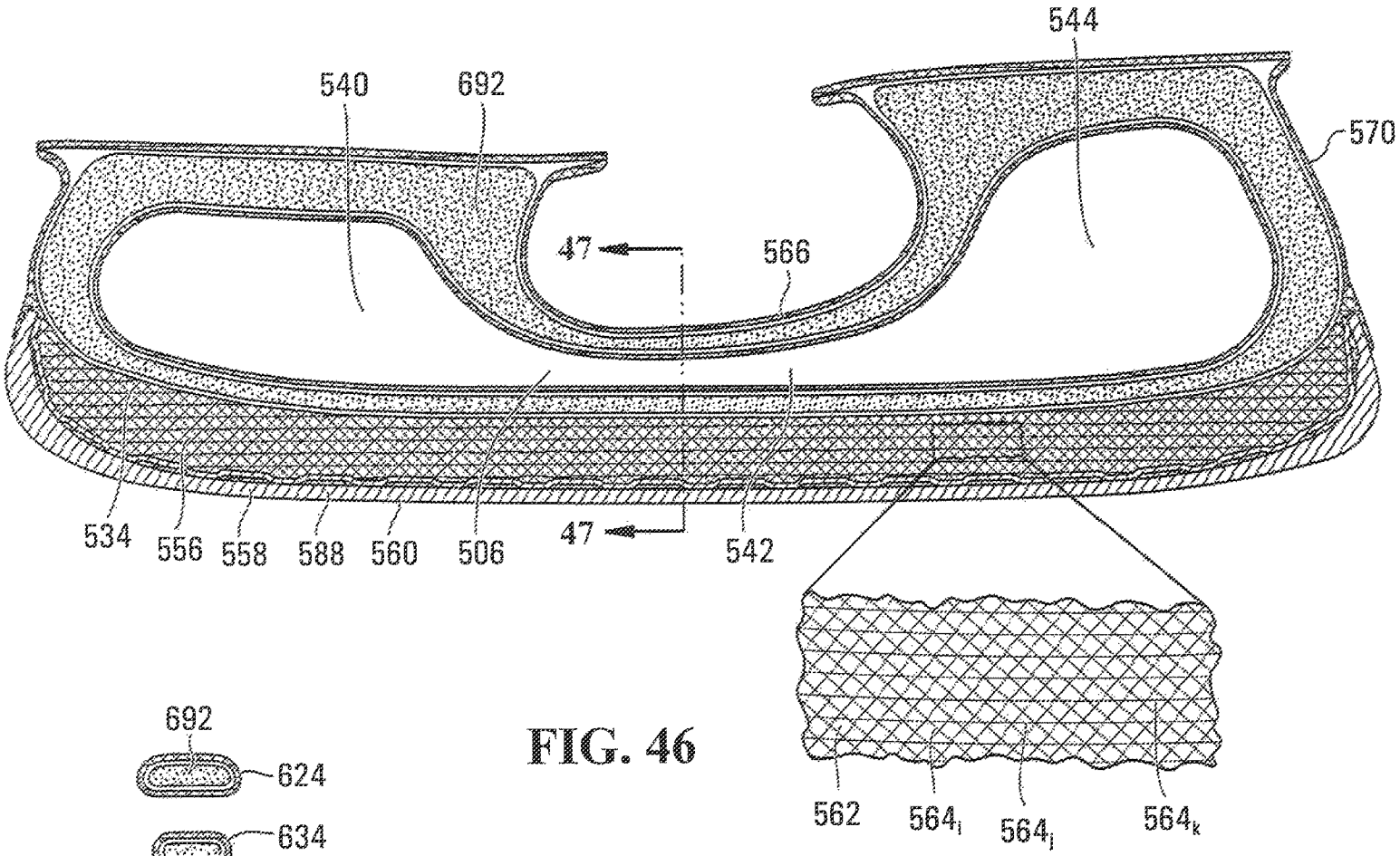
FIG. 46 is a cross-sectional view taken along line 46-46 of FIG. 45.

Referring to FIGS. 39 to 43, the ice skate blade 558 has a top portion 586 and a bottom portion 588 defining the ice-contacting surface 560. The top portion 586 of the ice skate blade 558 comprises a plurality of anchoring members 590 (e.g. hooks, projections, channels or interlocking openings) such that the top portion 586 of the ice skate blade 558 is within the fiber-matrix composite material of the elongated blade-supporting base 534 for retaining the ice skate blade 558 to the blade holder 500. As shown in FIG. 43, the fiber-matrix composite material of the elongated blade-supporting base 534 (including its bottom blade portion 556) may be made of layers of fibers 592 and at least one layer of fibers is located within the anchoring elements 590 such that the anchoring elements 590 are embedded in the fiber-matrix composite material of the elongated blade-supporting base 534 (including its bottom blade portion 556).

In other embodiments, the bottom blade portion of the elongated blade-supporting base may define a recess and the top portion of the ice skate blade may comprise a projection affixed into the recess of the bottom blade portion of the elongated blade-supporting base. In a further embodiment, the bottom blade portion of the elongated blade-supporting base may define a projection and the top portion of the ice skate blade may comprise a recess in which the projection of the bottom blade portion of the elongated blade-supporting base is affixed.

A blade holder in accordance with a further embodiment is shown in FIGS. 44 to 47 in which the same reference numbers are used for the same features as those for the blade holder 500. The blade holder 600 has blade holder and ice skate blade constructions similar to the blade holder 500 but the blade holder 600 does not comprise the intermediate member 520 and the resilient element 546. The blade holder 600 rather comprises a front member 608 defining a front peripheral wall 610 with an upper surface 612 for facing a bottom portion of the front portion 17 of the skate boot 11 and a rear member 614 defining a rear peripheral wall 616 with an upper surface 618 for facing a bottom portion of the rear portion 19 of the skate boot 11, the front peripheral wall 610 being separate from the rear peripheral wall 616 and defining separate front and rear pedestals for being mounted to the front and rear portions 17, 19 of the skate.

Figure 47:
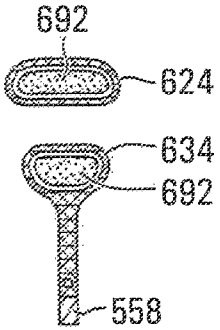
FIG. 47 is a cross-sectional view taken along line 47-47 of FIG. 46.

As best seen in FIG. 47, the blade holder 600 has an elongated portion 624 and an elongated blade-supporting base 634 that do not comprise recesses, grooves, indentations or depressions. In another embodiment, it is understood that the blade holder may comprise a resilient element that may be permanently secured to the elongated portion and the elongated blade-supporting base.

The blade holder 600 also comprises an internal material 692. More particularly, the internal material 692 includes a filler that fills at least part of the cavities 568, 572, 582, 584. The filler may be made of foam. This may help to improve impact resistance and/or absorb vibrations while the skater skates. For instance, the foam may be polystyrene (PS) foam, polyurethane (PU) foam, ethylene vinyl acetate (EVA) foam, polyvinyl chloride (PVC) foam, polypropylene (PP) foam, polyethylene (PE) foam, vinyl nitrile (VN) foam, ethylene polypropylene foam, polyisocyanurate foam or any other suitable foam. In some examples of implementation, the foam may have been pre-molded to form an internal frame of the blade holder 600 over which the composite material may subsequently be molded.

As for the blade holder 500, the blade holder 600 can be manufactured in any suitable manner using various processes. For example, a plurality of layers of fibers, which are destined to provide the fibers $\mathbf{564}_1$-$\mathbf{564}_F$ of the blade holder 600, are layered onto one another on a support which is then placed in a mold to consolidate the composite material of the blade holder 600. In this example, each of these layers of fibers is provided as a pre-preg (i.e., pre-impregnated) layer of fibers held together by an amount of matrix material, which is destined to provide a respective portion of the matrix 662 of the blade holder 600. The support may comprise a single support of foam or a plurality of support members of foam on which the pre-preg layers are layered. It is understood that one of the cavities may comprise a first foam member and another of the cavities may comprise a second foam member, the second foam member having properties (density) different from the first foam member. For example, the first foam member may be high-density foam and the second foam member may be low-density foam. It is also understood that one of the cavities may comprise a first foam member and another of the cavities may comprise a second foam member, the second foam member being different from the first foam member.

For example, the first foam member may be ethylene vinyl acetate foam and the second foam member may be polyurethane foam. It is further understood that one of the cavities may not comprise any internal material. For, example, the cavities 582, 584 of the front and rear members 508, 514 may not comprise any internal material. In another embodiment, the cavity 568 of the U-shaped inner member 502 may comprise a foam material that has less resilience or rigidity that the foam material occupying the cavity 572 of the U-shaped outer member 504. It is further understood that the internal material may entirely occupy the cavities 568, 572, 582, 584 such that the internal surfaces of the U-shaped inner and outer members 502, 504 are entirely covered by the internal material or may partially occupy the cavities 568, 572, 582, 584 such that there are voids or hollow areas between the internal material and the internal surfaces of the U-shaped inner and outer members 502, 504. In a further embodiment, voids or hollows areas may be present in the internal material.

As indicated previously, the blade holder may be responsive to the skating movement of the skater to undergo an elastic torsion of each of the front pillar and the rear pillar which induces an elastic flexion of the elongated blade-supporting base, its bottom blade portion and the ice skate blade in the widthwise direction of the blade holder.

Reproduced below, is a chart representing lateral displacement in the middle of the ice skate blade of different holders (size 8) depending on the force applied in the middle of the blade/runner (pressure contact area on the blade/runner being 300 $mm^2$):

| Player's weight (Lbs) | Lateral force (Lbs) (75% of weight) | Lateral force (N) | Displacement (mm) Holder #1 | Displacement (mm) Holder #2 | Displacement (mm) Holder #3 | Displacement (mm) Holder #4 | Displacement (mm) Holder #5 |
|---|---|---|---|---|---|---|---|
| 240 | 180 | 801 | 2.93 | 4.86 | 6.16 | 5.51 | 7.72 |
| 200 | 150 | 667 | 2.55 | 4.11 | 5.25 | 4.73 | 6.61 |
| 175 | 131 | 584 | 2.30 | 3.68 | 4.63 | 4.13 | 5.75 |
| 150 | 113 | 500 | 2.04 | 3.25 | 4.05 | 3.61 | 5.00 |

As indicated previously, the blade holder in accordance with the above embodiments is lightweight and may provide other performance benefits to the skater (e.g., may facilitate and/or allow faster turns). In this regard, the weight, volume and density of a prior BAUER LIGHTSPEED EDGE blade holder commercialized in 2013, with an ice skate blade LS3, was about 300.5 grams, 165 $cm^3$ and 1.82 $g/cm^3$ for a size 8. With the blade holder and ice skate blade according to the invention, the weight is significantly reduced. For example, for a size 8, the weight, volume and density of the blade holder 500 are about 160.4 grams, 149.2 $cm^3$ and 1.08 $g/cm^3$ for a weight reduction of almost 50%. In different samples/prototypes of the blade holders 500, 600, the density is about 1.05 $g/cm^3$ to about 1.10 $g/cm^3$ for a size 8.

Figure 48:
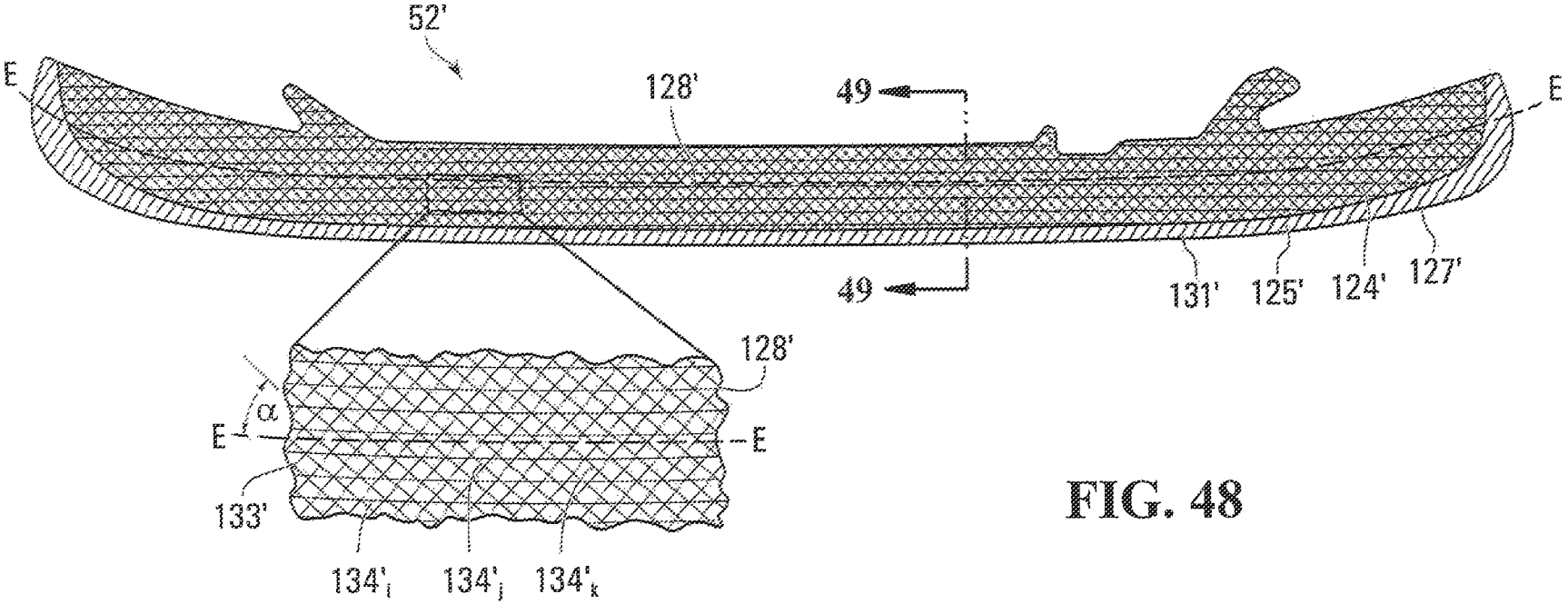
FIG. 48 is a cross-sectional view of a variant of the ice skate blade in accordance with another embodiment of the invention.
Figure 49A:
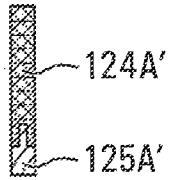
FIG. 49A shows a cross-sectional view of another embodiment.
Figure 49:
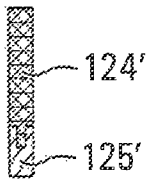
FIG. 49 is a cross-sectional view taken along line 49-49 of FIG. 48.

FIGS. 48 and 49 show an ice skate blade 52' that comprises a blade body 124' and a runner or strip 125' that are made of different materials. The blade body 124' extends above the runner 125' and is mounted to the blade holder 28. The runner 125' includes the ice-contacting surface 127' that slides on the ice while the skater skates. The blade body 124' is at least mainly made of a first material 128', which will be referred to as a "blade body material", and the runner 125', including its ice-contacting surface 127', is at least mainly made of an ice-contacting material 131' which is different from the blade body material 128'. For example, the ice-contacting material 131' is harder than the blade body material 128'. More particularly, the ice-contacting material 131' is a metallic material (e.g., stainless steel) and the blade body material 128' is a composite material.

The blade body material 128' is a fiber-matrix composite material that comprises a matrix 133' in which fibers $\mathbf{134'}_1$-$\mathbf{134'}_B$ are embedded.

The matrix 133 may include any suitable substance. In this embodiment, the matrix 133 is a polymeric matrix. For example, the polymeric matrix 133 may include any other suitable polymeric resin, such as a thermosetting polymeric material (e.g., polyester, vinyl ester, vinyl ether, polyurethane, epoxy, cyanate ester, phenolic resin, etc.), a thermoplastic polymeric material (e.g., polyethylene, polypropylene, acrylic resin, polyether ether ketone (PEEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyamide-imide, self-reinforcing polyphenylene, etc.), or a hybrid thermosetting-thermoplastic polymeric material.

The fibers $\mathbf{134}_1$-$\mathbf{134}_F$ may be made of any suitable material. In this embodiment, the fibers $\mathbf{134}_1$-$\mathbf{134}_F$ are carbon fibers. The blade body material 128 is thus a carbon-fiber-reinforced plastic in this example of implementation. Any other suitable type of fibers may be used in other embodiments (e.g., polymeric fibers such as graphite fibers, carbon graphite fibers, aramid fibers (e.g., Kevlar fibers), boron fibers, silicon carbide fibers, ceramic fibers, metallic fibers, glass fibers, polypropylene fibers, etc.).

In this embodiment, respective ones of the fibers $\mathbf{134}_1$-$\mathbf{134}_F$ are oriented to be in tension when the ice skate blade 52' is deflected by the deflection in the widthwise direction of the blade holder 28 due to the elastic flexion of the elongated blade-supporting base 157 and the ice skate blade 52' in the widthwise direction of the blade holder 28. This fiber tension tends to force the ice skate blade 52' back into its normal (non-deflected) shape, thereby enhancing the kickback in the widthwise direction of the blade holder 28.

For example, respective ones of the fibers $\mathbf{134}_1$-$\mathbf{134}_F$ extend in a direction having at least a component parallel to a longitudinal axis E-E of the ice skate blade 52'. In other words, respective ones of the fibers $\mathbf{134}_1$-$\mathbf{134}_F$ extend parallel or at an oblique angle to the longitudinal axis E-E of the ice skate blade 52'. For instance, an angle $\alpha$ between a fiber and the longitudinal axis E-E of the ice skate blade 52' may be from 0° (parallel) to 45°.

In one embodiment, at least a majority of the fibers $\mathbf{134}_1$-$\mathbf{134}_F$ extend parallel or at an oblique angle to the longitudinal axis E-E of the ice skate blade 52'. In another embodiment, a totality of the fibers $\mathbf{134}_1$-$\mathbf{134}_F$ extend parallel or at an oblique angle to the longitudinal axis E-E of the ice skate blade 52'.

The fibers $\mathbf{134}_1$-$\mathbf{134}_F$ may be arranged in any other suitable manner in other embodiments.

As seen in FIG. 49, the bottom portion of the blade body 124' may define a projection and the top portion of the runner 125' may comprise a recess in which the projection the bottom blade portion of the elongated blade-supporting base is affixed. In another embodiment shown in FIG. 49A, the bottom portion of the blade body 124A' may define a recess and the top portion of the runner 125A' may comprise a projection affixed into the recess of the bottom blade portion of the elongated blade-supporting base.

Figure 53:
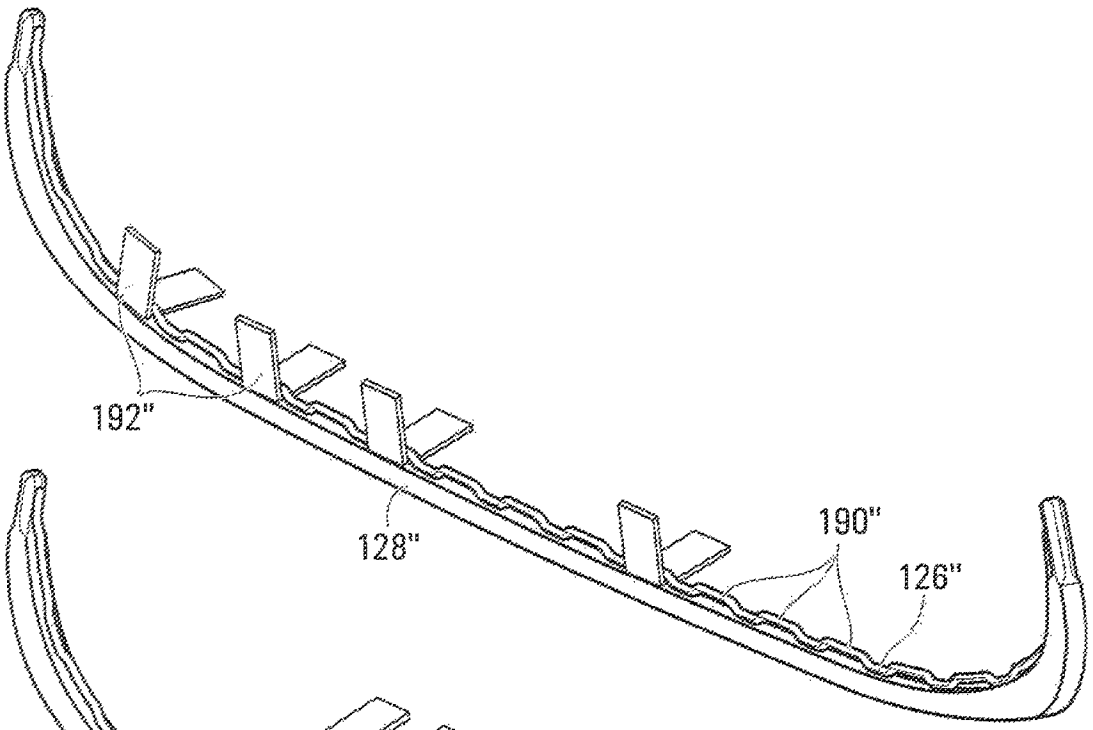
FIG. 53 shows the runner of FIG. 52 with layers of fibers used for the composite material.
Figure 53A:
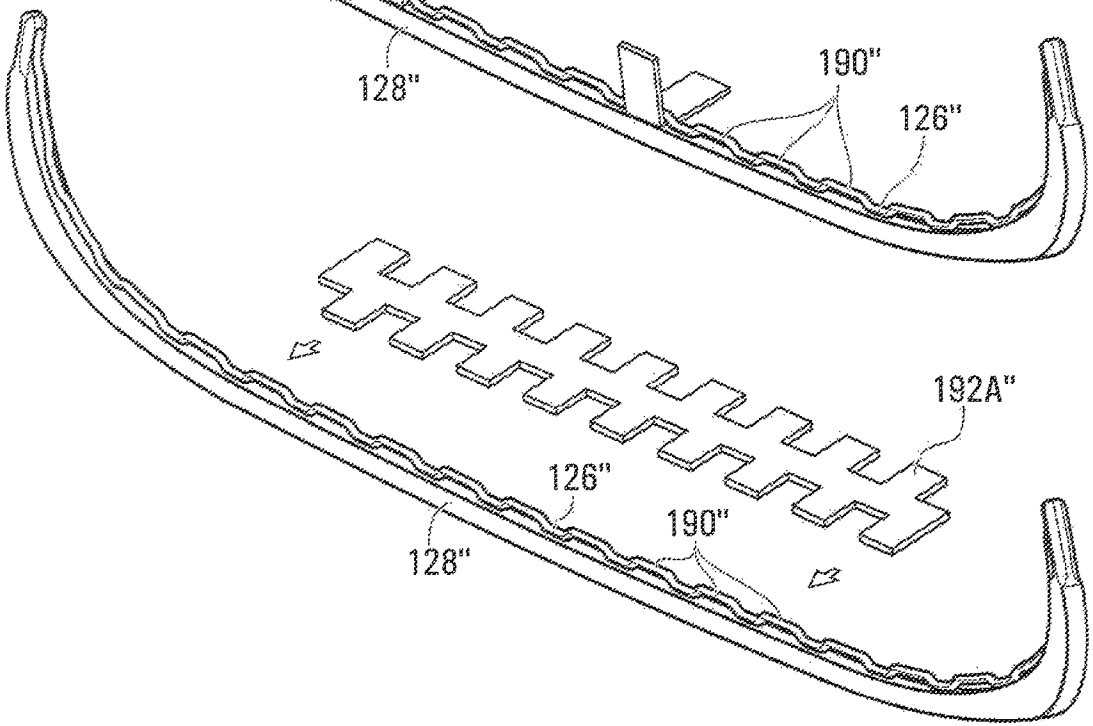
FIG. 53A shows the runner of FIG. 52 with a strip of fibers used for the composite material.

FIGS. 50 to 53 show an ice skate blade 52" that has a blade body 124' with a construction similar to the construction of the blade body 124' but wherein a different runner or strip 125" is used. The runner or strip 125" may be made of stainless steel, carbon steel, tungsten carbide, titanium, engineering plastic, aluminum titanate, aluminum zirconate, sialon, silicon nitride, silicon carbide or zirconia and partially stabilized zirconia. The runner 125" has a top portion 126" and a bottom portion 128" defining an ice-contacting surface 127". The top portion 126" of the runner 125" comprises a plurality of anchoring members 190" (e.g. hooks, projections, channels or interlocking openings) such that the top portion 126" of the runner 125" is within the fiber-matrix composite material 133' of the blade body 124' for retaining the runner 125" to the blade body 124'. As shown in FIG. 53, the fiber-matrix composite material 133' of the blade body 124' may be made of layers 192" of fibers and at least one layer 192" of fibers is located within the anchoring elements 190" such that the anchoring elements 190" are embedded in the fiber-matrix composite material 133' of the blade body 124'. In another embodiment shown in FIG. 53A, the fiber-matrix composite material 133' of the blade body 124' may be made of strips or bands 192A" of fibers.

Figure 54:
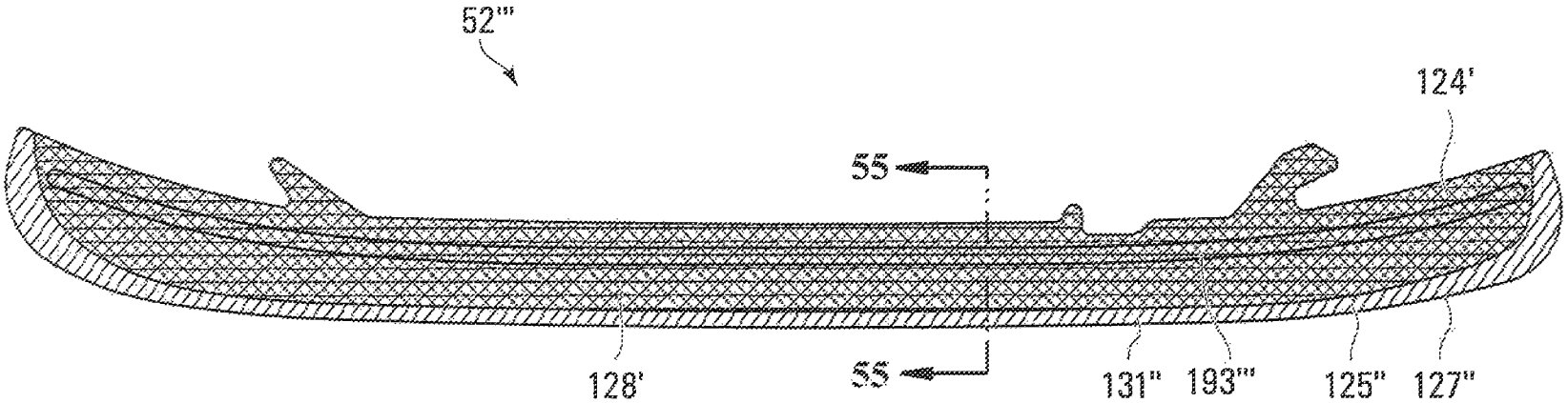
FIG. 54 is a cross-sectional view of an ice skate blade in accordance with another embodiment of the invention.
Figure 55:
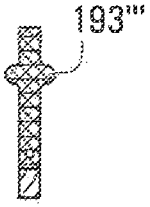
FIG. 55 is a cross-sectional view taken along line 55-55 of FIG. 54.

FIGS. 54 and 55 show an ice skate blade 52'" that has a construction similar to the construction of the ice skate blade 52" but wherein the blade body 124" has a reinforcing member 193'" on each side extending along the longitudinal axis of the ice skate blade 52".

To facilitate the description, any reference numeral designating an element in one figure designates the same element if used in any other figures. In describing the embodiments, specific terminology has been resorted to for the sake of clarity but the invention is not intended to be limited to the specific terms so selected, and it is understood that each specific term comprises all equivalents. In some embodiments, any feature of any embodiment described herein may be used in combination with any feature of any other embodiment described herein. Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein. Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. A blade holder for holding a blade of an ice skate, the ice skate comprising a skate boot for receiving a foot of a skater, the blade holder comprising:

a wall comprising a first polymeric material and defining at least part of a shape of the blade holder; and a filler configured to achieve at least one of contributing to an impact resistance of the blade holder and absorbing vibrations during skating, the filler comprising a second polymeric material different from the first polymeric material;

wherein: the blade holder comprises an upper structure comprising a front member, a rear member and an inner member extending between the front member and the rear member; the inner member defines an upper void; the blade holder comprises a lower structure comprising a front pillar, a rear pillar spaced from the front pillar in a longitudinal direction of the blade holder and an elongated blade-supporting base for supporting the blade between the front pillar and the rear pillar; and the inner member, the front pillar, the rear pillar and the elongated blade-supporting base define a lower void.

2. The blade holder of claim 1, wherein the wall and the filler are affixed to one another by molding of at least one of the wall and the filler.

3. The blade holder of claim 2, wherein the wall of the blade holder is molded over the filler of the blade holder.

4. The blade holder of claim 1, wherein the first polymeric material is a composite material.

5. The blade holder of claim 4, wherein the composite material is a fiber-reinforced polymeric material comprising fibers in a polymeric matrix.

6. The blade holder of claim 5, wherein the fiber-reinforced polymeric material comprises a pre-impregnated fiber layer including respective ones of the fibers.

7. The blade holder of claim 6, wherein: the pre-impregnated fiber layer is a first pre-impregnated fiber layer; and the fiber-reinforced polymeric material comprises a second pre-impregnated fiber layer including respective ones of the fibers distinct from the respective ones of the fibers of the first pre-impregnated fiber layer.

8. The blade holder of claim 5, wherein the fibers comprise carbon fibers.

9. The blade holder of claim 5, wherein the fibers comprise at least one of graphite fibers, carbon graphite fibers, aramid fibers, boron fibers, silicon carbide fibers, ceramic fibers, metallic fibers, glass fibers, and polypropylene fibers.

10. The blade holder of claim 1, wherein the second polymeric material is a foam.

11. The blade holder of claim 1, wherein: the wall defines a cavity;

and at least part of the filler of the blade holder is disposed in the cavity.

12. The blade holder of claim 1, wherein at least part of the wall is part of at least one of the front pillar, the rear pillar and the elongated blade-supporting base.

13. The blade holder of claim 12, wherein the wall of the blade holder includes at least part of the front pillar and at least part of the rear pillar.

14. The blade holder of claim 13, wherein the wall of the blade holder includes at least part of the elongated blade-supporting base.

15. The blade holder of claim 13, wherein the filler of the blade holder includes at least part of the front pillar and at least part of the rear pillar.

16. The blade holder of claim 15, wherein the wall of the blade holder includes at least part of the elongated blade-supporting base and the filler of the blade holder includes at least part of the elongated blade-supporting base.

17. The blade holder of claim 12, wherein the lower structure comprises a U-shaped member including the front pillar, the rear pillar and the elongated blade-supporting base.

18. The blade holder of claim 1, wherein the inner member of the upper structure is a U-shaped member, wherein the wall of the blade holder includes at least part of the U-shaped member.

19. An ice skate comprising the blade holder of claim 1.

20. The blade holder of claim 1, wherein the front pillar extends upwardly towards the front portion of the upper structure, and the rear pillar extends upwardly towards the rear portion of the upper structure.

21. A blade holder for holding a blade of an ice skate, the ice skate comprising a skate boot for receiving a foot of a skater, the blade holder comprising:

a wall comprising a composite material and defining at least part of a shape of the blade holder; and a filler configured to achieve at least one of contributing to an impact resistance of the blade holder and absorbing vibrations during skating, the filler comprising a polymeric material different from the composite material;

wherein: the blade holder comprises an upper structure comprising a front member, a rear member and an inner member extending between the front member and the rear member; the inner member comprises a first arm extending upwardly towards the front member and a second arm extending upwardly towards the rear member; the inner member defines an upper void; the blade holder comprises a lower structure comprising a front pillar, a rear pillar spaced from the front pillar in a longitudinal direction of the blade holder and an elongated blade-supporting base for supporting the blade between the front pillar and the rear pillar; and the upper structure and the lower structure define a lower void.

22. A blade holder for holding a blade of an ice skate, the ice skate comprising a skate boot for receiving a foot of a skater, the blade holder comprising:

a wall comprising a first polymeric material and defining at least part of a shape of the blade holder; and a filler configured to achieve at least one of contributing to an impact resistance of the blade holder and absorbing vibrations during skating, the filler comprising a second polymeric material different from the first polymeric material;

wherein: the wall and the filler of the blade holder are affixed to one another by molding of at least one of the wall and the filler of the blade holder; the blade holder comprises an upper structure comprising a front member, a rear member and an inner member extending between the front member and the rear member; the inner member defines an upper void; the blade holder comprises a lower structure comprising a front pillar, a rear pillar spaced from the front pillar in a longitudinal direction of the blade holder and an elongated blade-supporting base for supporting the blade between the front pillar and the rear pillar; and the inner member, the front pillar, the rear pillar and the elongated blade-supporting base define a lower void.

23. The blade holder of claim 22, wherein the first polymeric material is a composite material.

24. The blade holder of claim 23, wherein the composite material comprises a matrix.

25. The blade holder of claim 24, wherein the matrix comprises a resin.

26. The blade holder of claim 25, wherein the resin comprises a thermosetting polymeric material.

27. The blade holder of claim 25, wherein the resin comprises a thermoplastic polymeric material.

28. The blade holder of claim 25, wherein the resin comprises a hybrid thermosetting-thermoplastic polymeric material.

29. The blade holder of claim 23, wherein the composite material comprises fibers.

30. The blade holder of claim 29, wherein the fibers comprise carbon fibers.

31. The blade holder of claim 29, wherein the fibers comprise graphite fibers.

32. The blade holder of claim 29, wherein the fibers comprise carbon graphite fibers.

33. The blade holder of claim 29, wherein the fibers are oriented to be in tension when the ice skate is deflected in a widthwise direction of the blade holder.

34. The blade holder of claim 22, wherein the first polymeric material is molded.

35. The blade holder of claim 22, wherein the first polymeric material is molded over the second material.

36. The blade holder of claim 22, wherein the second polymeric material comprises foam.

37. The blade holder of claim 22, wherein the first polymeric material comprises fiber-matrix composite material comprising fibers.

38. The blade holder of claim 37, wherein the fibers comprise carbon fibers.

39. The blade holder of claim 37, wherein the fibers comprises glass fibers.

40. The blade holder of claim 37, wherein the fibers comprises polypropylene fibers.

41. The blade holder of claim 22, wherein the second polymeric material is pre-molded.

42. The blade holder of claim 22, wherein the second polymeric material comprises polyurethane.

43. An ice skate comprising a skate boot for receiving a foot of a skater, a blade, and the blade holder of claim 22.

44. The blade holder of claim 22, wherein the front pillar extends upwardly towards the front portion of the upper structure, and the rear pillar extends upwardly towards the rear portion of the upper structure.

* * * * *